US006322183B1

(12) United States Patent
Kubota et al.

(10) Patent No.: US 6,322,183 B1
(45) Date of Patent: Nov. 27, 2001

(54) RECORDING APPARATUS OPERATED IN SPLIT DRIVING MODE AND METHOD OF DRIVING RECORDING APPARATUS

(75) Inventors: Hidemi Kubota, Inagi; Isao Kimura, Kawasaki; Hiroyuki Maeda, Yokohama, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/969,655

(22) Filed: Nov. 13, 1997

(30) Foreign Application Priority Data

Nov. 14, 1996 (JP) ..... 8-303001

(51) Int. Cl.[7] ..... B41J 2/05; B41J 29/38
(52) U.S. Cl. ..... 347/10; 347/12; 347/60
(58) Field of Search ..... 347/9, 10, 11, 347/12, 13, 60, 40

(56) References Cited

U.S. PATENT DOCUMENTS

| | | | | |
|---|---|---|---|---|
| 4,246,154 | | 1/1981 | Yao . | |
| 4,680,332 | | 7/1987 | Hair et al. . | |
| 5,100,471 | | 3/1992 | Winnik et al. . | |
| 5,172,130 | * | 12/1992 | Takahashi | 347/13 |
| 5,172,134 | * | 12/1992 | Kishida et al. | 347/13 |
| 5,173,717 | | 12/1992 | Kishida et al. . | |
| 5,381,164 | * | 1/1995 | Ono | 347/60 X |
| 5,477,245 | * | 12/1995 | Fuse | 347/10 |
| 5,581,281 | * | 12/1996 | Fuse | 347/12 X |
| 5,606,355 | * | 2/1997 | Komatsu | 347/60 |
| 5,621,440 | * | 4/1997 | Takahashi | 347/12 |
| 5,724,077 | * | 3/1998 | Murata | 347/12 |
| 5,903,289 | * | 5/1999 | Takayanagi | 347/13 X |
| 5,907,337 | * | 5/1999 | Tajika et al. | 347/40 |

FOREIGN PATENT DOCUMENTS

| | | |
|---|---|---|
| 0 630 751 A2 | 12/1994 | (EP) . |
| 58-13675 | 1/1983 | (JP) . |
| 62-181372 | 8/1987 | (JP) . |
| 01-272623 | 10/1989 | (JP) . |
| 03-172362 | 7/1991 | (JP) . |
| 03-240586 | 10/1991 | (JP) . |
| 06-49399 | 2/1994 | (JP) . |
| 08-333535 | 12/1996 | (JP) . |

OTHER PUBLICATIONS

Melvin D. Croucher, et al., Design Criteria and Future Directions in Inkjet Ink Technology, *Industrial & Engineering Chemistry Research*, vol. 28, No. 11, Nov. 1989, pp. 1712–1718.

* cited by examiner

*Primary Examiner*—Susan S. Y. Lee
(74) *Attorney, Agent, or Firm*—Fitzpatrick, Cella, Harper & Scinto

(57) ABSTRACT

In control of a recording process in accordance with block driving, the driving timing of a pulse train is avoided from overlapping with each other between blocks, and a load imposed on a power supply during the operation is reduced. To that end, a recording apparatus includes a pulse generating unit for generating a driving pulse train consisted of a number (m) of pulses including a plurality of preheating pulses and one main driving pulse taking part directly in a recording process, the intervals between the (m) pulses being each not less than the total time of pulse widths of the (m) pulses, and a driving unit for dividing a plurality of recording elements into multiple blocks, and driving the recording elements in units of block to perform recording in such a manner that just before the second preheating pulse of the driving pulse train for one block, the first preheating pulse of the driving pulse train for the next block is applied.

14 Claims, 40 Drawing Sheets

RECORDING APPARATUS OPERATED IN SPLIT DRIVING MODE AND METHOD OF DRIVING RECORDING APPARATUS

BACKGROUND OF THE INVENTION

1. Field of the Invention

The present invention relates to a recording apparatus in which recording is performed by ejecting ink to fly in the form of small droplets through ejection ports (orifices) and depositing the small droplets on the surface of a recording material, as well as a method of controlling the recording apparatus.

2. Description of the Related Art

Heretofore, as ink for ink jet recording, water-based ink has been primarily employed from the standpoints of, e.g., ensuring safety and eliminating a bad odor. There are known many types of ink prepared by dissolving or dispersing various water-soluble dyes or pigments in water or a mixture of water and a water-soluble organic solvent, and if necessary adding a moisture retaining agent, a dye dissolving aid, a fungicide, etc. Ink jet recording made using such ink has been rapidly developed in these years because of many advantages of, e.g., enabling high-speed recording to be easily realized as several thousands or more ink droplets can be ejected per second, generating less noise, ensuring easy production of a color image, providing a high resolution, and permitting an image to be printed on plain paper.

Further, with a recent trend toward the lower price, higher performance, and standardization of the GUI (Graphical User Interface) environment in the field of personal computers, there is increasing demand for better color development, higher quality, higher durability, higher resolution and higher speed in image recording using printers or the like. To meet such a demand, technical concepts have been proposed with an aim at holding down feathering, bleeding (color mixing) and other unfavorable properties by leaving color components as much as possible on the.paper surface and making the edges of recording dots sharper.

As the first example, Japanese Patent Laid-Open No. 58-13675 discloses a method of controlling absorption of ink and spread of recording dots into and over paper by addition of polyvinyl pyrrolidone into the ink. As the second example, Japanese Patent Laid-Open No. 3-172362 discloses a method of controlling absorption of ink and spread of recording dots into and over paper by addition of a specific micro-emulsion into the ink.

As the third example utilizing a sol-gel transition phenomenon of ink, Japanese Patent Laid-Open No. 62-181372, and No. 1-272623, as well as others disclose that ink can be prevented from permeating into paper by using an ink which is in the gel form at room temperature and transitions to the sol form upon heating, and recording an image with the ink applied in the sol state to a recording material, because the ink restores to the gel state upon cooling.

As the more recent fourth example, Japanese Patent Laid-Open No. 6-49399 discloses an ink which is added with a compound having a characteristic of thermally gelling in a reversible manner, thereby realizing good color development and fixing property, showing less feathering, and being superior in preservation and reliability of prints, as well as an ink jet recording method and apparatus both using the ink. The technical background of this related art is based on a phenomenon that as a solution of a particular water-soluble high molecule is gradually heated, water solubility of the high molecule is reduced and the solution becomes cloudy at a specific temperature (that is called a clouding point). Typical examples of such a high molecule include, for example, N-isopropyl acrylic amide, polyvinyl methyl ether, polyethylene oxide, and hydroxypropyl cellulose. Because these high molecules show solubility having a negative temperature coefficient, they are separated and precipitated from the solution at temperatures not less than the clouding point. In the precipitating state, viscosity of the solution is lowered due to generation of hydrophobic micro-gel. After being recorded on a recording material in the precipitating state, the solution restores its original viscosity with a temperature effect developed on the surface of the recording material. Thus, the increased viscosity holds down the ink from permeating into paper.

Meanwhile, as the fifth example, M. Croucher et al. point out the problems of conventional homogeneous ink and propose, as inkjet ink in future, an inhomogeneous ink utilizing latex (see M. D. Croucher and M. L. Hair; Ind. Eng. Chem. Res. 1989, 28, 1712–1718, "Design Criteria and Future Direction in Inkjet Ink Technology"). In addition, U.S. Pat. No. 4,246,154 discloses an ink wherein fine particles of a vinyl polymer colored with dyes are stabilized in the anionic form. U.S. Pat. No. 4,680,332 discloses an inhomogeneous ink containing an oil-soluble dye wherein a water-soluble polymer coupled to a non-ionic stabilizer is dispersed a liquid medium. Also, U.S. Pat. No. 5,100,471 proposes a water-based ink consisted of a solvent and colored particles each made up of a polymer core and a silica shell covalently bonded to a dye. This proposed ink has features of enabling colors to develop more sharply on paper, being stable against temperature, and providing high water-resistance.

Further, as the sixth example, Japanese Patent Laid-Open No. 3-240586 proposes a non-water-based ink wherein colored particles covered by a resin swelling with a dispersion medium, such as kerosene, are dispersed in the dispersion medium. It is suggested that this proposed ink is effective particularly in preventing feathering of ink images and clogging of nozzles for ejecting liquid droplets.

The above-stated first and second examples have a problem in fixing property because the ink is prevented from permeating into paper and is to left stand on the paper for a long time without undergoing permeation. Another problem is that there occurs mixing between different colors (i.e., bleeding).

The sol-gel transition ink shown as the third example has a problem that a recorded image may suffer from bleeding and transfer fouling because changes in preservation temperature of prints cause the ink to have fluidity and to flow out.

The ink added with a compound having a characteristic of thermally gelling in a reversible manner, shown as the fourth example, is not suitable for a method of recording an image at such a high speed of not more than 10 msec per pixel as required in ink jet recording, because a rise in viscosity with a temperature drop is too slow as a result of employing water-soluble cellulose ethers. Also, when used in ink jet recording, ink is required to have an upper limit of viscosity not more than 20 mPa·s at the time of ink ejection. The ink must be therefore employed with a low concentration enough to satisfy the above requirement, which makes it hard for the ink to produce the effect of increasing viscosity sufficiently.

On the other hand, of the fifth example group, the ink containing vinyl polymer fine particles stabilized in the anionic form has a problem that a pH range in which the ink can disperse stably is narrow and a selectable range of dyes is small consequently. Another drawback is that spread of recording dots on paper is too small to provide a satisfactory value of optical density (O.D.). Further, the ink is less effective in shortening a fixing time, though this effect is essential for high-speed recording, because a fixing mechanism of the ink depends on only evaporation and permeation as with conventional image forming means.

Another ink of the fifth example group, which contains an oil-soluble dye and in which a water-soluble polymer coupled to a non-ionic stabilizer is dispersed a liquid medium, has an enlarged selectable range of dyes, but is also less effective in shortening a fixing time because a fixing mechanism of the ink depends on only evaporation and permeation as with the above ink. In addition, this ink is disadvantageous in preventing mixing between different colors (i.e., bleeding) because it takes time until adjacent dots are fixed into a stable state.

Still another disperse ink having the polymer-core/silica-shell structure is superior in stability of pigment dispersion, but cannot provide a satisfactory value of O.D. because the ink has no special means for causing a color material to aggregate on the paper surface. Further, this ink is also less effective in shortening a fixing time because its fixing mechanism depends on only evaporation and permeation, thus accompanying a problem of bleeding.

The problem common to the above three types of ink of the fifth example group is that a recorded image has a poor abrasion property as a result of taking no account about adhesion of color material particles onto the paper surface.

The ink of the sixth example is problematic in points of safety, a bad odor and so on because kerosene is used as the dispersion medium.

Physical properties required for water-based ink, in particular, required for ejecting the ink in the form of small droplets for ink jet recording will be now explained below. The physical properties required for inkjet ink to be ejected in the form of small droplets are given by;

surface tension; >20 dyne/cm (relating to a refill speed), viscosity; 1–20 mpa·s, pH: 3–10, and fixing time<20 sec (preferably as short as possible).

Here consider transition of ink onto paper. Generally, there is known the Lucas-Washburn's equation about a transition phenomenon of a liquid onto paper. Assuming that the amount of the liquid transited is V, the index of paper roughness is Vr, the absorption coefficient is Ka, the transition time is T, and the wetting start time is Tw, the Lucas-Washburn's equation is expressed by the following formula (1) when the liquid is water:

$$V=Vr+Ka\sqrt{T-Tw} \tag{1}$$

In the formula (1), Ka relates to physical properties of both paper and ink, and is expressed by the following formula (2):

$$Ka=\sqrt{r\cdot\frac{\gamma\cos\theta}{2\eta}} \tag{2}$$

In the formula (2), r is the diameter of a capillary, $\gamma$ is the surface tension of the liquid, $\theta$ is the contact angle, and $\eta$ is the viscosity of the liquid.

As is apparent from the formula (1), to leave a color material on the paper surface, it is required to slow down permeation of a liquid, i.e., to reduce the absorption coefficient Ka (the evaporation time can be prolonged by reducing Ka). It is also apparent that, to the above end, physical properties of ink preferably have a smaller surface tension, a larger viscosity and a larger contact angle. But since there are restrictions in those physical properties of ink for ink jet recording, adjustment of Ka is not easy.

On the other hand, where the liquid is a non-aqueous solvent, e.g., ethanol, the wetting time Tw in the formula (1) can be ignored and therefore the fixing time can be shortened. However, since the absorption coefficient Ka is increased to promote an effect of permeating ink, a printed image is more susceptible to feathering. Further, since the term of $\cos\theta$ in the formula (2) is determined depending on a combination of ink and paper, image quality depends on the types of paper. Thus, the ink using a non-aqueous solvent cannot satisfy a paper selection property.

The above-mentioned problems are believed to possibly occur also in conventional color-material dispersed ink so long as image formation depends on only evaporation and permeation.

With a view of solving the problems mentioned above, the inventors previously proposed it to use an ink for printing which contains a high molecule having viscosity that increases in a thermally reversible manner (Japanese Patent Laid-Open No. 8-333535).

Taking into account the above-stated restrictions being attributable to the fact that ink is a liquid in the homogenous state of a color material and a solvent regardless of temperature, the inventors proposed in the above Japanese Patent Application an ink which causes a state change triggered depending on temperature so that the color material and the solvent separately behave on a recording material.

To explain the state change in more detail, high molecule particles are isolatedly dissolved in the ink state at room temperature, but they aggregate at temperature higher than a certain value into a dense liquid having a high viscosity, and form a state where the color material is coupled to the high molecule. By applying the ink in the latter state to the recording material, recording is made with a dense color material phase left on the surface of the recording material, while a thin solvent phase permeates into the recording material. Also, the state change must be reversible to be adapted for a wide range of environment temperature under which recording is potentially made.

In practice, when small droplets of ink are ejected from a recording head, it is advantageous for high-speed recording that the ink has a low viscosity. A phenomenon of the above state change can be therefore realized by ejecting the ink in the state having a low viscosity in operation of the recording head, and recording the ink on a recording material heated up to above the transition temperature. Owing to the relationship of temperature of the ink droplets<temperature of the recording material in the above case, at the moment the ink droplets adhere to the surface of the recording material, the surface of the recording material is cooled to provide a slight time lag in rising of the ink droplet temperature up to the transition temperature. During the lag time until reaching the transition temperature and showing a high viscosity, the ink droplets have a low viscosity and therefore the ink permeates into the recording material in accordance with the Lucas-Washburn's equation. This mechanism also serves as means for solving a problem that if the color material is all left on the surface of the recording material, a recorded image would have a poor abrasion property.

The transition temperature is preferably set to be higher than the environment temperature (room temperature) under which recording apparatus is usually employed, and to fall in the range of 35° C. to 100° C. to enhance the effect of increasing viscosity depending on temperature (i.e., to enlarge a temperature difference between before and after the state change). The transition temperature equal to 100° C. or higher is not preferable because it would cause a notable increase in viscosity due to evaporation of water in the ink. As shown in a viscosity characteristic graph of FIG. 1, by way of example, the ink preferably has the transition temperature in the range of 46° C. to 48° C.

Meanwhile, as a method of ejecting ink for recording, there is known an ink jet type applying thermal energy to the ink and causing ink droplets to fly out through orifices. In such an ink jet method, a bubble is generated in the ink with the applied thermal energy, whereupon the ink droplets are given kinetic energy enough to eject through the orifices. When ejecting the above-proposed ink by the ink jet method, heating the average temperature of the ejected ink droplets up to the transition temperature is more efficient as a heating method than heating paper separately. However, when such an ink as requiring much heat to be applied for ejection, like the above-proposed ink, is ejected, the conventional heating method may not impart sufficient thermal energy to the ink. In some cases, before sufficient thermal energy Is transmitted to the ink, a bubble is abruptly generated and the ink is thermally isolated from a heater.

To solve the above problem, therefore, the inventors proposed a driving method for averaging heat flux transmitted from the heater surface to the ink in a controlled manner. As one example of such a driving method, the inventors showed a method of heating and ejecting the ink by using a train of five pulses. In that example, the driving voltage was set to 7.5 V (this voltage value itself has no direct meaning in relation to the actual process and is merely one instance because the amount of heat actually generated varies in the resistance value of a heater; that is, what has actual meaning is a value of heat flux explained below). As shown in FIG. 27, the ink was heated by a train of five pulses each having a crest value of 7.5 V.

In the above example, as shown in FIG. 28, heat flux was produced in the form of a pulse train corresponding to the driving voltage. A peak value of heat flux produced upon application of the driving voltage exceeded 100 [$MW/m^2$] and, particularly, it rose to 140 [$MW/m^2$] at the time a bubble was generated. This enabled the bubble to stably generate in volume sufficient to provide a strong ejection force even with the above-proposed ink. Also, as shown in FIG. 29, the ink being 10 $\mu$m over the heater surface was heated up to 69.6° C. until generation of a bubble. Thus, an effect of sufficiently heating the ink to be ejected was achieved.

The driving method of generating one bubble with a plurality of driving signals as stated above, however, is inconvenient in the case of ejecting ink through a number of nozzles. Although a printing head usually has a number of nozzles for realizing high-speed printing, a load imposed on a power supply is remarkably increased if heaters for those nozzles are energized at the same time. In the technical field of ink jet recording and thermal transfer recording, therefore, a block driving method has been widely used for the purposes of reducing the load imposed on the power supply and realizing high-speed printing. With the block driving method, the nozzles are divided into a plurality of blocks which are energized with a small time lag therebetween, and arrangement of the nozzles is shifted to eject ink in proper sequence so that the printing result is not affected.

Where a pulse for driving one nozzle is given by a single pulse, or where, though it consists of a plurality of pulses, these pulses have so short time intervals as to be virtually regarded as a single pulse, the above block driving method does not accompany a notable difficulty. For example, when 64 nozzles are divided into 8 blocks each comprising 8 nozzles and each nozzle is driven by a pulse of 3 $\mu$s, respective first nozzles of the 8 blocks are driven at the same time, and after several $\mu$s, respective second nozzles of the 8 blocks are driven at the same time. Subsequently, respective third to eighth nozzles of the 8 blocks are all driven in a like manner. This makes it possible to drive all the nozzles in a shatter time, alleviate a shift in printing, and reduce the load imposed on the power supply upon simultaneous driving.

Where a driving pulse applied to one nozzle is given by a train of five pulses and the time intervals between the five pulses are predetermined like the above-explained example, however, it is difficult to freely apply the block driving method. As one example for applying the driving signals, which is not the known art, but taken into account in studies made for accomplishing the present invention, FIG. 30 shows a pulse train consisted of three pre-pulses (for preheating) each having a width of 1 $\mu$s and a driving pulse proper (pulse for generating a bubble directly) having a width of 3 $\mu$s, with intervals between the pulses being each 7 $\mu$s. The illustrated example is to drive a nozzle array comprising 8 blocks. In the block driving method, it is preferable from the standpoint of causing no shifts in a recorded image that driving of all the blocks is completed as quick as possible. To this end, therefore, the block driving method is required to be executed such that the first signal of the second block, for example, locates between the first and second signal of the first block. In the example of FIG. 30, the driving signals of the second block are issued with a delay of 1 $\mu$s from the driving signals of the first block, the driving signals of the third block are issued with a delay of 1 $\mu$s from the driving signals of the second block, and so on. The driving signals of the eighth block are finally issued with a delay of 1 $\mu$s from the driving signals of the seventh block.

In the illustrated example, because the driving signals of the respective blocks are shifted 1 $\mu$s from one another, the preheating pulses each having a width of 1 $\mu$s are not overlapped. But the driving pulse has a width of 3 $\mu$s, and therefore the driving pulse of the first block overlaps with the driving pulse of the second block for a period of 2 $\mu$s. During this period, a current value is doubled and a power supply requires a current capacity twice as much. In the illustrated example, because the driving pulse of the third block further overlaps with the driving pulses of the first and second blocks, the power supply actually requires a current capacity triple as much. If the respective blocks are driven with a time lag of 3 $\mu$m therebetween to prevent the driving pulses from overlapping with each other, overlaps between the driving pulses are avoided, but the driving pulse of the first block overlaps with the third preheating pulse of the fourth block and subsequently the second preheating pulse of the seventh block. Accordingly, the power supply requires a current capacity twice as much for a period of 2 $\mu$s.

SUMMARY OF THE INVENTION

The present invention has been made in view of the above-stated problems in the art, and its object is to provide a recording apparatus and a method of controlling the recording apparatus, with which in control of a recording process for executing block driving by the use of two or more preheating pulses, the driving timing of a pulse train including pulses having different widths is properly adjusted to prevent the driving timing from overlapping with each other between blocks, and to reduce a load imposed on a power supply during operation.

Another object of the present invention is to provide a recording apparatus and a method of controlling the recording apparatus, with which ink having transition temperature can be ejected in a sufficiently heated state and behavior of the ink on a recording material can be controlled appropriately to ensure image recording with high quality, in addition to reducing a load imposed on a power supply as with the above object.

To achieve the above objects, according to one aspect of the present invention, there is provided a recording apparatus comprising a recording head having a plurality of recording elements for recording an image by utilizing heat, pulse generating means for generating a driving pulse train consisted of a number (m) of pulses including a number (m−1) [m−1>2] of preheating pulses each having a pulse width (a), and one main driving pulse having a longer pulse width (b) than the pulse width (a) of the preheating pulses and taking part directly in a recording process, the intervals between the (m) pulses being equal and each not less than [a×(m−1)+b], and driving means for dividing the plurality of recording elements into multiple blocks, and driving the recording elements in units of block to perform recording in such a manner that just before the second preheating pulse of the driving pulse train for one block previously driven, the driving pulse train for the next block is supplied. According to another aspect, there is provided a recording apparatus comprising a recording head having a plurality of recording elements for recording an image by utilizing heat, pulse generating means for generating a driving pulse train consisted of a number (m) of pulses including a plurality of preheating pulses and one main driving pulse taking part directly in a recording process, the intervals between the (m) pulses being each not less than the total time of pulse widths of the (m) pulses, and driving means for dividing the plurality of recording elements into multiple blocks, and driving the recording elements in units of block to perform recording in such a manner that just before the second preheating pulse of the driving pulse train for one block, the first preheating pulse of the driving pulse train for the next block is applied.

According to a further aspect of the present invention, there is provided a method of controlling a recording apparatus including recording means in which a plurality of recording elements for recording an image by utilizing heat are divided into multiple blocks, and the recording elements are driven in units of block in accordance with a driving pulse train input for each of the blocks, the method comprising the steps of generating a driving pulse train consisted of a number (m) of pulses including a number (m−1) [m−1>2] of preheating pulses each having a pulse width (a), and one main driving pulse having a longer pulse width (b) than the pulse width (a) of the preheating pulses and taking part directly in a recording process, the intervals between the (m) pulses being equal and each not less than [a×(m−1)+b], and dividing the plurality of recording elements into multiple blocks, and driving the recording elements in units of block to perform recording in such a manner that just before the second preheating pulse of the driving pulse train for one block previously driven, the driving pulse train for the next block is supplied.

According to a still further aspect of the present invention, there is provided a method of controlling the recording apparatus including recording means in which a plurality of recording elements for recording an image by utilizing heat are divided into multiple blocks, and the recording elements are driven in units of block in accordance with a driving pulse train input for each of the blocks, the method comprising the steps of generating a driving pulse train consisted of a number (m) of pulses including a plurality of preheating pulses and one main driving pulse taking part directly in a recording process, the intervals between the (m) pulses being each not less than the total time of pulse widths of the (m) pulses, and dividing the plurality of recording elements into multiple blocks, and driving the recording elements in units of block to perform recording in such a manner that just before the second preheating pulse of the driving pulse train for one block, the first preheating pulse of the driving pulse train for the next block is applied.

DETAILED DESCRIPTION OF THE PREFERRED EMBODIMENTS

First Embodiment

[Ink Jet Recording Apparatus]

An ink jet recording apparatus according to a first embodiment will be described below.

Figure 2:
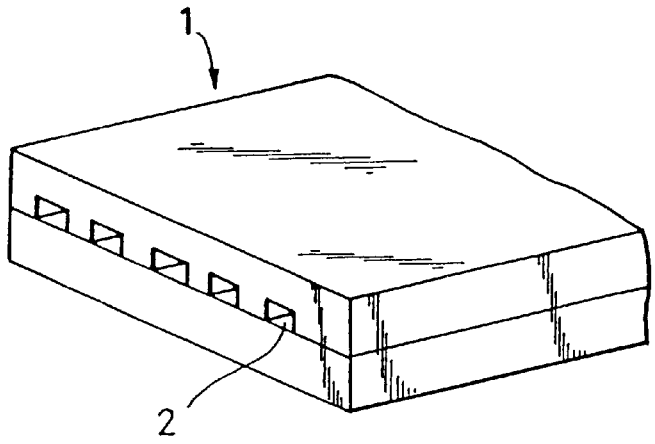
FIG. 2 is a perspective view showing an appearance of a multi-head having a plurality of orifices.
Figure 3:
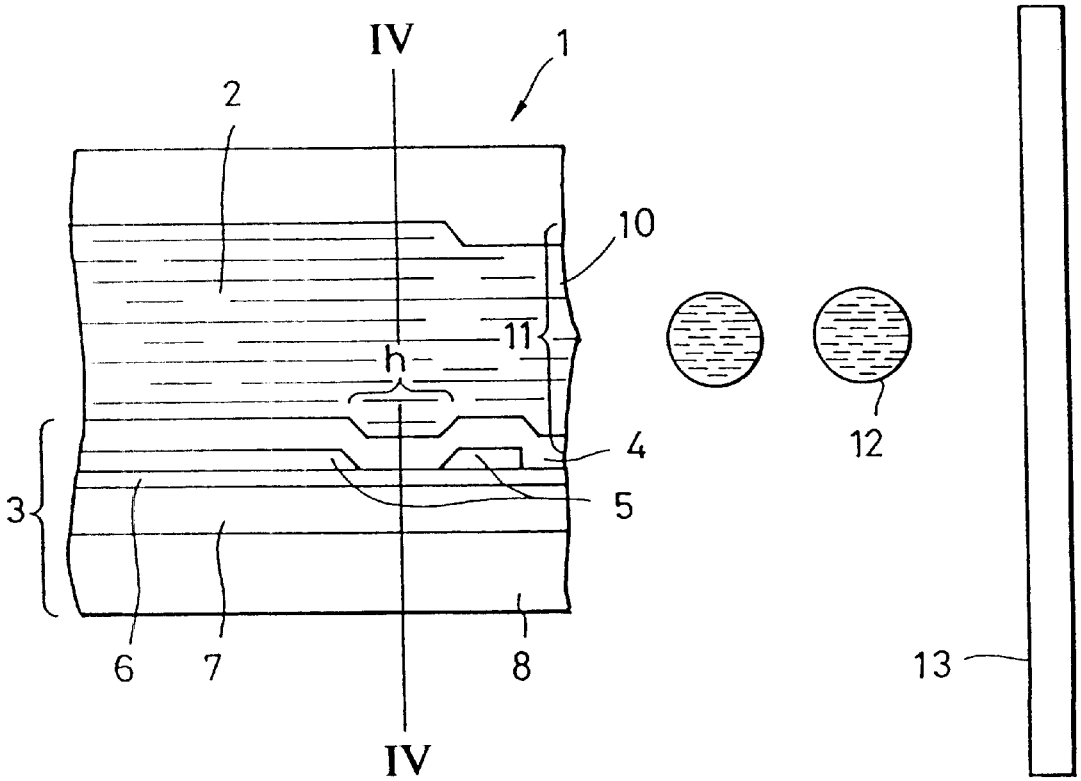
FIG. 3 is a sectional view of the multi-head taken along one ink flow passage.
Figure 4:
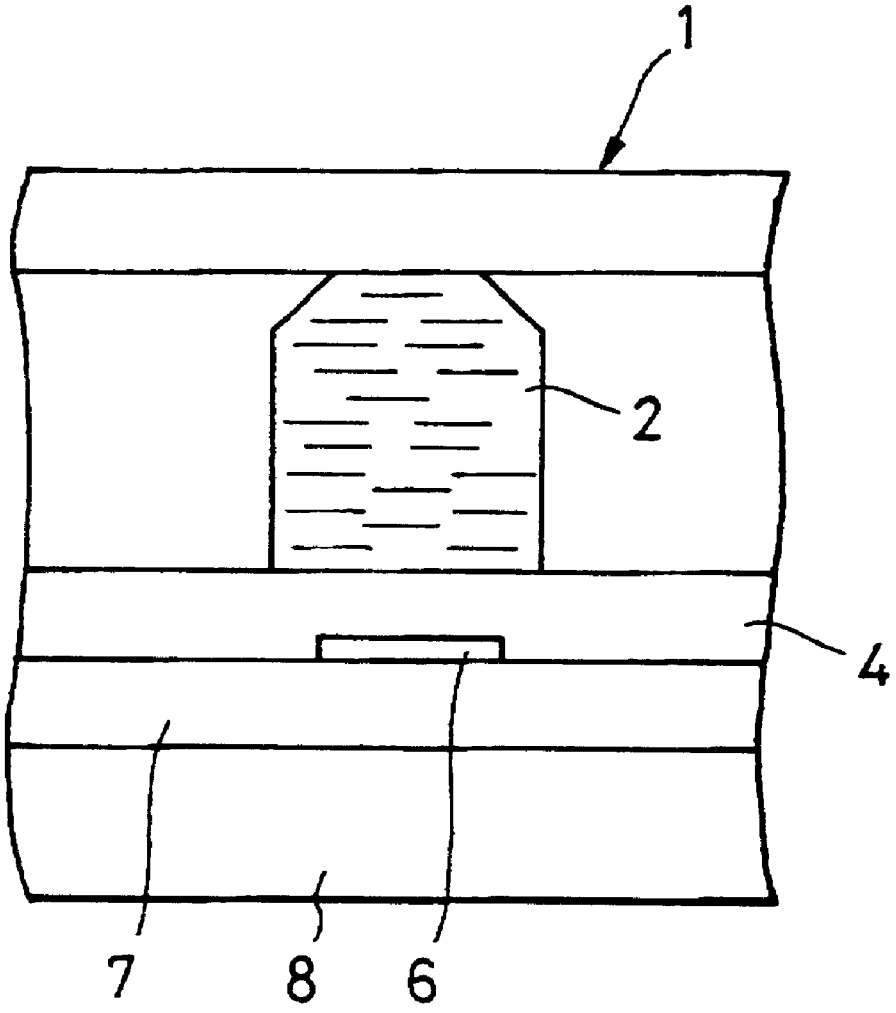
FIG. 4 is a sectional view taken along line IV—IV in FIG. 3.

An example of the structure of a head of the ink jet recording apparatus, i.e., a principal part of a recording apparatus utilizing thermal energy, is first shown in FIGS. 2, 3 and 4. FIG. 2 is a perspective view showing an appearance of a multi-head having a plurality of orifices. FIG. 3 is a sectional view of the multi-head of FIG. 2 taken along one ink flow passage. FIG. 4 is a sectional view taken along line IV—IV in FIG. 3.

In FIG. 2, denoted by reference numeral 1 is a head having a plurality of ink flow passages 2. The structure of the head 1 will be described in detail with reference to the sectional view (FIG. 3) taken along one ink flow passage 2 and the sectional view (FIG. 4) taken along line IV—IV in FIG. 3. The head 1 is constructed by bonding a plate made of, e.g., glass, ceramic or plastic and having the flow passages (nozzles) 2 through which the ink passes, and a heat-generating element board 3 together. The heat-generating element board 3 comprises a protective layer 4 formed of, e.g., silicon oxide, silicon nitride or silicon carbide, an electrode 5 formed of, e.g., aluminum, gold or an aluminum-copper alloy, a heat-generating resistance material layer 6 formed of a material having the high melting point such as $HfB_2$, TaN or TaAl, a heat accumulating layer 7 formed of, e.g., thermally oxidized silicon or aluminum oxide, and a base plate 8 formed of a material having a high heat-radiating ability such as silicon, aluminum or aluminum nitride.

When an electric signal (driving signal) in the form of a pulse is applied to the electrode 5 of the head, an area of the heat-generating element board 3 indicated by h quickly generates heat so that a bubble is produced in ink contacting the surface of the protective layer 4 in the area h. A meniscus 10 is projected forwardly with a resultant pressure, causing the ink to eject and fly in the form of a recording small droplet 12 from the nozzle 2 of the head toward a recording material 13 on which an image is to be printed.

Figure 5:
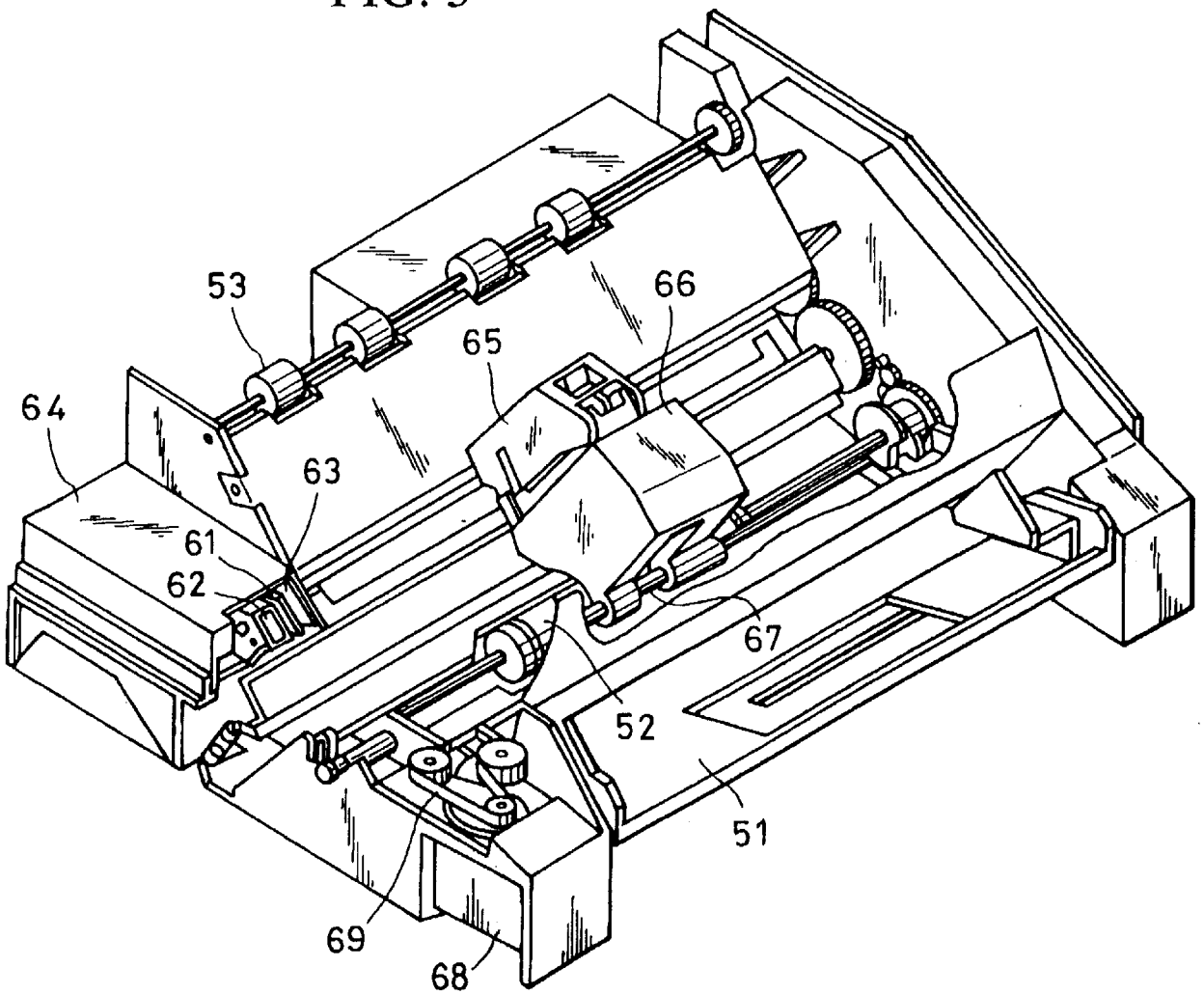
FIG. 5 is a perspective view showing one example of an ink jet recording apparatus in which the multi-head is incorporated.

FIG. 5 shows one example of the ink jet recording apparatus in which the aforesaid head is incorporated. In FIG. 5, denoted by 61 is a blade as a wiping member in the form of a cantilever, of which one end is fixedly held by a blade holding member. The blade 61 is disposed in a position adjacent to a recording area covered by the recording head, and includes a cap 62 which is movable in a direction perpendicular to the direction of movement of the recording head such that it comes into contact with the orifice surface for capping the orifice. 63 is an ink absorber which is disposed adjacent to the blade 61 and is held in such a manner as to project into the travel path of the recording head similarly to the blade 61. The blade 61, the cap 62 and the absorber 63 cooperatively construct an ejection recovery unit 64 in which the blade 61 and the absorber 63 serve to remove moisture, dust, dirt, etc. on the orifice surface.

Denoted by 65 is a recording head which includes an ejection energy generating means (electro-thermal transducer) for generating thermal energy upon receiving the driving signal and ejecting the ink onto the recording material which is disposed in opposed relation to the orifice surface including the orifices arrayed therein, for recording an image. 66 is a carriage on which the recording head 65 is mounted to be reciprocally moved together. The carriage 66 is slidably engaged with a guide shaft 67 and is also connected at its part to a belt 69 driven by a motor 68. With such an arrangement, the carriage 66 is movable along the guide shaft 67 so that the recording head 65 can move over the recording area and an area adjacent thereto. Denoted by 51 is a paper feed portion through which the recording material is inserted, and 52 is a paper feeding roller driven by a motor (not shown). With such an arrangement, the recording material is fed to a position opposed to the orifice surface of the recording head, and is then guided to a paper discharge portion, in which paper discharging rollers 53 are disposed, with the progress of a recording process.

In the above arrangement, when the recording head 65 is returned to the home position upon the completion of recording, the cap 62 in the head recovery Unit 64 is retracted from the travel path of the recording head 65, but the blade 61 is held projected into the travel path. As a result, the orifice surface of the recording head 65 is wiped by the blade 61. When the cap 62 is brought into contact with the orifice surface of the recording head 65 for capping the orifices, it is moved so as to project into the travel path of the recording head. On the other hand, when the recording head 65 is moved from the home position to the recording start position, the cap 62 and the blade 61 are in the same positions as in the above wiping state. During that movement, therefore, the orifice surface of the recording head 65 is likewise wiped again.

Figure 6:
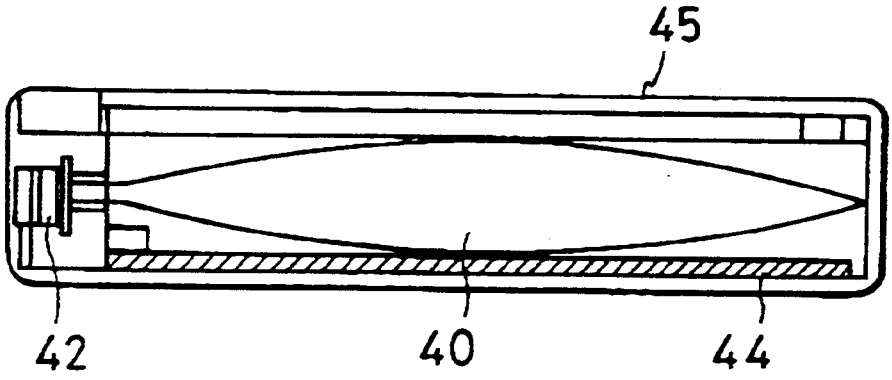
FIG. 6 is a view showing one example of an ink cartridge containing ink supplied to a recording head through an ink supply member, e.g., a tube.

The movement of the recording head to the home position adjacent to the recording area is performed not only upon the completion of recording or the recovery of ejection, but also at predetermined intervals during the time in which the recording head is reciprocally moved over the recording area for recording an image. For each of such movements, the wiping of the orifice surface of the recording head is made. FIG. 6 shows one example of an ink cartridge containing ink supplied to the recording head through an ink supply member, e.g., a tube. In FIG. 6, denoted by 40 is an ink storage portion, e.g., an ink bag, which contains the ink to be supplied and has a rubber-made plug 42 provided at its leading end. By sticking a needle (not shown) through the plug 42, the ink in the ink bag 40 can be supplied to the head. 44 is an ink absorber for accommodating waste ink. The ink storage portion preferably has an ink contact surface formed of a polyolefin, in particular, polyethylene.

Figure 7:
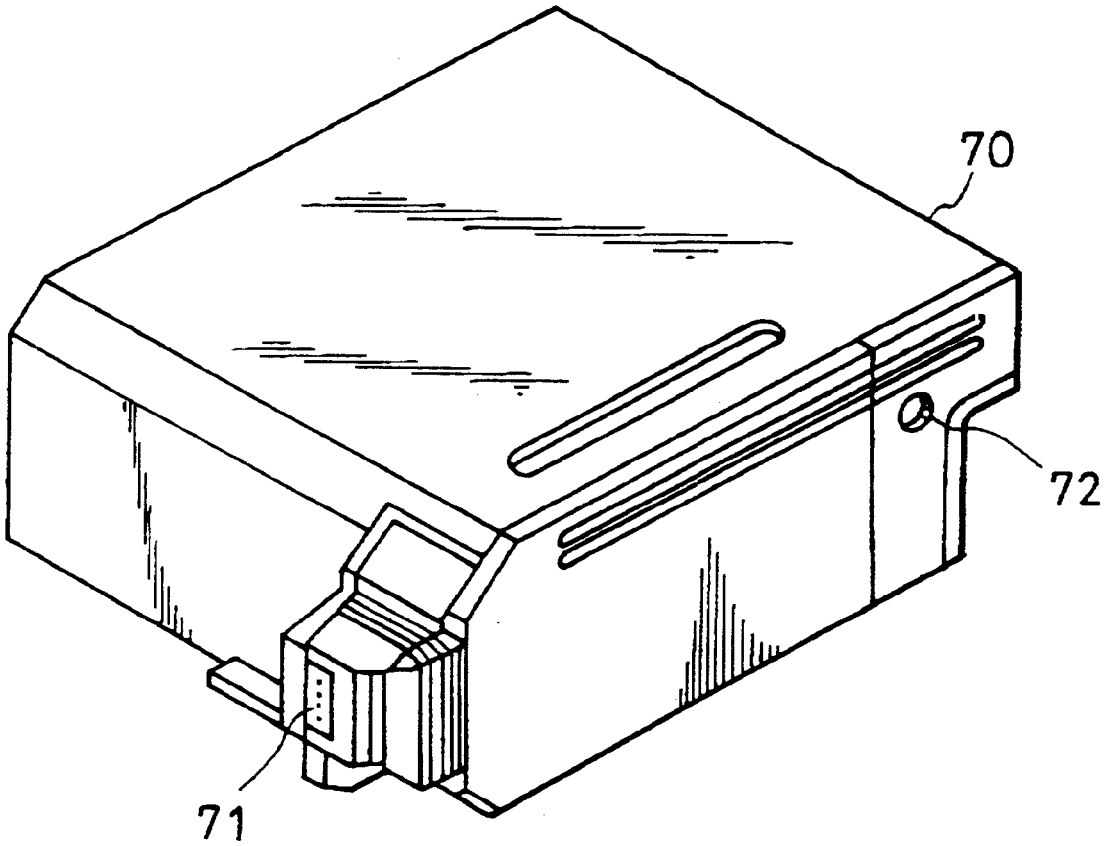
FIG. 7 is a perspective view showing a unit comprised of the ink jet recording head and the ink cartridge both incorporated together therein.

The ink jet recording apparatus for use in this embodiment is not limited to the above-stated construction in which the head and the ink cartridge are separated from each other, but also suitably applicable to the construction in which both the members are integral with each other as shown in FIG. 7. Referring to FIG. 7, denoted by 70 is a recording unit in which an ink storage portion containing ink therein, e.g., an ink absorber, is housed. The ink held in the ink absorber is ejected in the form of ink droplets through a head portion 71 having a plurality of orifices. In this embodiment, a material of the ink absorber is preferably of polyurethane. Also, instead of using the ink absorber, the ink storage portion may have a structure like an ink bag in which a spring or the like is built. Denoted by 72 Is an atmosphere communicating port via which the interior of the recording unit is communicated with the atmosphere. The recording unit 70 is to be employed in place of the recording head shown in FIG. 2, and can be attached to the carriage 66 in a detachable manner.

[Driving Method]

Figure 8:
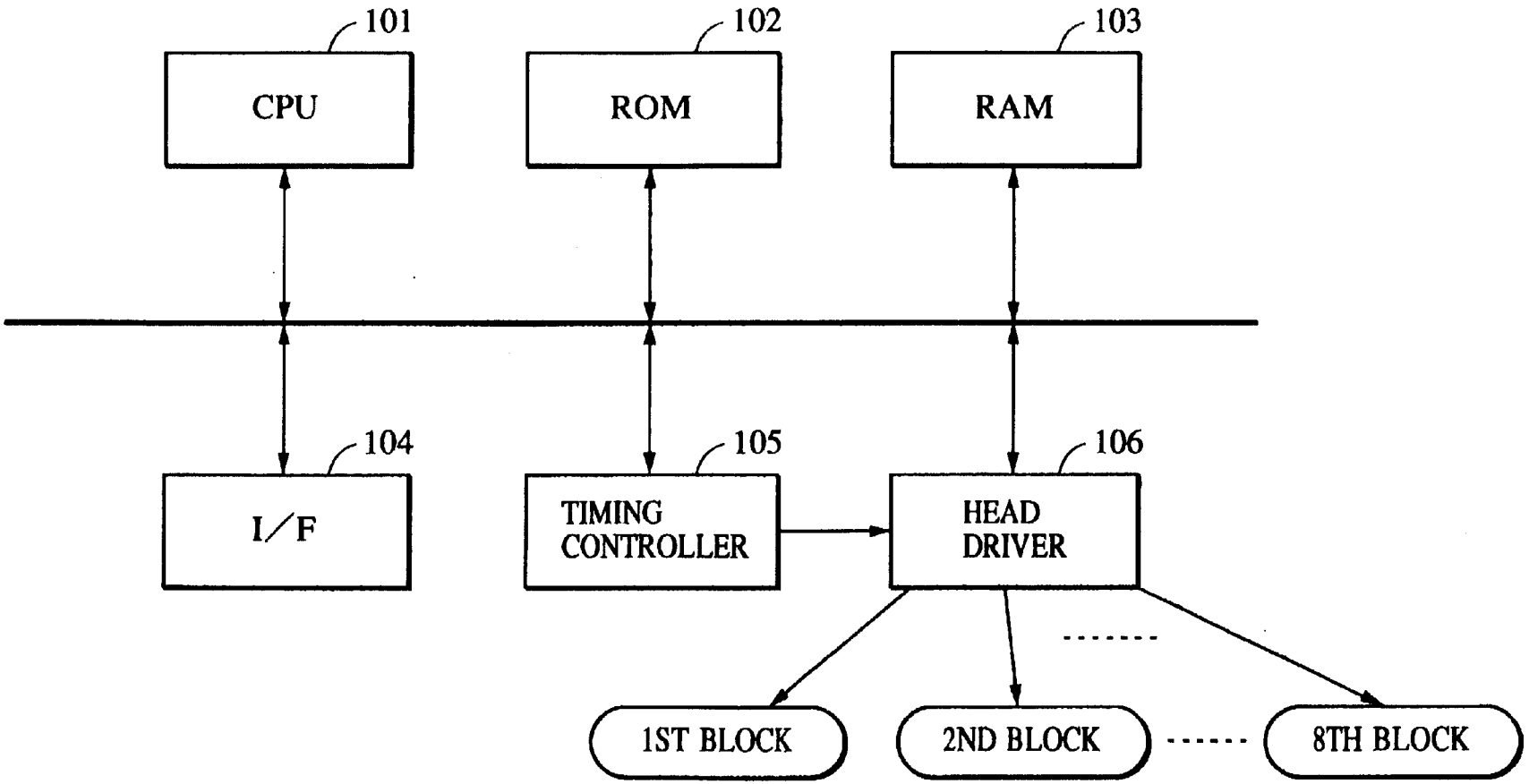
FIG. 8 is a block diagram showing the schematic control configuration of an ink jet recording apparatus according to a first embodiment of the present invention.

FIG. 8 is a block diagram showing the schematic control configuration of the ink jet recording apparatus according to the first embodiment. In FIG. 8, a CPU 101 performs various kinds of control in the ink jet recording apparatus. A ROM 102 stores various control programs executed by the CPU 101 and data. A RAM 103 provides a working area necessary when the CPU 101 executes various kinds of control. The RAM 103 also includes an area for loading image data which is obtained by developing input printing data.

An interface 104 receives printing data from an external apparatus such as a host computer. A timing controller 105 controls the driving timing of each block so that an amount of power consumed during the printing operation will not exceed the amount of power consumed per block. A head driver 106 drives the nozzles of the recording head in units of block in accordance with the image data loaded in the RAM 103, thereby forming a visible image. It is assumed in this embodiment that the recording head is driven by dividing the nozzles into eight blocks, i.e., first to eighth blocks. Also, block split driving in the head driver 106 is performed by using a conventional circuit configuration.

Figure 9:
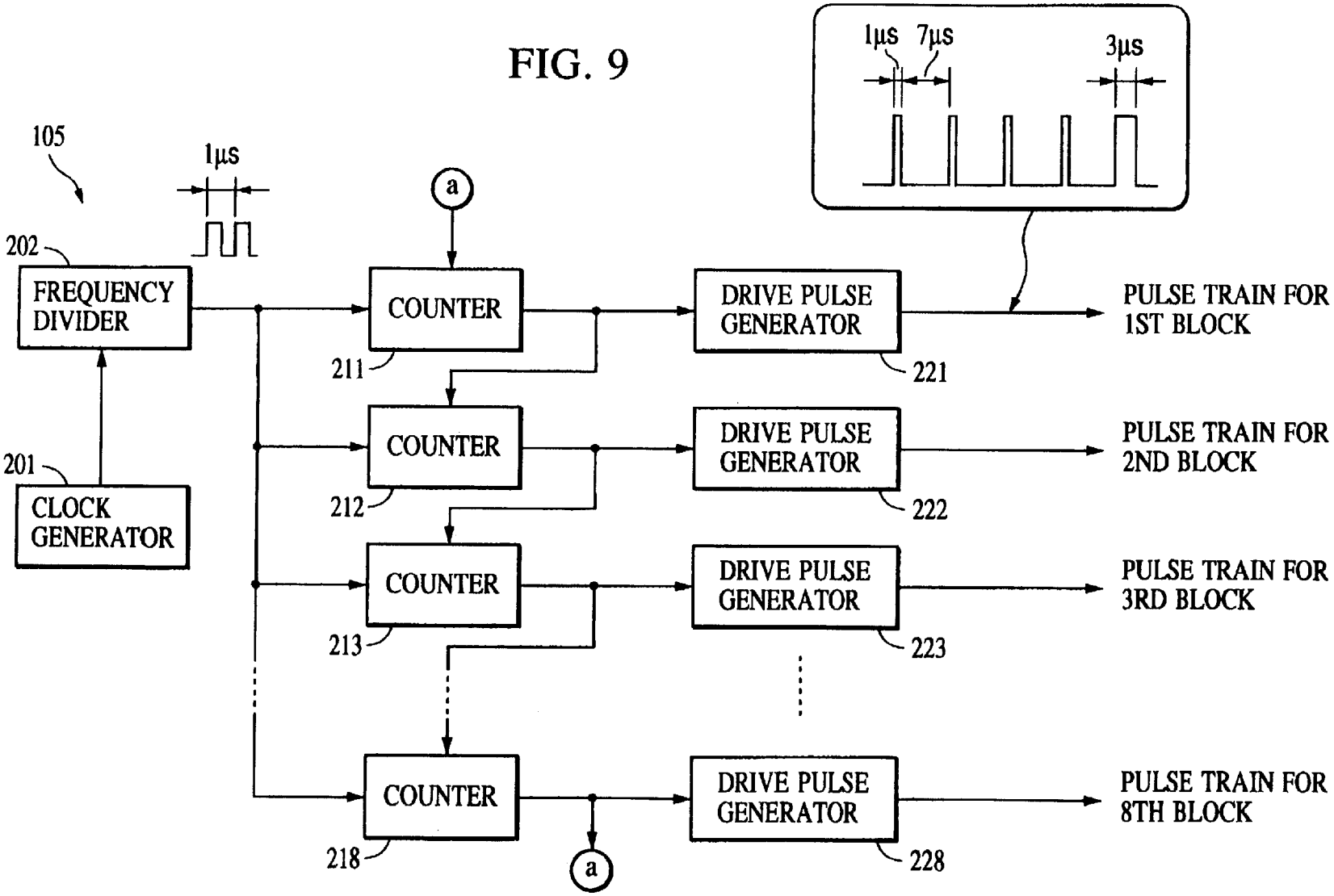
FIG. 9 is a block diagram showing the configuration of a timing controller.

FIG. 9 is a block diagram showing the configuration of the timing controller 105. A clock generator 201 generates an original clock for various clocks used in the ink jet recording apparatus of this embodiment. A frequency divider 202 generates a clock pulse of 1 $\mu$s period from the clock generated by the clock generator 201. This clock pulse of 1 $\mu$s period is employed for producing a driving pulse of the ink jet head. Counters 211–218 output count-up signals which are employed as signals for starting generation of pulse trains from driving pulse generators described later. Denoted by 221–228 are driving pulse generators which generate driving pulses for the corresponding blocks. As shown in FIG. 9, the driving pulse generators each generate a pulse train consisted of four pre-pulses (preheating pulses) each having a width of 1 $\mu$s and one driving pulse having a width of 3 $\mu$s, these pulses succeeding one after another with intervals of 7 $\mu$s therebetween. Generation of the pulse trains from the driving pulse generators 221–228 is started in response to the count-up signals from the counters 211–218 which are connected to the corresponding driving pulse generators 221–228. Further, the pulse trains are generated from the driving pulse generators 221–228 in synch with the clock pulse of 1 $\mu$s from the frequency divider 202.

An initial value "7" is set to each of the counters 211–218. First, when the counter 211 receives the clock pulse from the clock generator 201 and finishes a count-up, a count-up signal is input to the driving pulse generator 221 which generates the pulse train shown in FIG. 9. The count-up signal from the counter 211 is also input to the counter 212 as an enable signal for the counter 212. In response to rising of the enable signal, the counter 212 sets a count value "7" and starts counting the clock pulse. Then, when the counter 212 counts up seven clock pulses, a count-up signal is input to the driving pulse generator 222 and simultaneously supplied to the counter 213 as an enable signal. After repeating the above operation until the counter 218, a count-up signal from the counter 218 is used as an enable signal for the counter 211.

Figure 31:
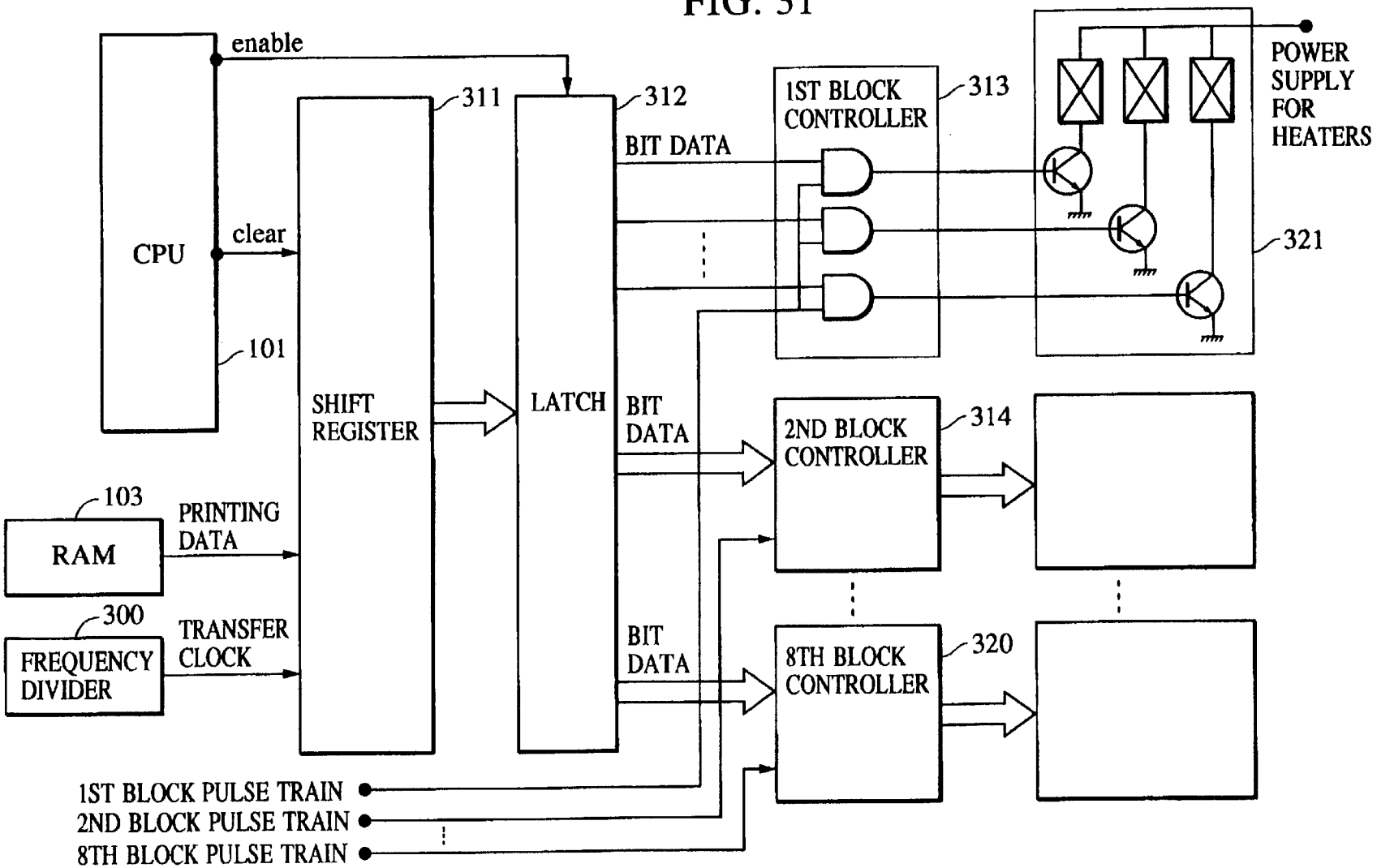
FIG. 31 is a block diagram showing the circuit configuration of a head driver.

FIG. 31 is a block diagram showing the circuit configuration of the head driver 106. In FIG. 31, a shift register 311 serially receives printing data in synch with a pixel clock, and outputs bit data for 8 blocks in parallel. Serial transfer of the printing data from the RAM 103 to the shift register 311 is performed in synch with a transfer clock which is obtained by frequency-dividing the clock, generated from the clock generator 201 in FIG. 9, by a frequency divider 300.

A latch 312 performs latching operation in synch with an enable signal from the CPU 101, and at the time the bit data for 8 blocks is all output from the shift register 311, it holds the register outputs. The bit data held in the latch 312 is then distributed and input to first to eighth block controllers 313–320.

The first to eighth block controllers 313–320 are each made up of, as shown, a plurality of AND circuits which output AND values of the pulse trains for the first to eighth blocks from the driving pulse generators 221–228 (FIG. 9) and the bit data. For example, the first block controller 313 takes AND values of the first block pulse train from the driving pulse generator 221 and the bit data corresponding to respective pixels of the first block and supplied from the latch 312, and outputs the ANDed results to a heater driver 321 for the first block. Consequently, heaters of the recording head corresponding to pixels for which the bit data is 1 are energized in accordance with the on/off timing of the first block pulse train.

Figure 10:
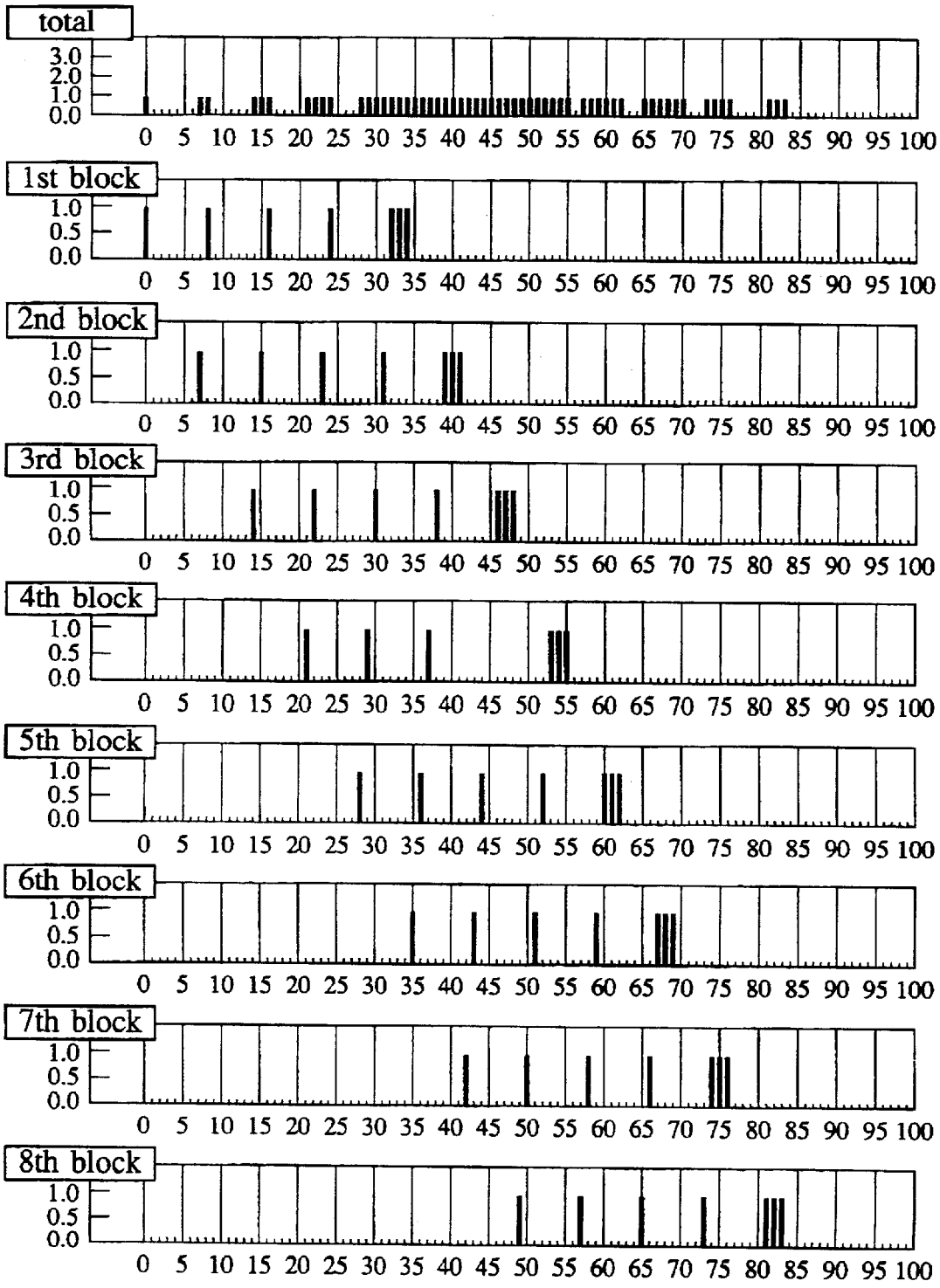
FIG. 10 is a chart showing the timed relationship in a block driving method according to the first embodiment.
Figure 11A:
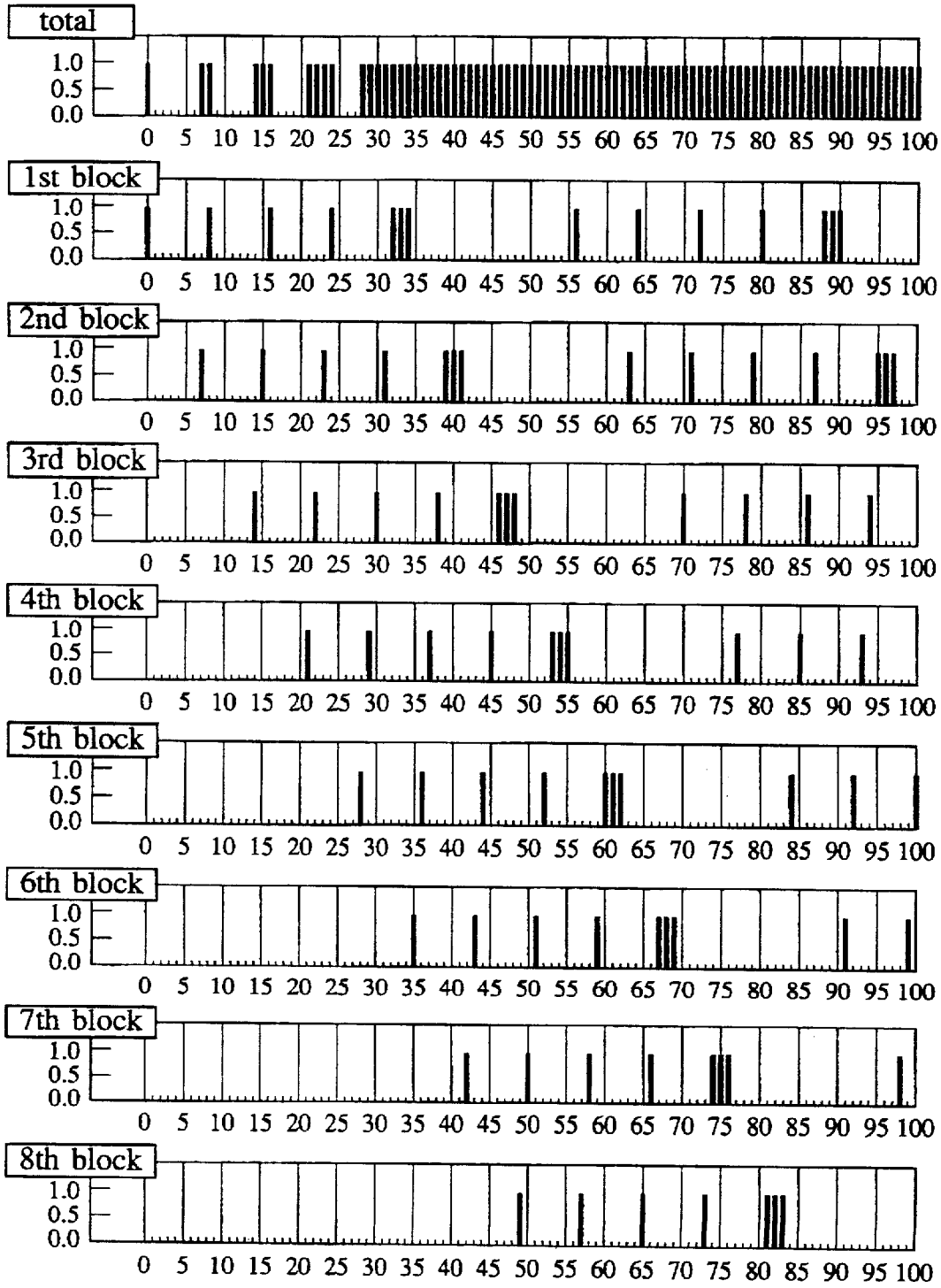
FIG. 11A is a chart for explaining the timed relationship of continuous driving in the block driving method of the first embodiment.
Figure 11B:
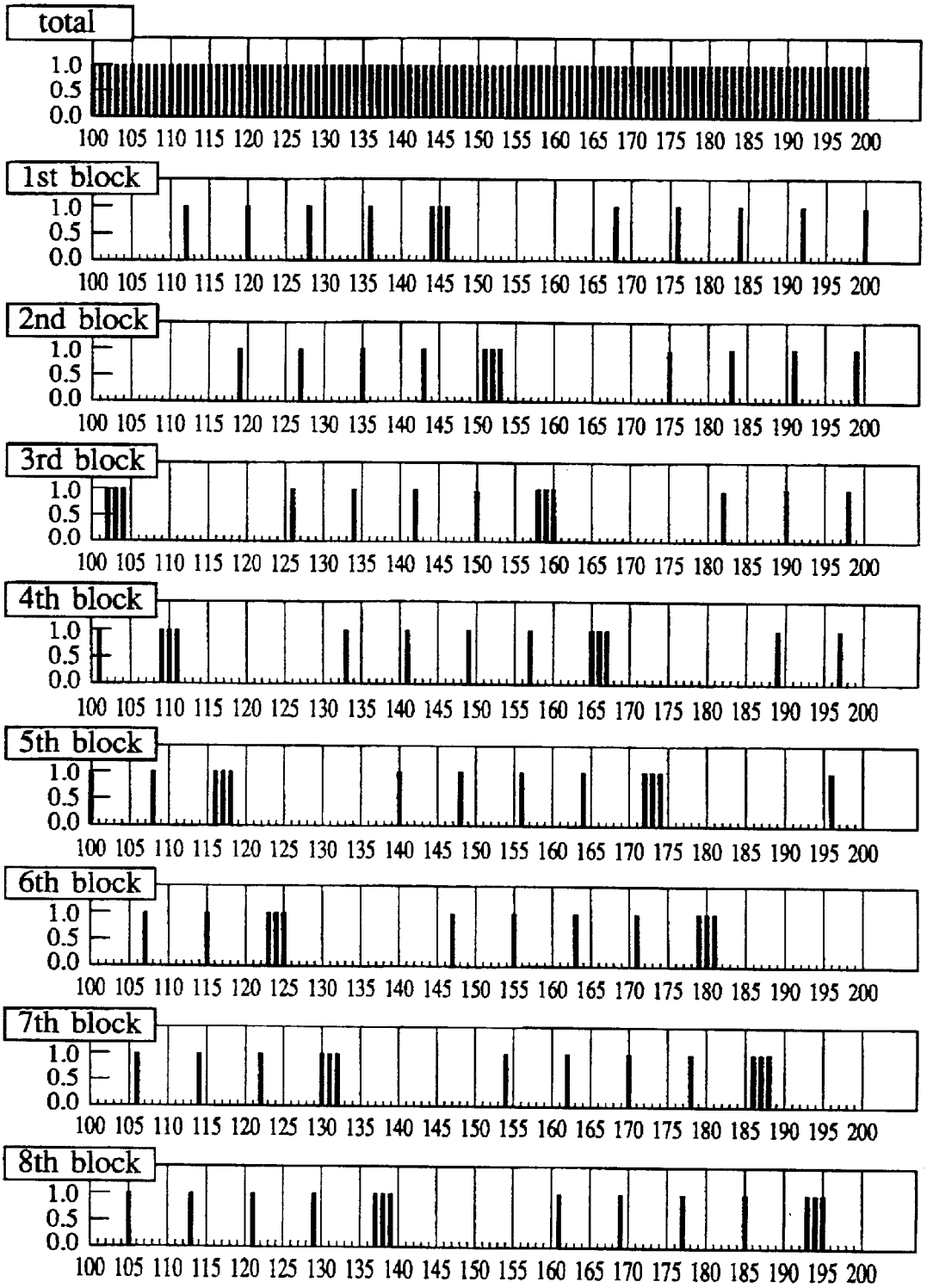
FIG. 11B is a chart for explaining the timed relationship of continuous driving in the block driving method of the first embodiment.
Figure 30:
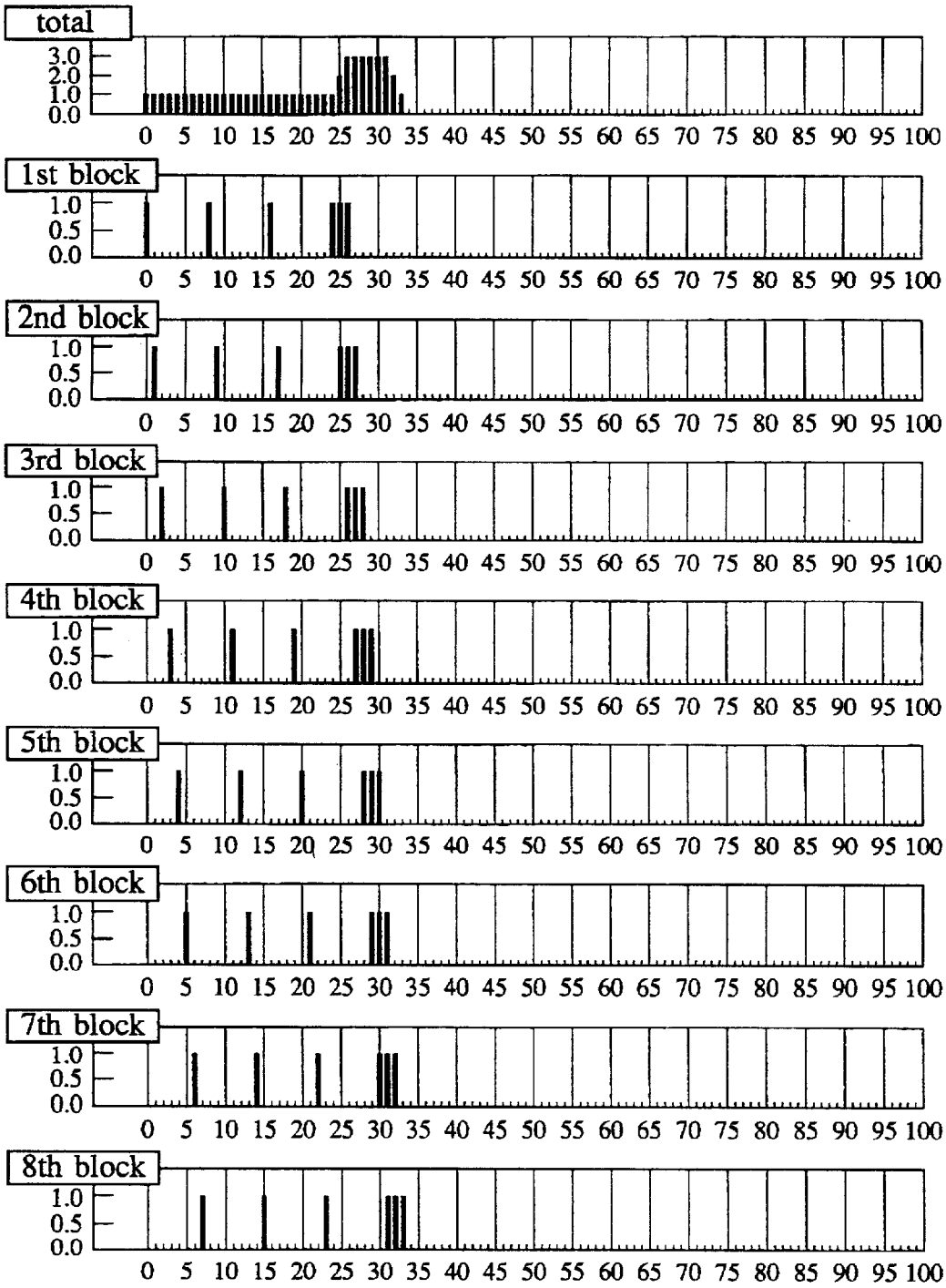
FIG. 30 is a chart for explaining a drawback resulted when block driving is performed by using a pulse train made up of multiple pulses.

FIGS. 10, 11A and 11B are charts showing the timed relationship of block driving in the ink jet recording apparatus of the first embodiment, which is achieved by the circuit configuration explained above, the charts being also shown to explain how the driving timing is determined to solve the drawback caused by overlap between the pulses as stated above in connection with FIG. 30. This embodiment will be described below for the case of using a pulse train consisted of two or more (four in this embodiment) preheating pulses (preheating signals) each having a pulse width of 1 μs and one driving pulse (driving signal) having a pulse width of 3 μs, these pulses succeeding one after another with intervals of 7 μs therebetween. Aiming at shortening a time period required to complete application of pulses for all the blocks, in this embodiment, the first preheating pulse of one block is applied to position between the first and second preheating pulses of the previous block. Specifically, the block driving is performed such that the first preheating pulse of the second block positions between the first and second preheating pulses of the first block, the first preheating pulse of the third block positions between the first and second preheating pulses of the second block, and so on. Then, the intervals between the pulses are each set to a length not less than (equal to in this embodiment) the total pulse width of the pulse group used for one driving (ejection) of each block (7 μs in this embodiment, i.e., total of 1 μs×4 (four preheating pulses) and 3 μs×1 (one driving pulse)). Further, the first preheating pulse of the second block is positioned just before the second preheating pulse of the first block, the first preheating pulse of the third block is positioned just before the second preheating pulse of the second block, and so on (here the term "Just before" means that the preceding pulse positions prior to the succeeding pulse to such an extent as not allowing another preheating pulse to position in a time interval between both the pulses). Subsequent to the third block, the pulses of the fourth to eighth blocks are positioned in a similar manner.

As a result, any pulse does not interfere with the pulses of the other blocks, and a current to be supplied from a power supply is the same as in the case of using a single pulse. The need of preparing a power supply having a current capacity two or three as much in the case of the block driving shown in FIG. 30 is no longer required.

FIGS. 11A and 11B show an example in which the second and third pulse trains are applied to the first to eighth blocks in accordance with the driving method of this embodiment. In this example, the second pulse train for the first block is applied earliest. Thus, the first preheating pulse of the second pulse train for the first block is positioned just after the driving pulse of the fourth block. It cannot be positioned at an earlier point in time because the period prior to that point in time is fully occupied by the preheating pulses and the driving pulses of the first pulse trains for all the blocks. In this example, the second train of driving signal pulses is applied with a delay of 56 μs from the first train of driving signal pulses. Focusing on one block, therefore, it is understood that one block can be driven at frequency of about 17.9 KHz.

While this embodiment has been explained for the pulse train consisted of five pulses (four preheating pulses each having a width of 1 μs and one driving pulse having a width of 3 μs), the number of pulses, the number of blocks and so on are not limited to the values used in the embodiment. Assuming now that the number of blocks is n, the number of pulses for each pulse train (a pulse group for generating a bubble and performing one ejection) is m (m−1 preheating pulses and one driving pulse), the pulse width of each preheating pulse is a μs, and the pulse width of the driving pulse is b μs, the interval between the pulses in the pulse train is expressed by:

$$a\times(n-2)+b \text{ for } n\leq m \tag{3}$$

or $$a\times(m-1)+b \text{ for } n>m \tag{4}$$

According to the formula (3) or (4), a proper pulse interval can be obtained depending on the relationship between the number of pulses for each pulse train and the number of blocks. In the example shown in FIGS. 10, 11A and 11B, for instance, because of n=8, m=5, a=1, b=3 and therefore n>m, the formula (4) is applied and the pulse interval=7 μs is resulted. By setting the pulse interval of 7 μs in each of the counters 211–218 in the timing controller 105, the pulse train can be generated in the timed relationship as shown in FIGS. 11A and 11B.

With the first embodiment, as described above, there occur no interference between the pulses of different blocks even In the case of dividing the head nozzles into a plurality of blocks and driving each of the blocks by driving signals including a plurality. of preheating pulses, or the case where the preheating pulses and the driving pulse making up each pulse train have different pulse widths from each other. As a result, the power supply is only required to have a capacity for one block; hence a reduction in capacity of the power supply can be achieved.

Second Embodiment

Figure 12A:
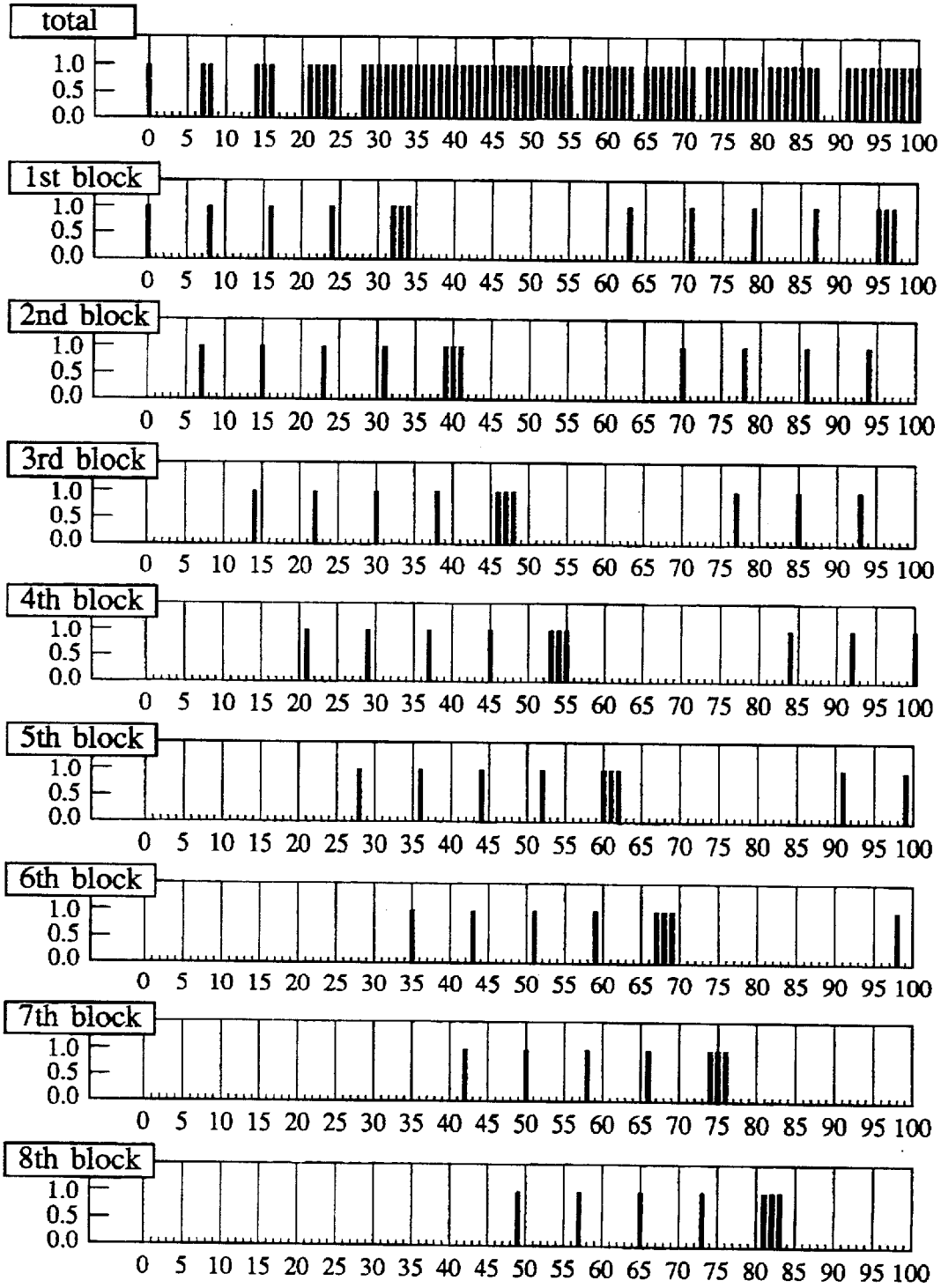
FIG. 12A is a chart showing the timed relationship in operation of a second embodiment wherein the timing of starting to apply a pulse train in a second recording cycle is changed.
Figure 12B:
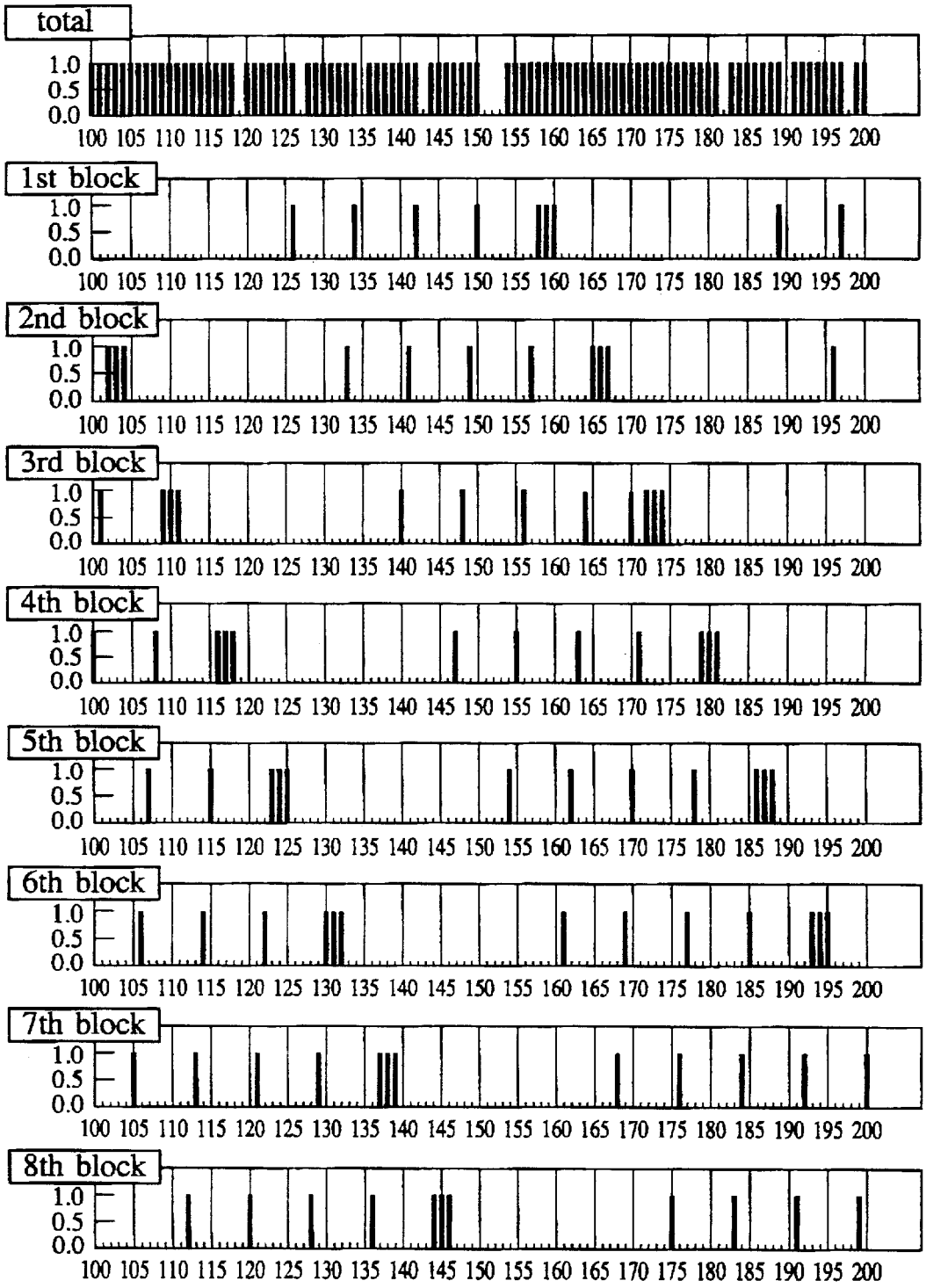
FIG. 12B is a chart showing the timed relationship in operation of the second embodiment wherein the timing of starting to apply the pulse train in the second recording cycle is changed.

FIGS. 12A and 12B show a second embodiment which differs from the first embodiment in that a method of applying the second driving signal of the first block is changed. In this second embodiment, the second pulse train for the first block Is started to be applied just after the driving pulse of the fifth block. Here the rule for the start of applying the second pulse train is a little moderate. Looking at the top column where all the pulses are shown together, as indicated by "total" in FIGS. 12A and 12B, there Is a gap at time of 64 μs. This is because the pulse of another block which is first applied after the end of application of the driving signal of the fifth block is the third preheating pulse of the eighth block and this pulse is applied with a delay of 2 μs. Accordingly, the first preheating pulse of the first block having a pulse width of 1 μs does not overlap with any other pulses if it is positioned within the delay width of 2 μs. The driving frequency in this embodiment is about 15.9 KHz.

As a modification, the first preheating pulse of the first block may be applied after the driving pulse of the sixth or seventh block. In this modification, the timing of the start of applying the second pulse train for the first block can be freely selected on condition that the pulse of 1 μs is positioned within a width of 3 μs or 4 μs, respectively. In any case, it is a matter of course that the driving frequency is somewhat lower than in the first and second embodiments corresponding to a slight delay in the start of applying the second pulse train. Incidentally, when the second pulse train for the first block is applied after the driving signal of the eighth block, the first preheating pulse of the second pulse train for the first block can be of course applied at free time because there are no pulses possibly interfering with it.

The above-stated relationship in application of the pulse trains can be controlled by modifying the circuit configuration shown in FIG. 9 such that the enable signal from the counter 218 is further delayed before it is supplied to the counter 211. In the example of FIGS. 12A and 12B, for instance, the count-up signal from the counter 218 is supplied to the counter 211 with a delay of 6 μs.

Third Embodiment

Figure 13A:
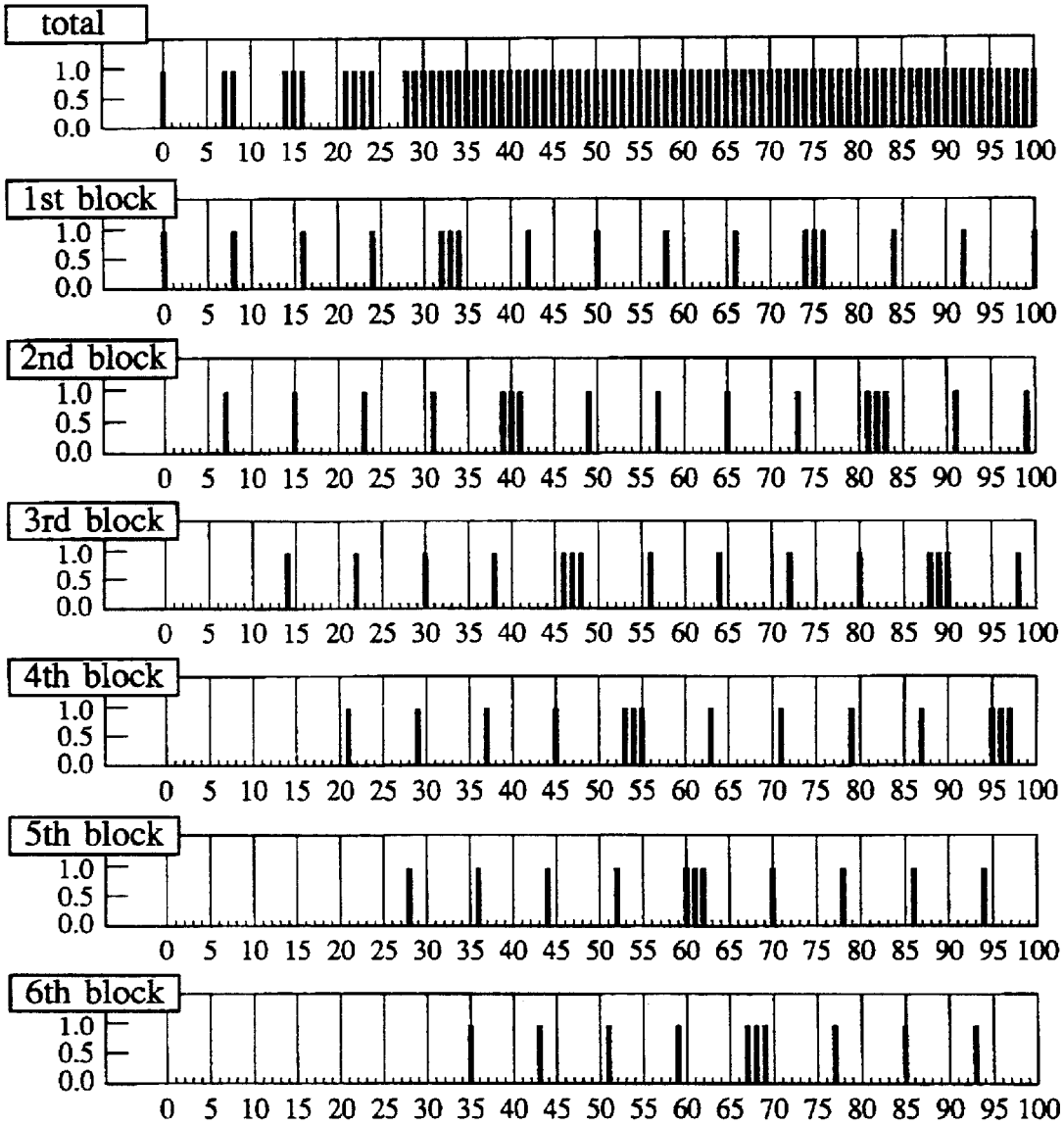
FIG. 13A is a chart showing the timed relationship of block driving in a third embodiment.
Figure 13B:
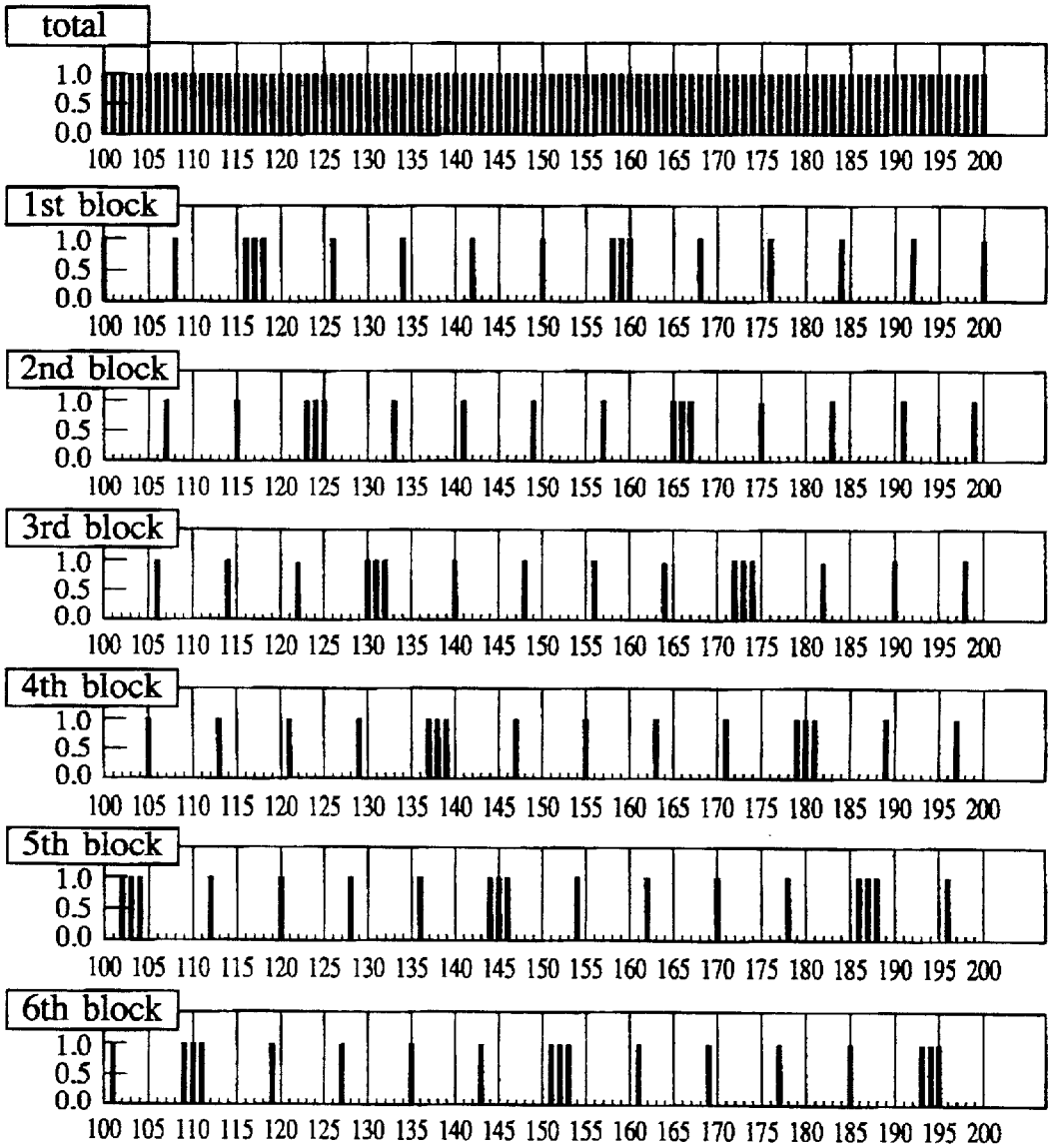
FIG. 13B is a chart showing the timed relationship of block driving in the third embodiment.

A third embodiment is shown in FIGS. 13A and 13B. In this third embodiment, the pulse train has the same make-up as in the above embodiments, but the number of blocks is six. Also, in this embodiment, the second pulse train for the first block is applied earliest. Since the second pulse train is started to be applied after 42 μs from the start of applying the first pulse train, the driving frequency is about 23.8 KHz.

Additionally, in the third embodiment, because of n=6, m=5, a=1, b=3 and therefore n>m, the formula (4) is applied and the pulse interval is 7 μs.

Fourth Embodiment

Figure 14A:
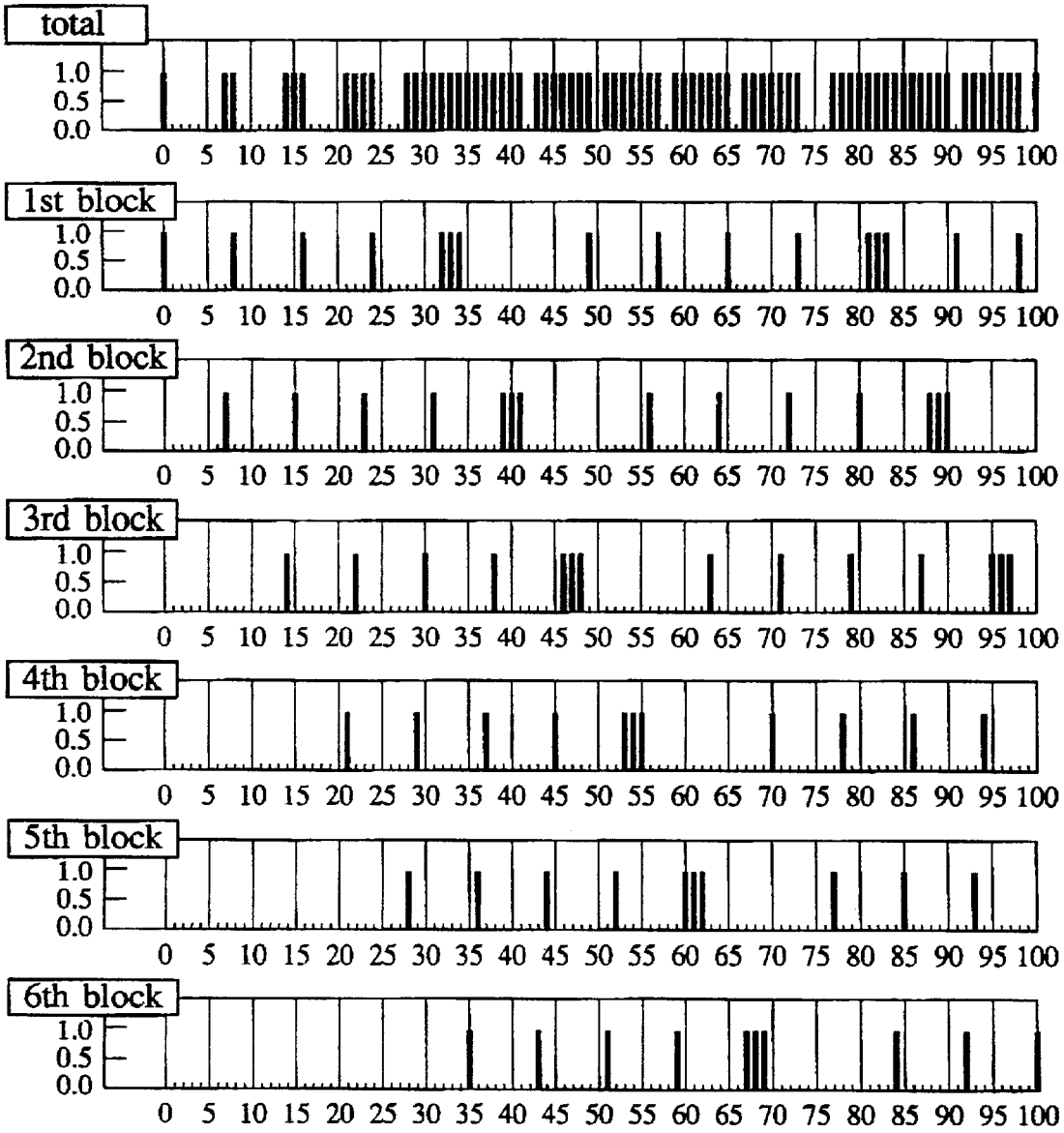
FIG. 14A is a chart showing the timed relationship of block driving in a fourth embodiment.
Figure 14B:
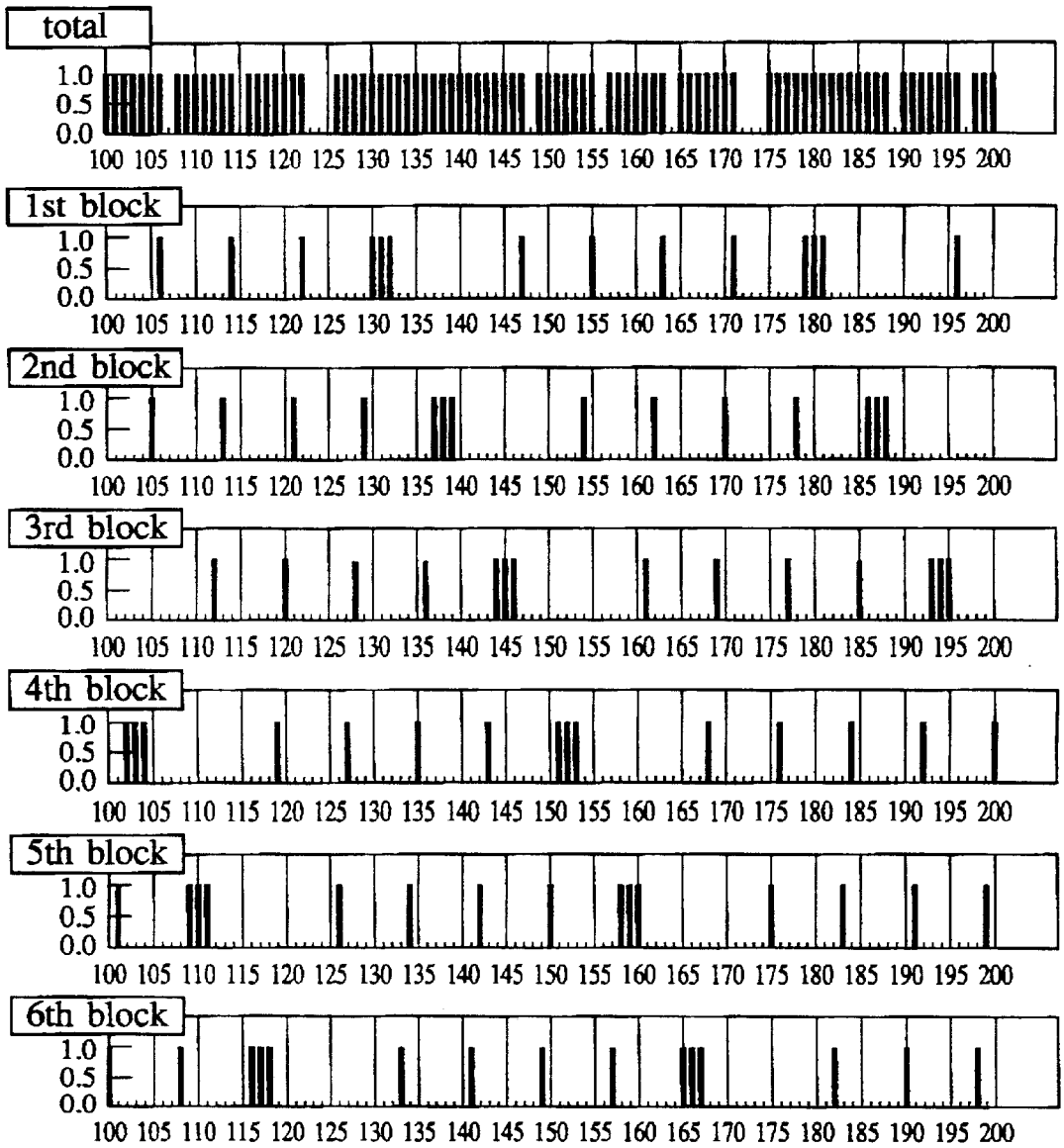
FIG. 14B is a chart showing the timed relationship of block driving in the fourth embodiment.

FIGS. 14A and 14B show a fourth embodiment in which the configuration is the same as the third embodiment (i.e., the number of blocks=6 and the number of pulses per pulse train=5), but the start of applying the second pulse train is somewhat delayed. The start of applying the second pulse train is delayed 49 μs from the start of applying the first pulse train. The driving frequency is about 20.4 KHz.

Fifth Embodiment

Figure 15A:
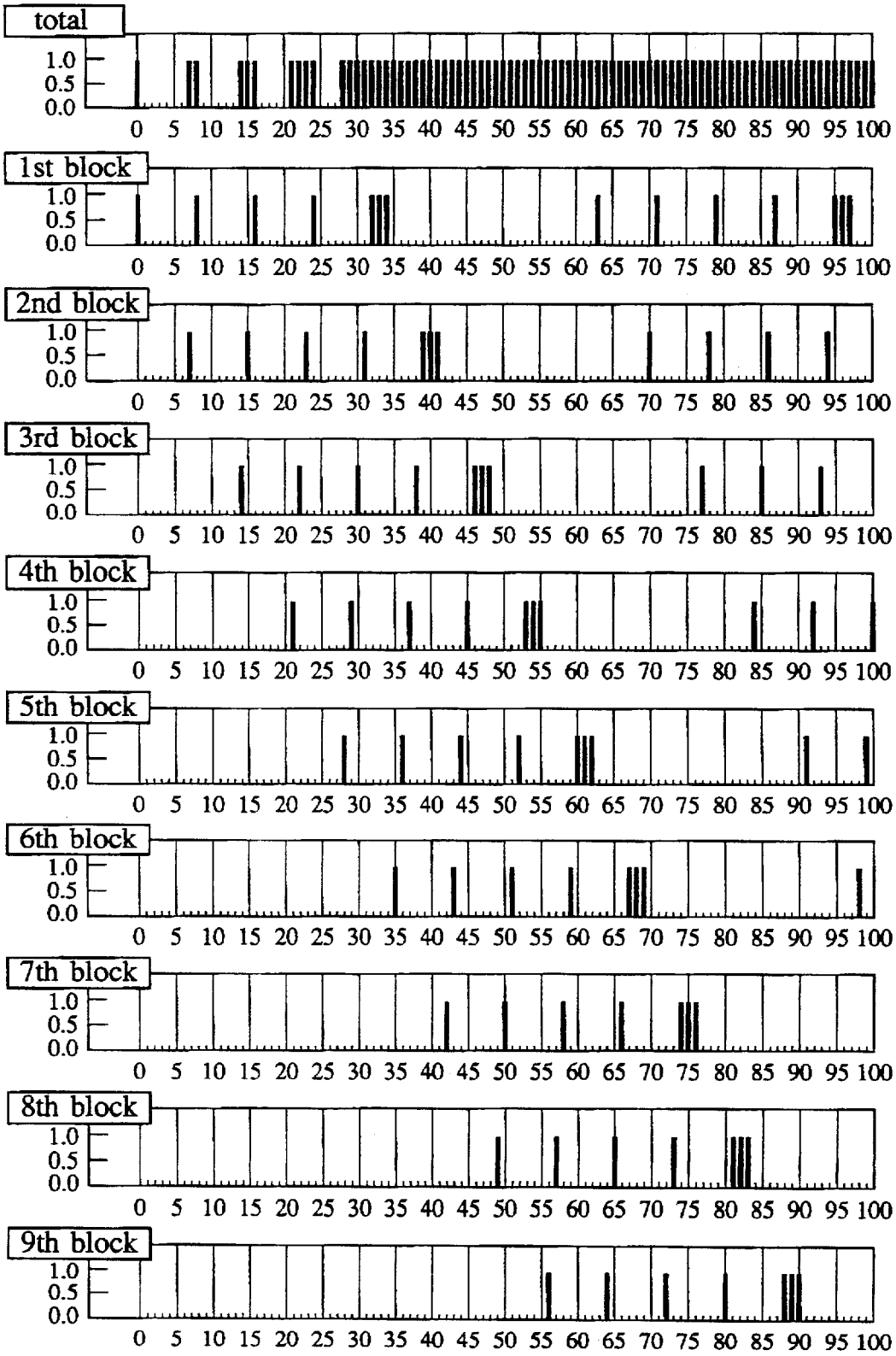
FIG. 15A is a chart showing the timed relationship of block driving in a fifth embodiment.
Figure 15B:
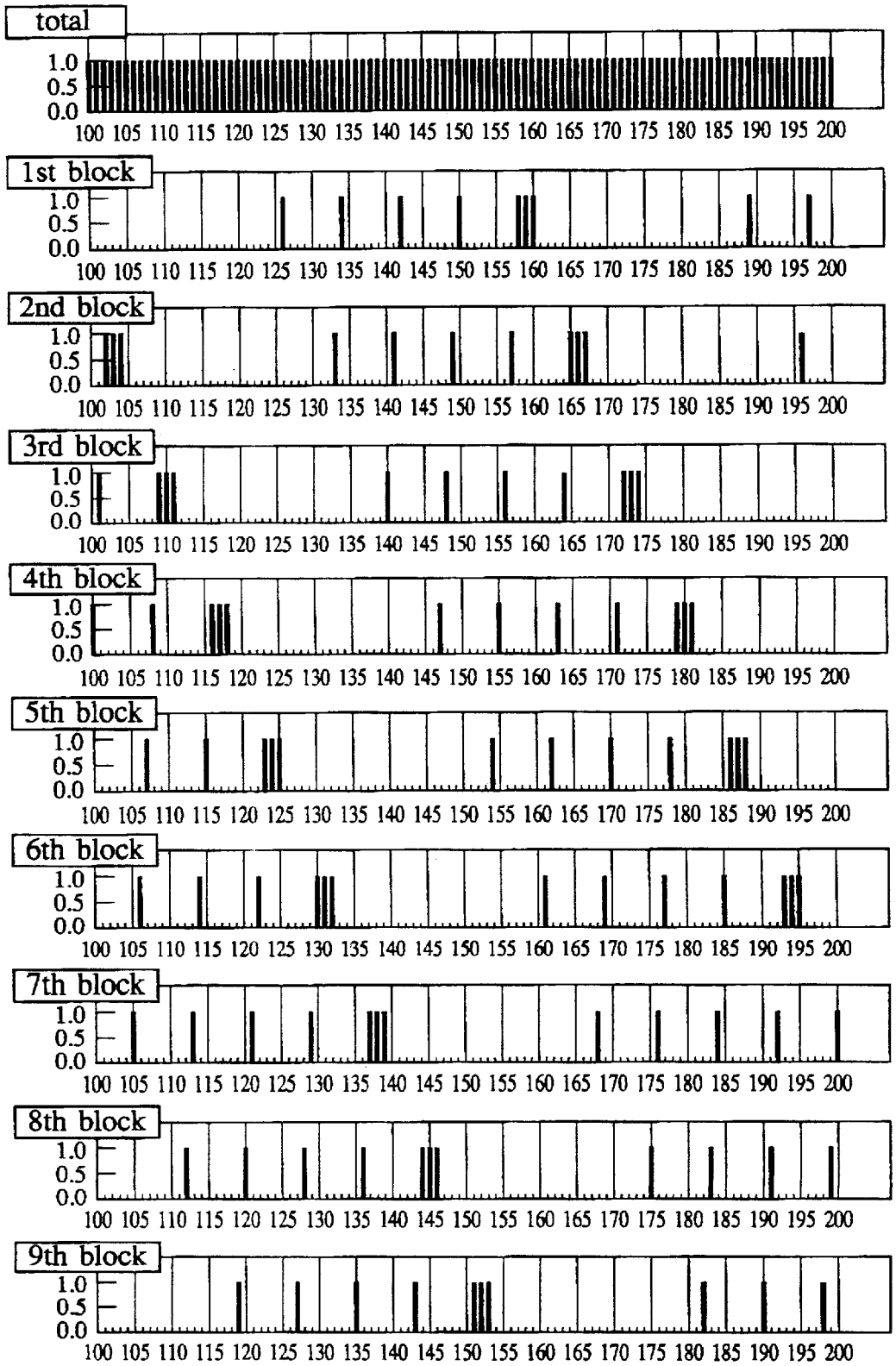
FIG. 15B is a chart showing the timed relationship of block driving in the fifth embodiment.

FIGS. 15A and 15B show a fifth embodiment in which the number of blocks is nine. In this fifth embodiment, the first preheating pulse of the second pulse train for the first block is applied just after the driving pulse of the fifth block. Because the number of blocks is nine in this driving method, the second pulse train cannot be applied earlier than the above timing. The driving frequency in the fifth embodiment is equal to that in the second embodiment shown in FIGS. 12A and 12B. Comparing the fifth embodiment with the first embodiment shown in FIGS. 11A and 11B, it can be said that the first preheating pulse of a ninth block is applied at exactly the same timing as the application of the first preheating signal of the second pulse train in the first embodiment. It can be thus regarded that the second pulse train for the first block in the first embodiment is allocated to the ninth block. Then, supposing that the second pulse train for the second block in the first embodiment is allocated to the second pulse train for the first block in this fifth embodiment, the subsequent pulse array is not at all changed from that in the first embodiment when considered from the power supply side.

The above point can be immediately understood from that the waveforms shown in the top columns indicated by "total" in FIGS. 11 and 15 are exactly the same. This fifth embodiment differs from the first embodiment only in that the difference in number of blocks leads to a difference in driving frequency. As with the relation of the second embodiment to the first embodiment, there is no problem even when the second pulse train is delayed from the above start point in time by, e.g., the multiple of integer and the block length. In this case, however, the driving frequency would be so lowered as to be not adaptable for high-speed printing in these years if the delay time is too long.

Additionally, in the fifth embodiment, because of n=9, m=5, a=1, b=3 and therefore n>m, the formula (4) is applied and the pulse interval is 7 μs.

Sixth Embodiment

FIGS. 16A and 16B to FIGS. 23A and 23B show still another embodiment. Specifically, these drawings show the timed relationship of block driving in different examples of a sixth embodiment wherein each pulse train consists of seven preheating pulses and one driving pulse (m=8), and the number of blocks is changed from 2 to 9.

Figure 16A:
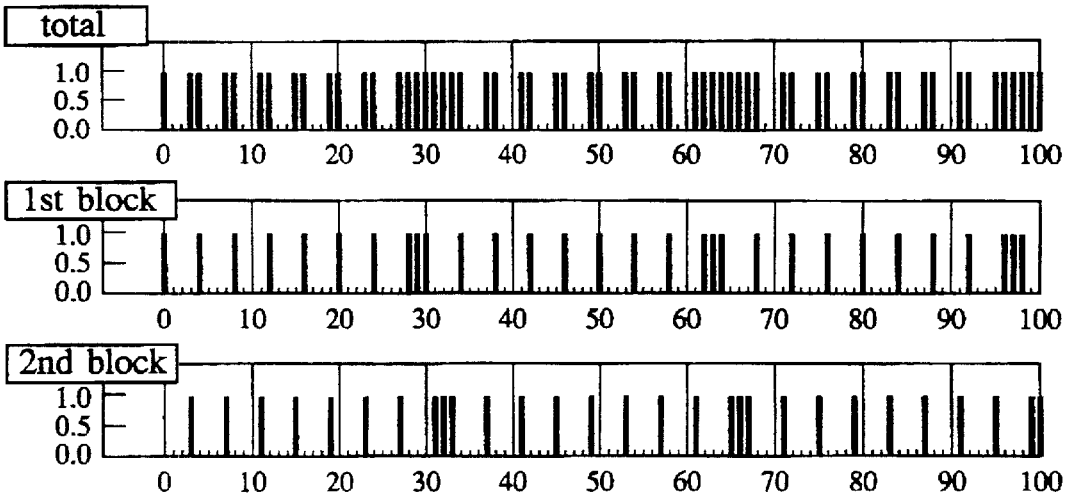
FIG. 16A is a chart showing the timed relationship of block driving in a sixth embodiment.
Figure 16B:
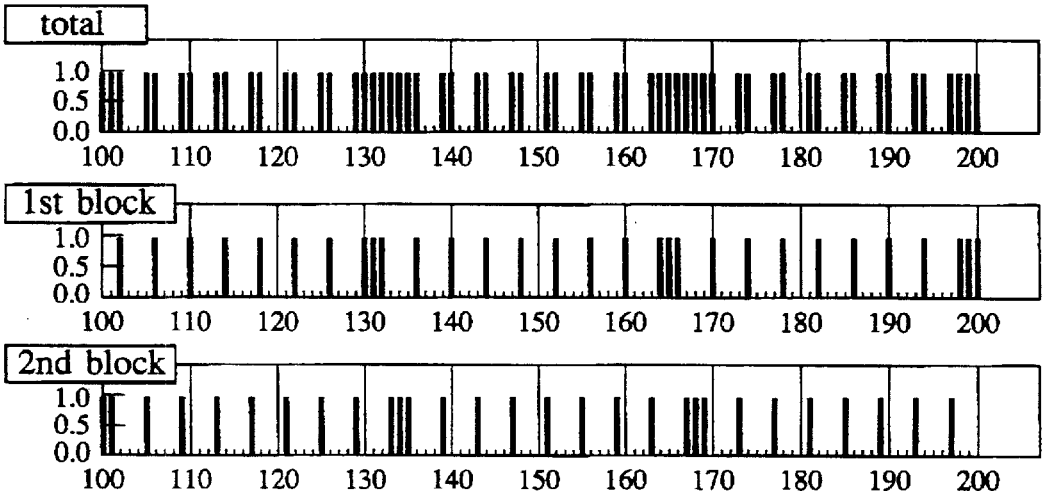
FIG. 16B is a chart showing the timed relationship of block driving in the sixth embodiment.

FIGS. 16A and 16B show an example in which the number of preheating pulses is seven and the total number of blocks is two. In this example, because of n=2, m=8, a=1, b=3 and therefore n<m, the formula (3) is applied and the pulse interval is 3 μs.

Figure 17A:
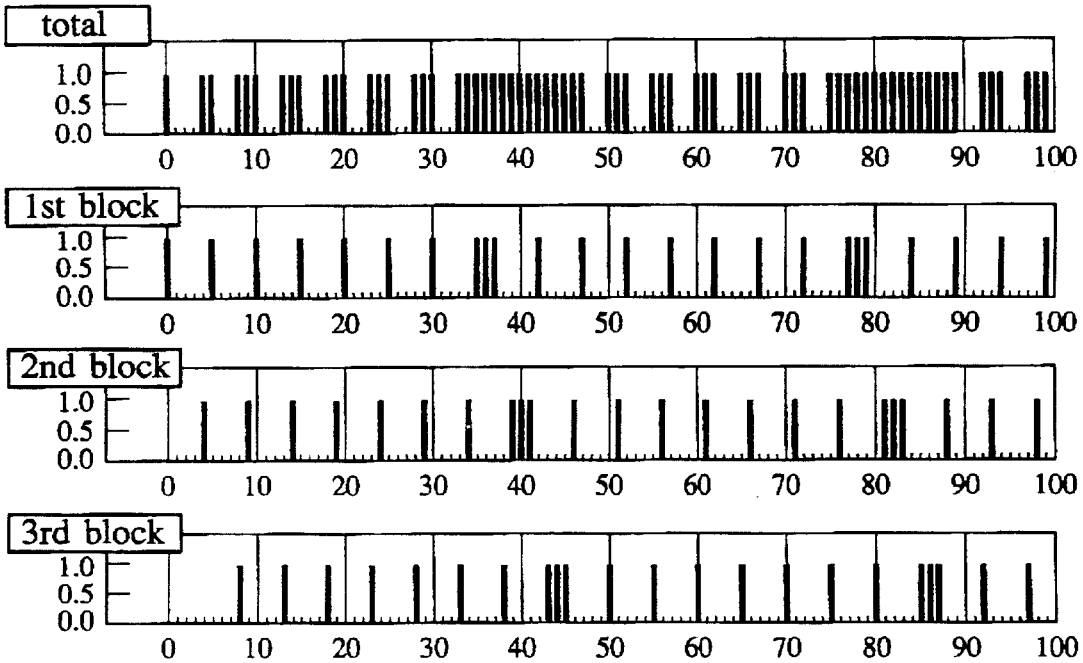
FIG. 17A is a chart showing the timed relationship of block driving in the sixth embodiment.
Figure 17B:
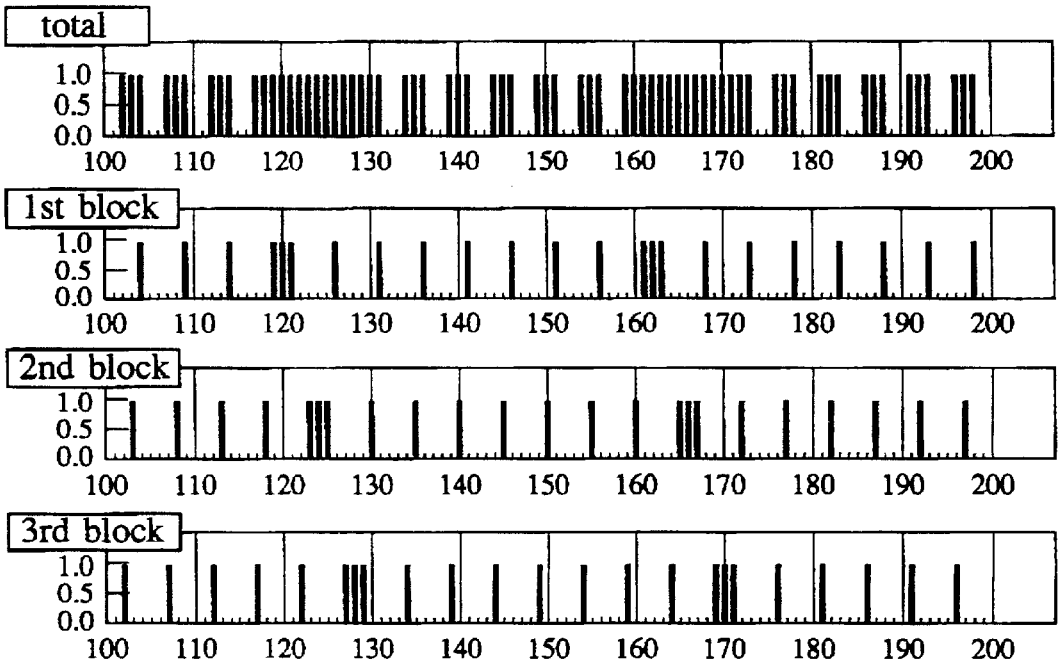
FIG. 17B is a chart showing the timed relationship of block driving in the sixth embodiment.

FIGS. 17A and 17B show an example in which the total number of blocks is three. In this example, because of n=3, m=8, a=1, b=3 and therefore n<m, the formula (3) is applied and the pulse interval is 4 μs.

Figure 18A:
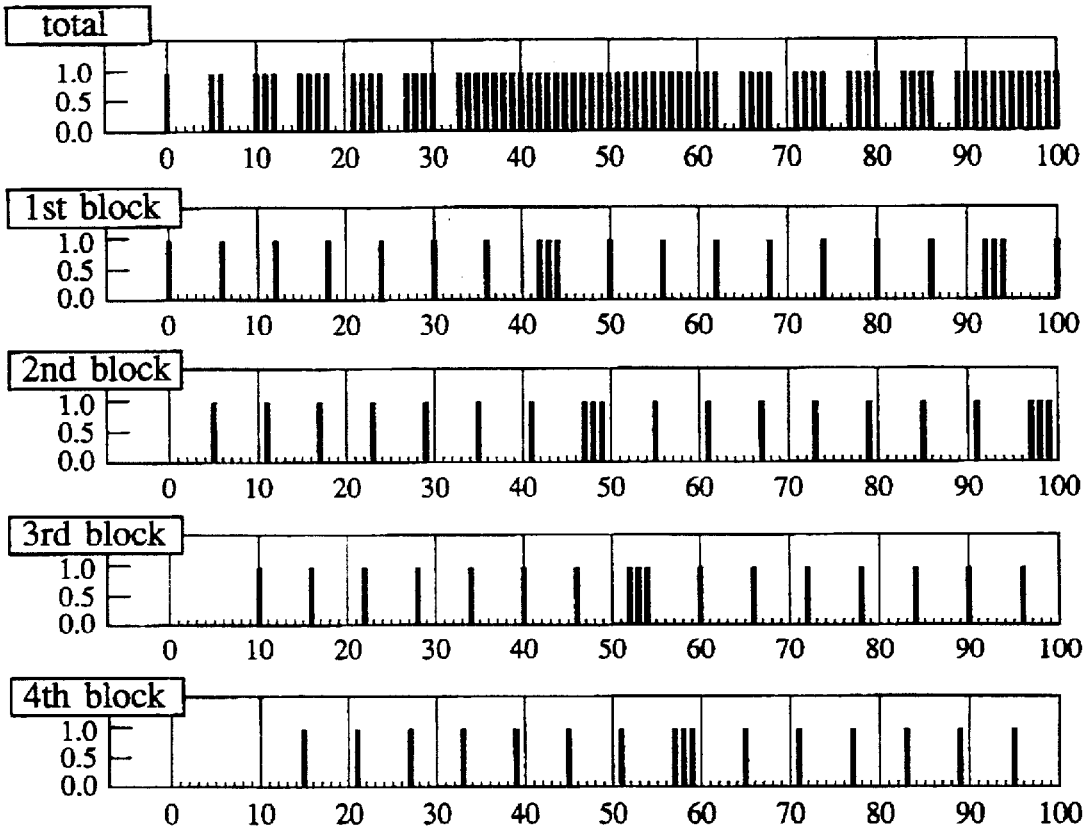
FIG. 18A is a chart showing the timed relationship of block driving in the sixth embodiment.
Figure 18B:
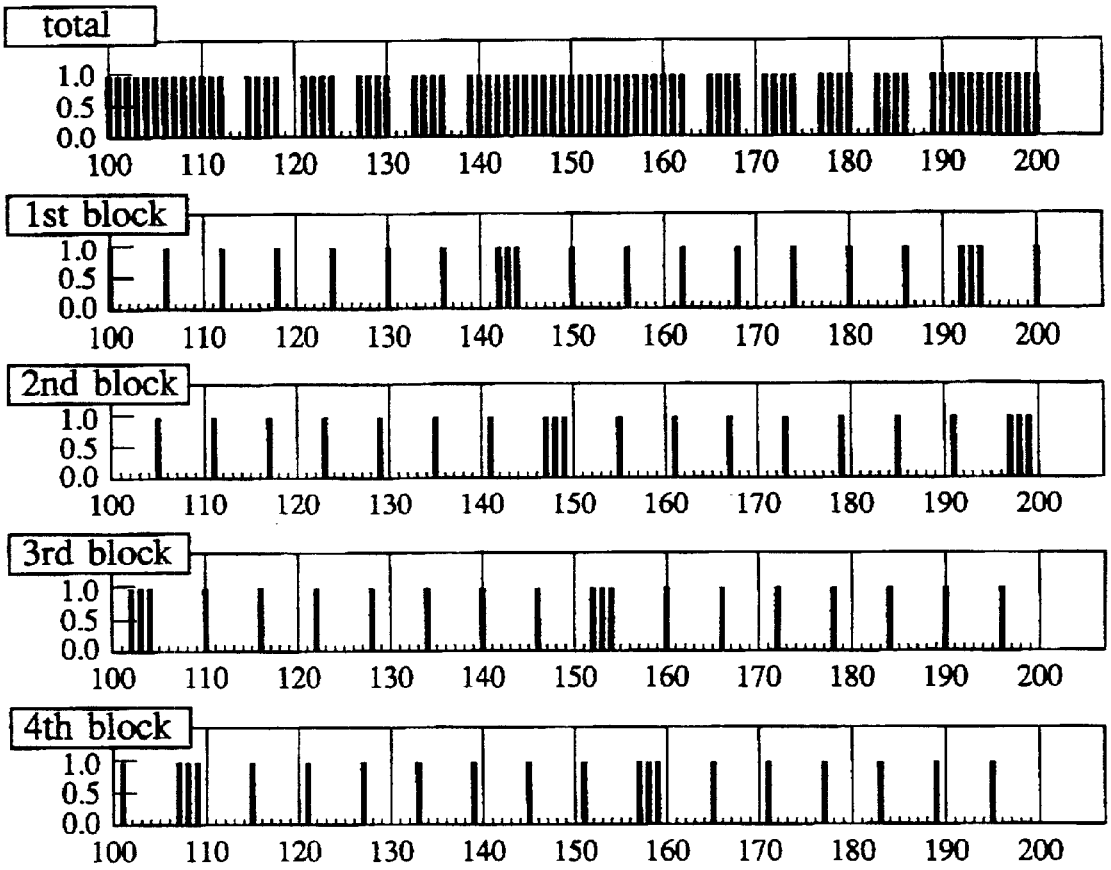
FIG. 18B is a chart showing the timed relationship of block driving in the sixth embodiment.

FIGS. 18A and 18B show an example in which the total number of blocks is four, In this example, because of n=4, m=8, a=1, b=3 and therefore n<m, the formula (3) is applied and the pulse interval is 5 μs.

Figure 19A:
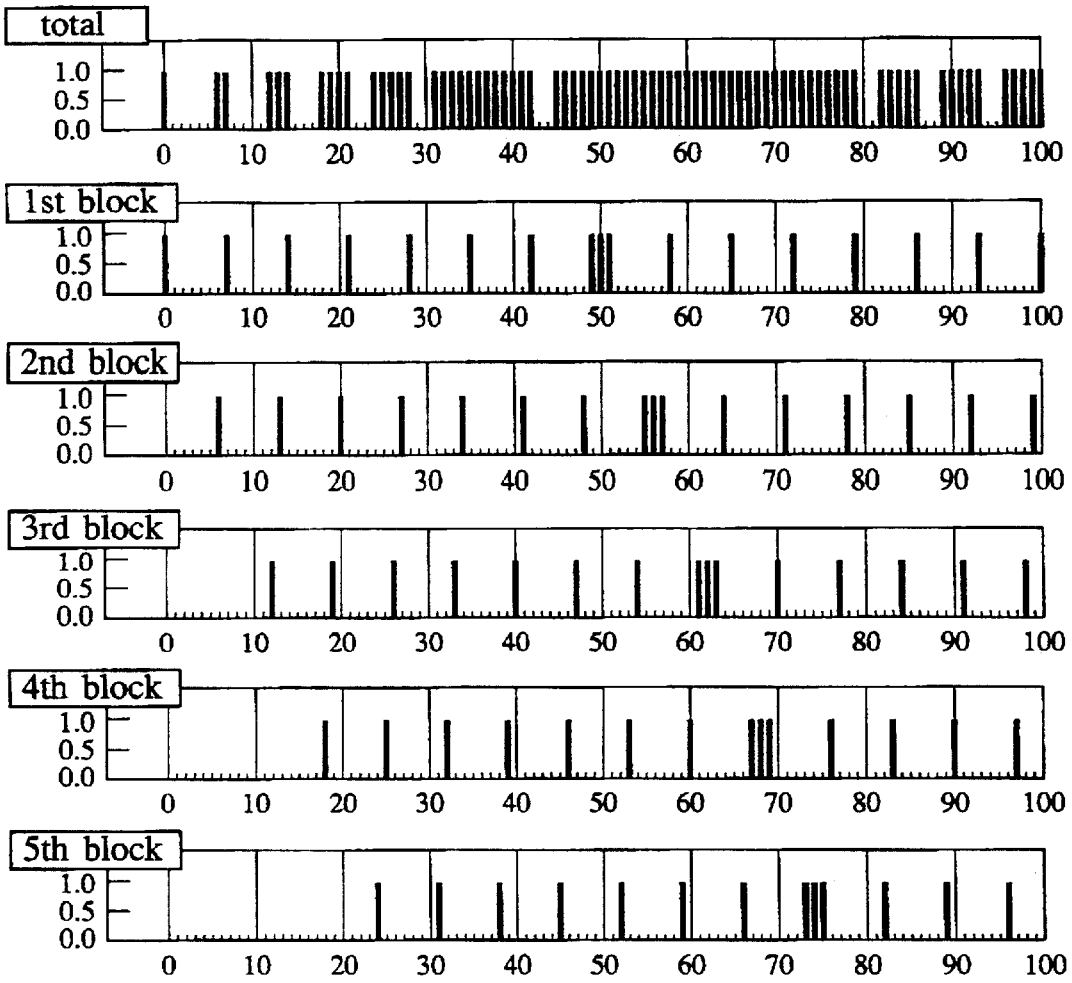
FIG. 19A is a chart showing the timed relationship of block driving in the sixth embodiment.
Figure 19B:
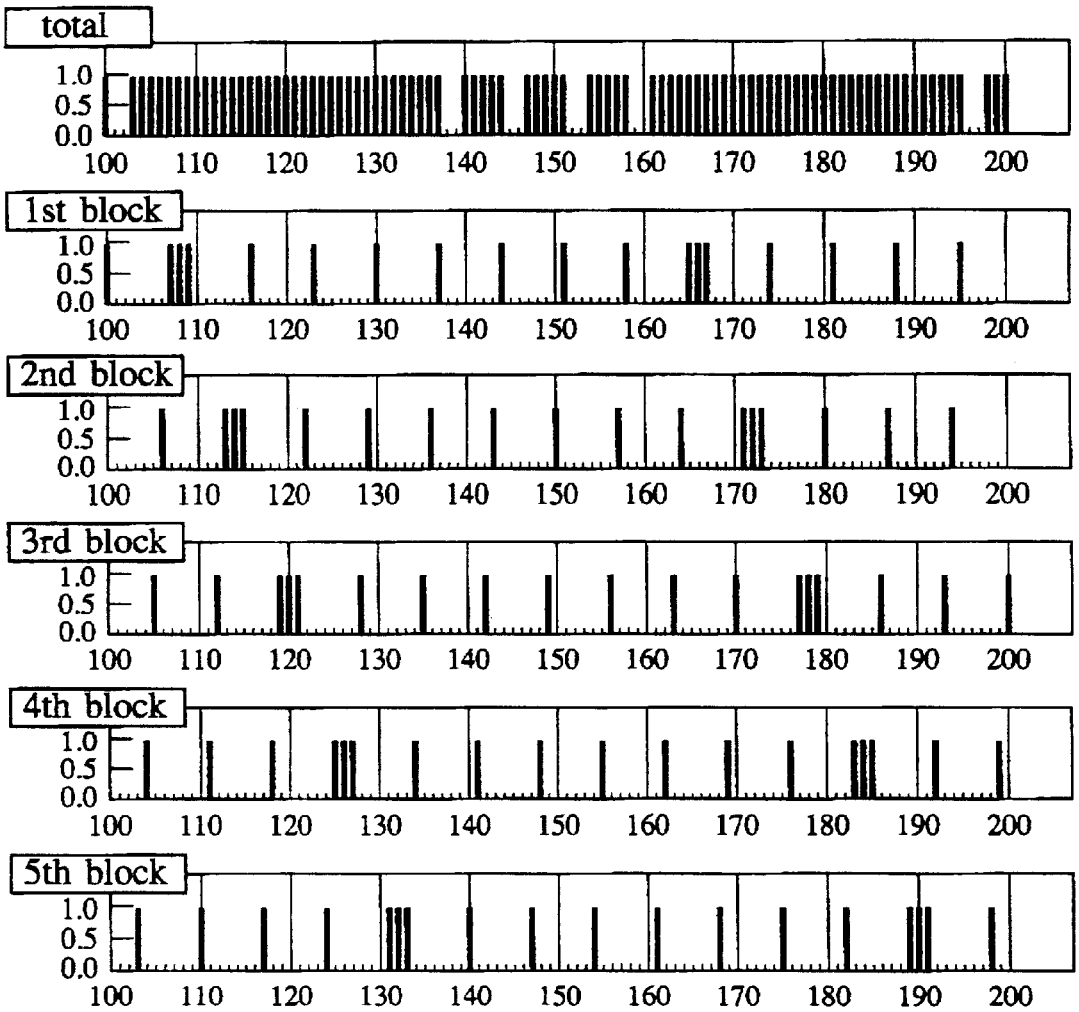
FIG. 19B is a chart showing the timed relationship of block driving in the sixth embodiment.

FIGS. 19A and 19B show an example in which the total number of blocks is five. In this example, because of n=5, m=8, a=1, b=3 and therefore n<m, the formula (3) is applied and the pulse interval is 6 μs.

Figure 20A:
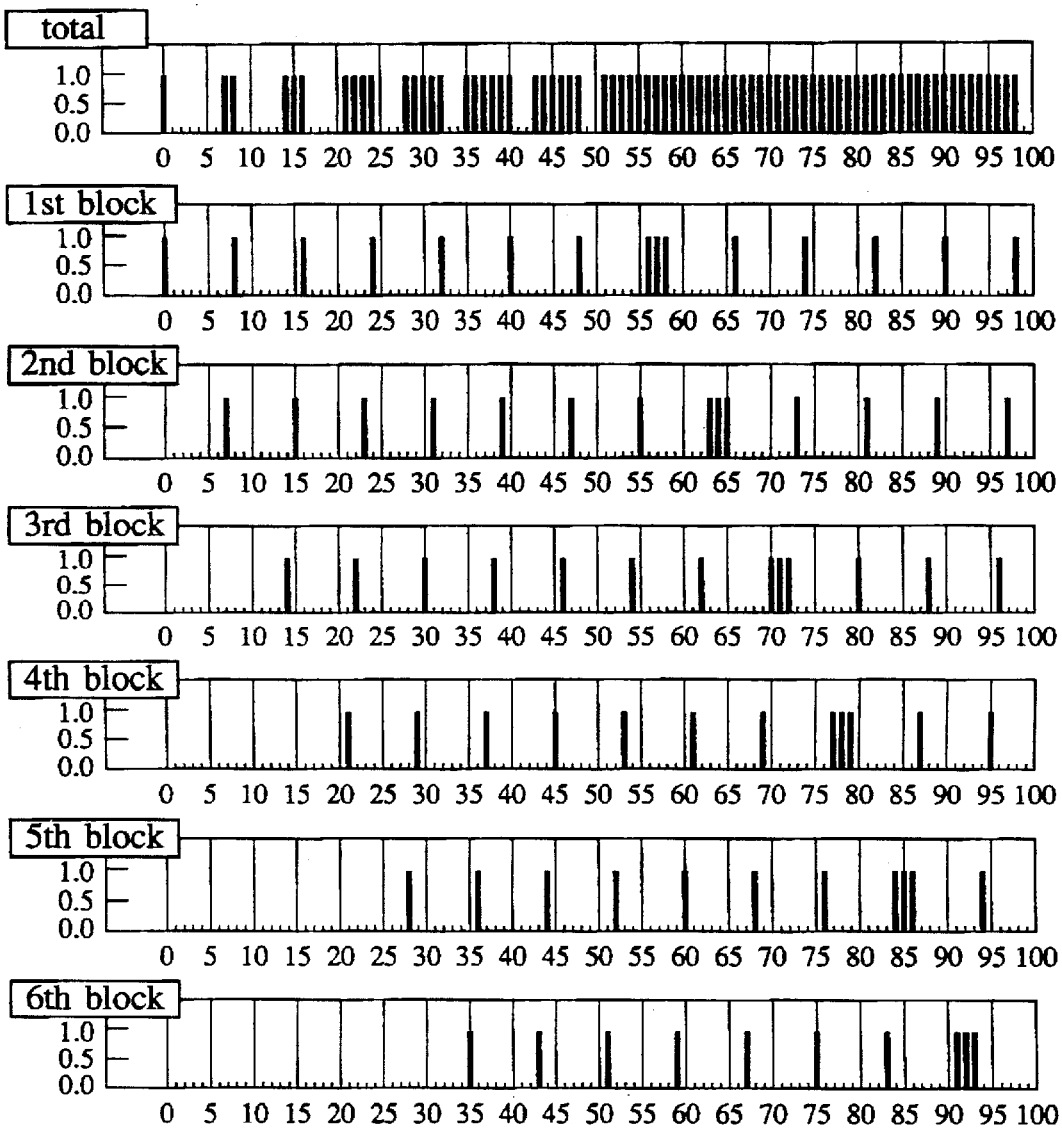
FIG. 20A is a chart showing the timed relationship of block driving in the sixth embodiment.
Figure 20B:
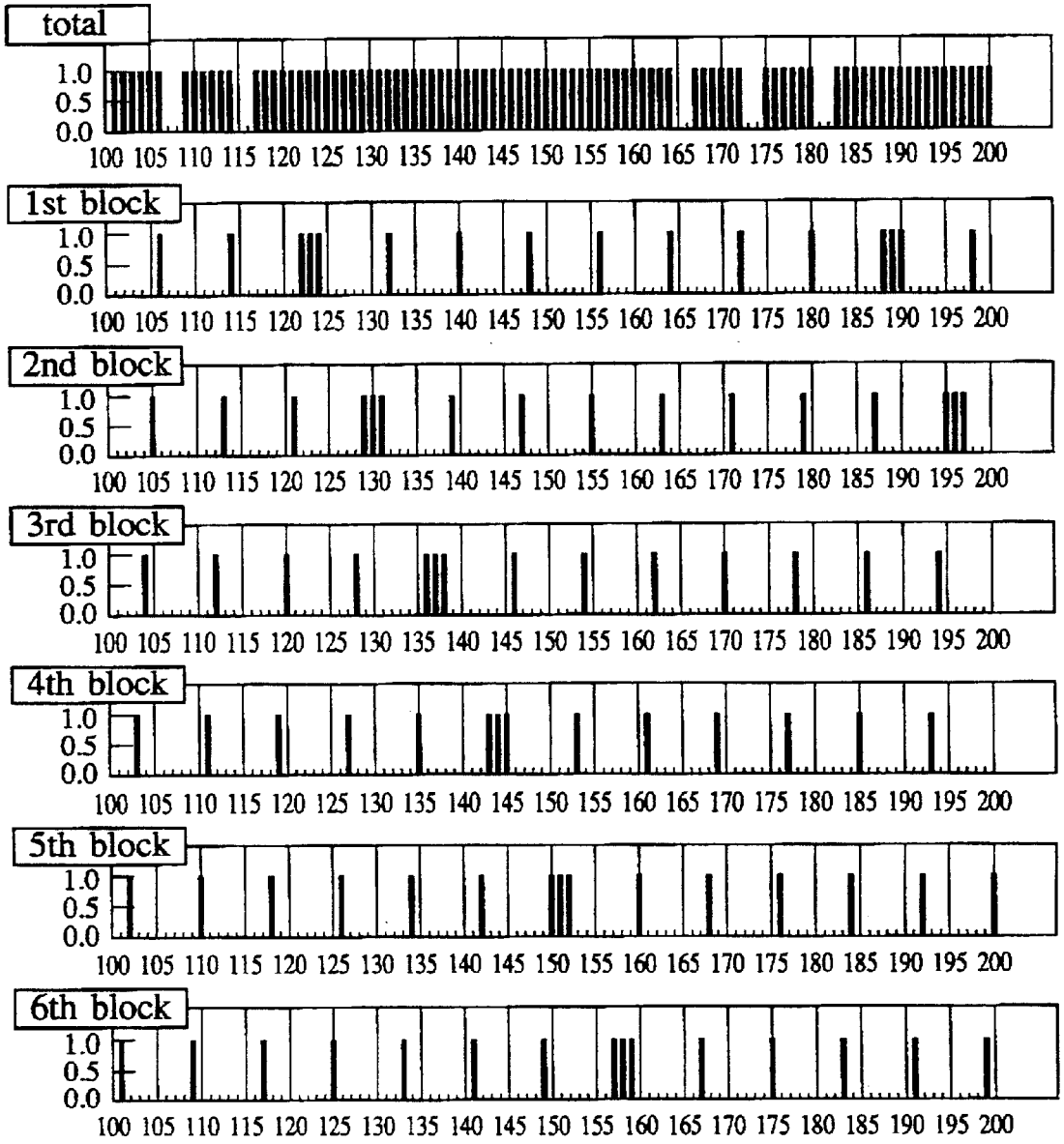
FIG. 20B is a chart showing the timed relationship of block driving in the sixth embodiment.

FIGS. 20A and 20B show an example in which the total number of blocks is six. In this example, because of n=6, m=8, a=1, b=3 and therefore n<m, the formula (3) is applied and the pulse interval is 7 μg.

Figure 21A:
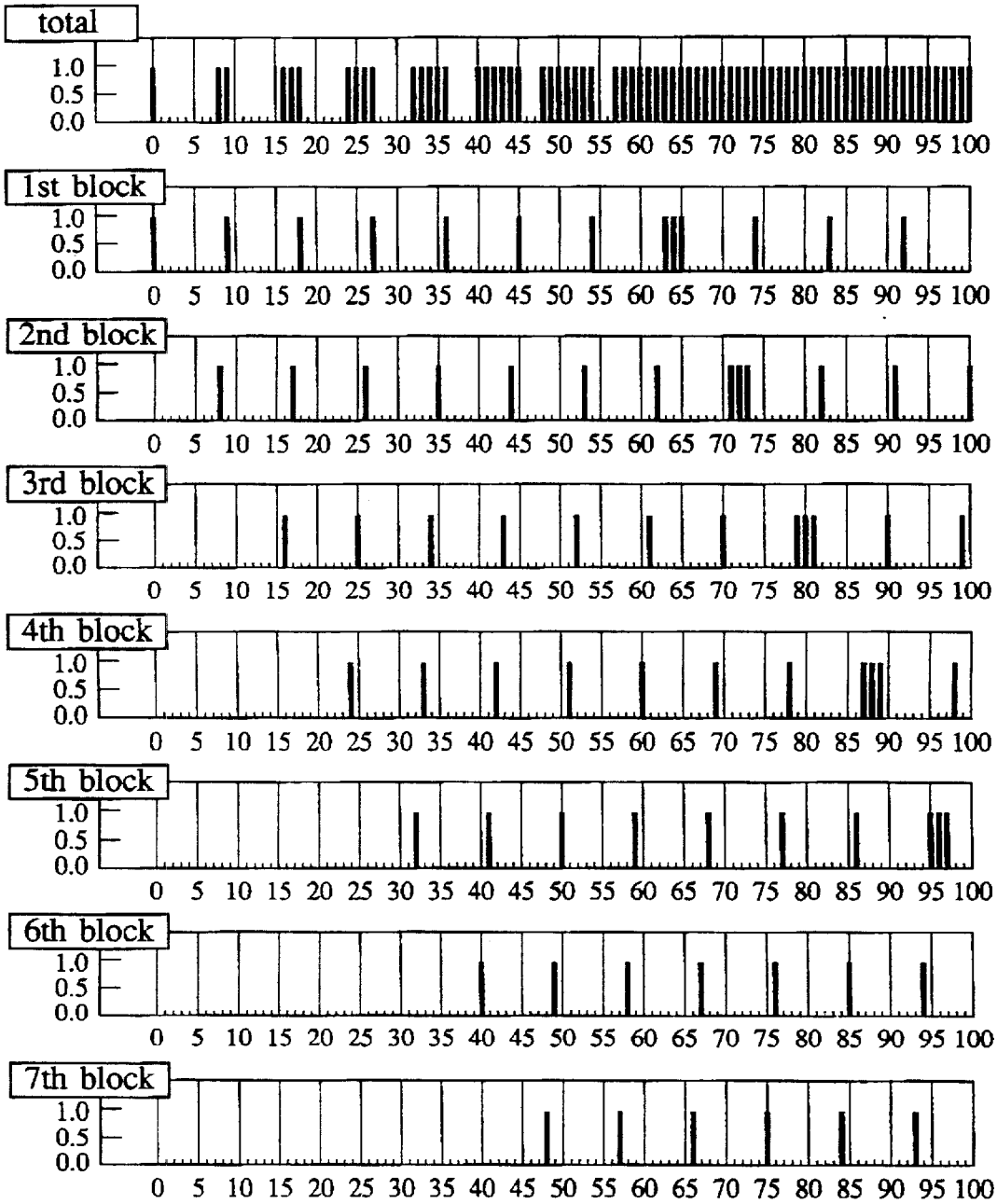
FIG. 21A is a chart showing the timed relationship of block driving in the sixth embodiment.
Figure 21B:
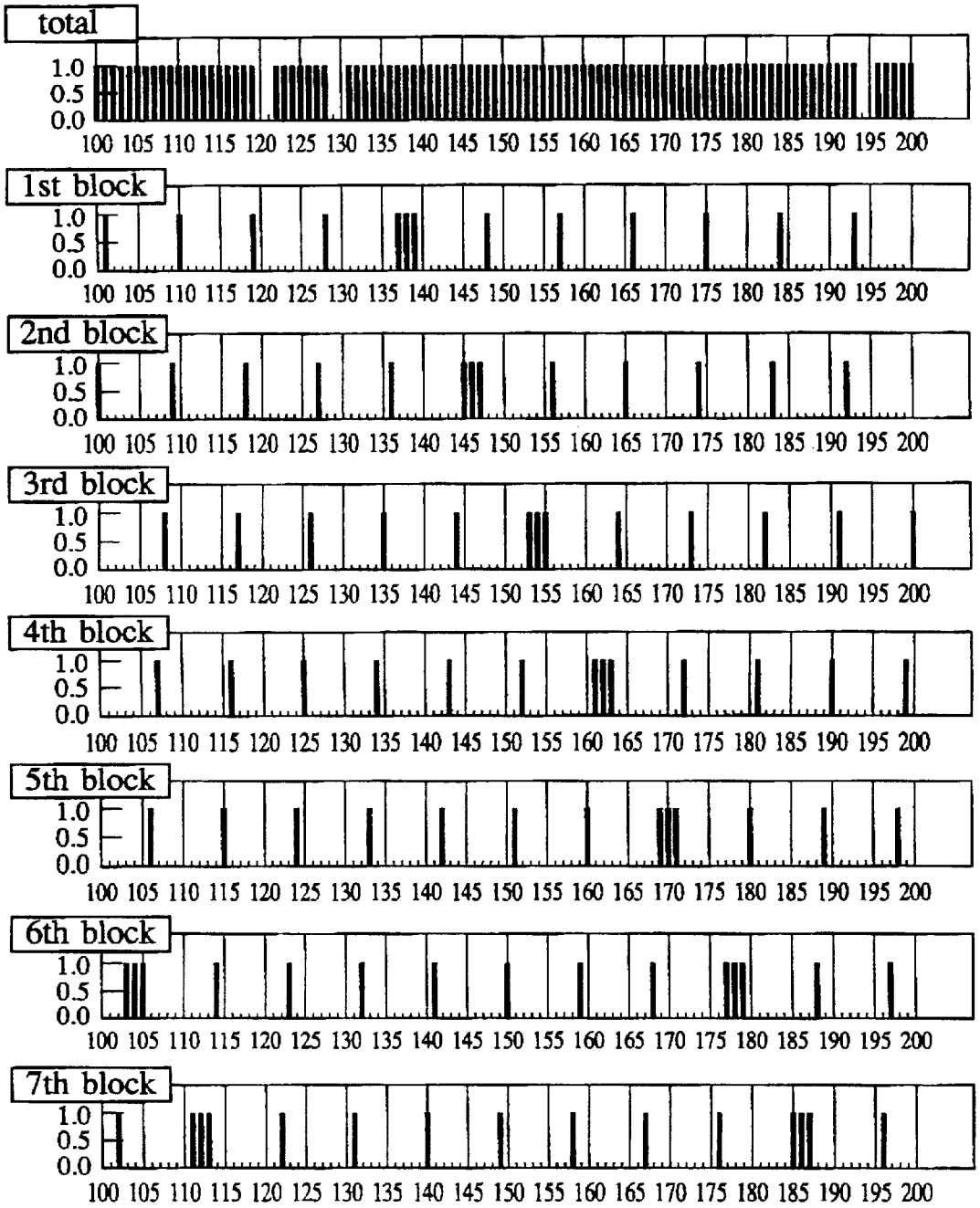
FIG. 21B is a chart showing the timed relationship of block driving in the sixth embodiment.

FIGS. 21A and 21B show an example in which the total number of blocks is seven. In this example, because of n=7, m=8, a=1, b=3 and therefore n<m, the formula (3) is applied and the pulse interval is 8 μs.

Figure 22A:
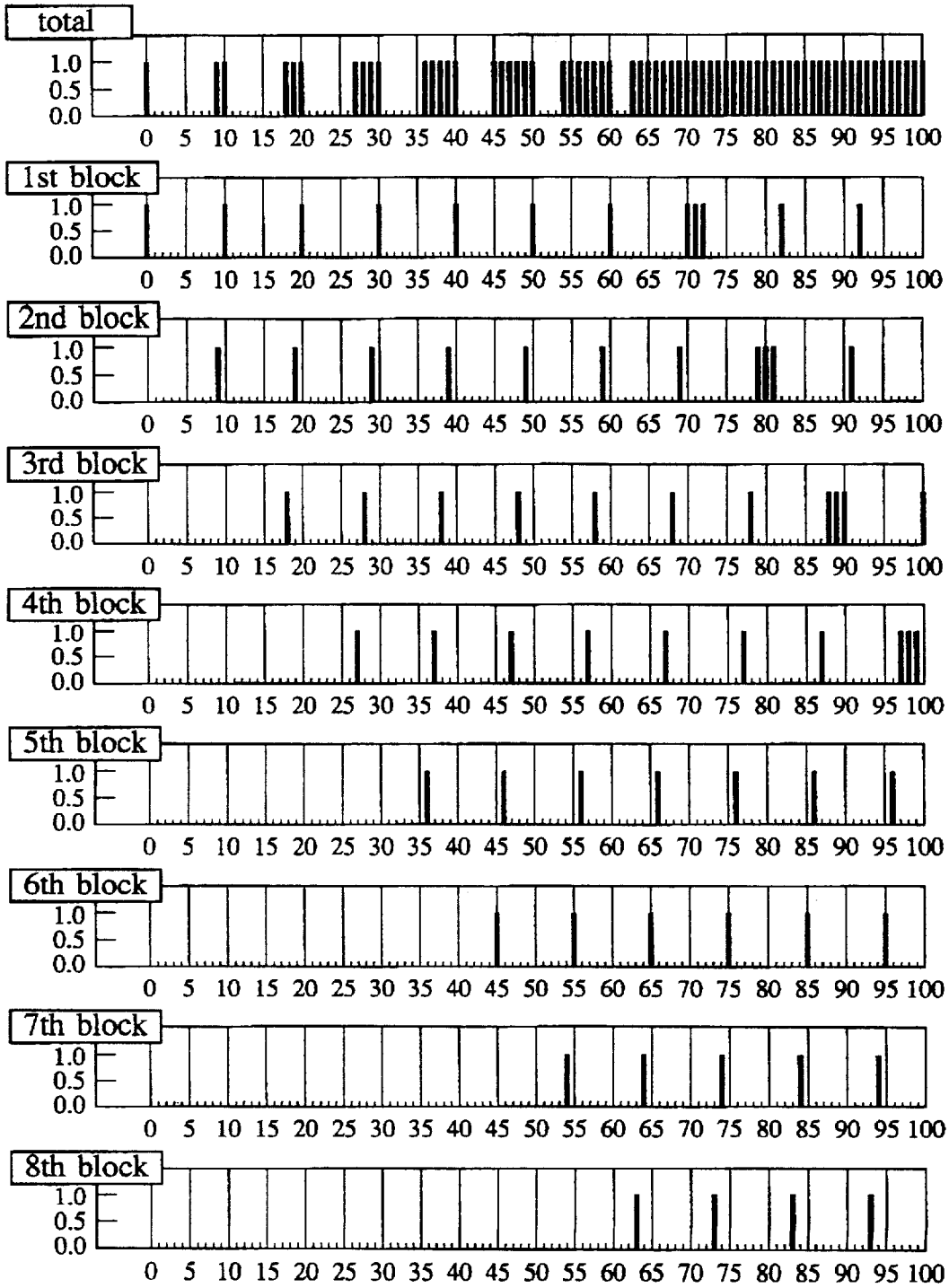
FIG. 22A is a chart showing the timed relationship of block driving in the sixth embodiment.
Figure 22B:
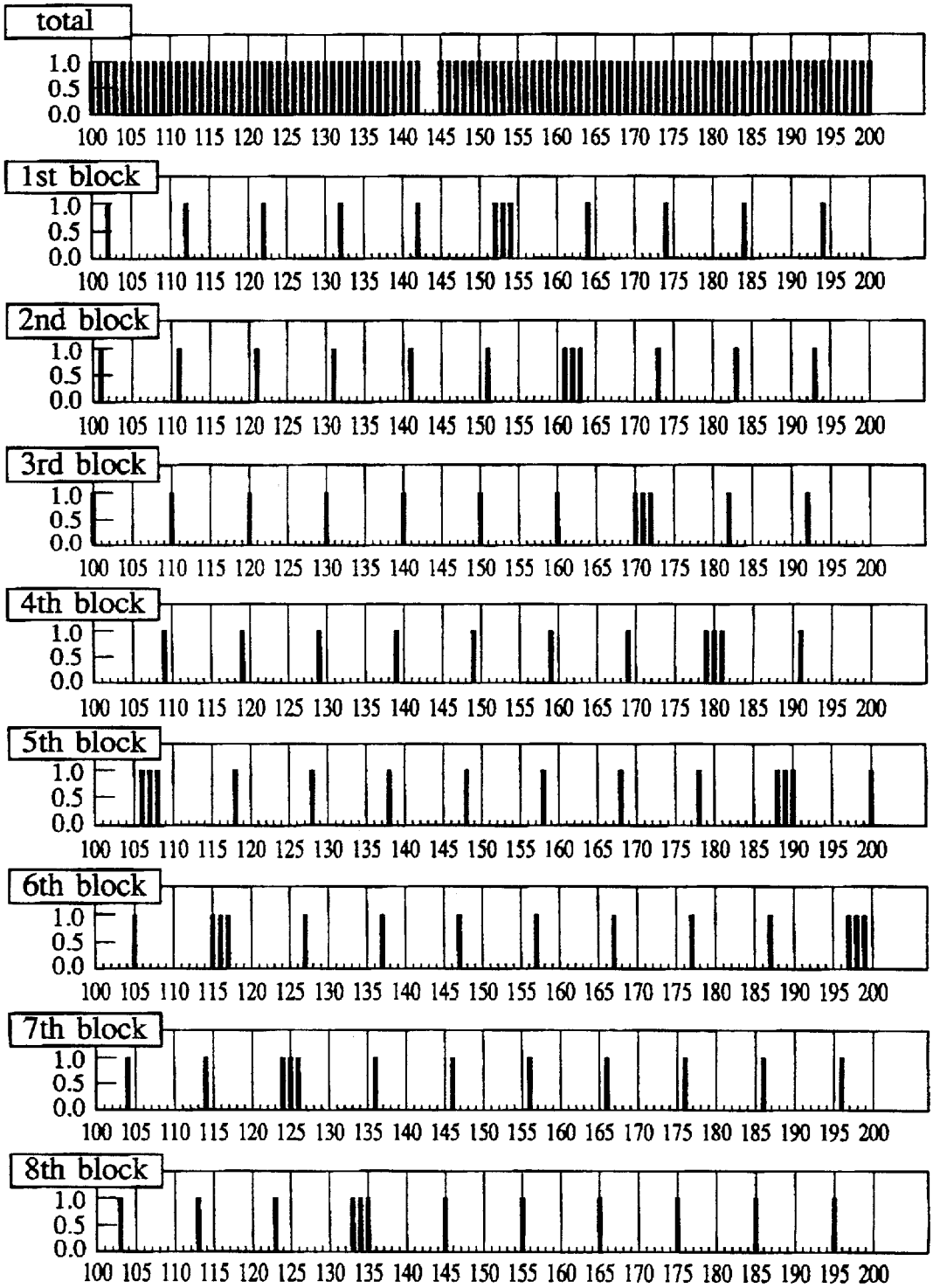
FIG. 22B is a chart showing the timed relationship of block driving in the sixth embodiment.

FIGS. 22A and 22B show an example in which the total number of blocks is eight. In this example, because of n=8, m=8, a=1, b=3 and therefore n=m, the formula (3) is still applied and the pulse interval is 9 μs.

Figure 23A:
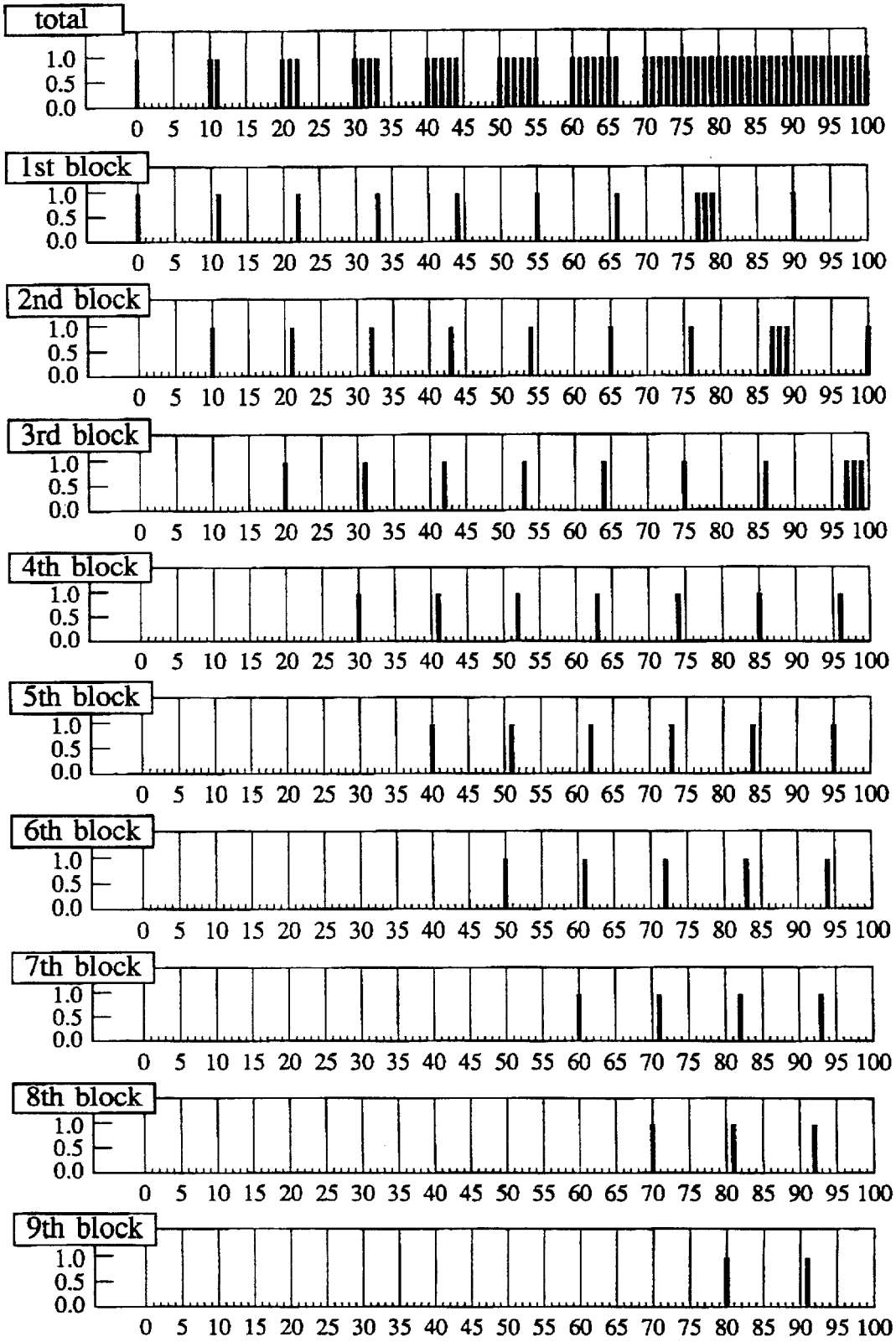
FIG. 23A is a chart showing the timed relationship of block driving in the sixth embodiment.
Figure 23B:
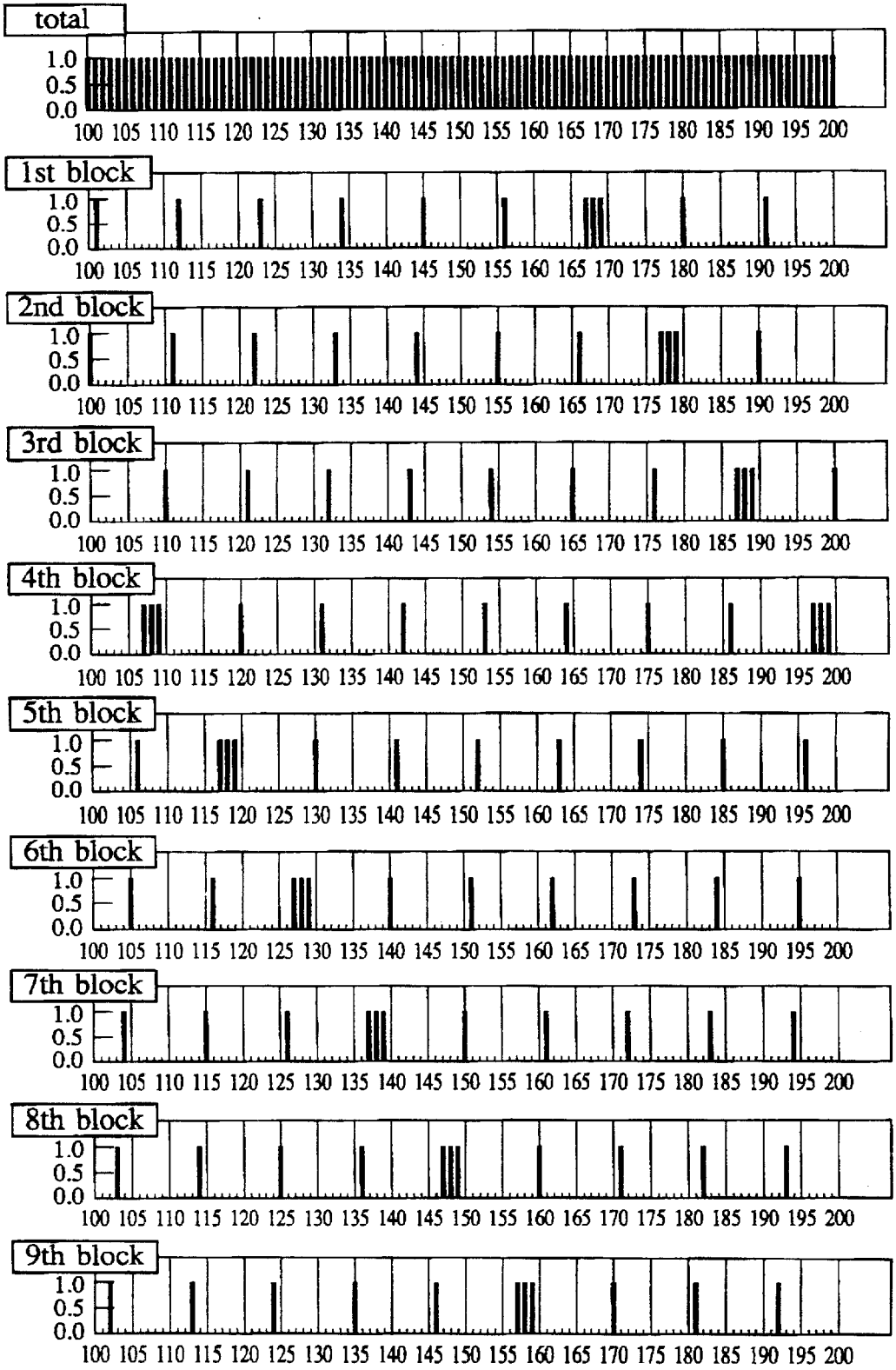
FIG. 23B is a chart showing the timed relationship of block driving in the sixth embodiment.

FIGS. 23A and 23B show an example in which the total number of blocks is nine. In this example, because of n=9, m=8, a=1, b=3 and therefore n>m, the formula (4) is applied and the pulse interval is 10 μs.

It is apparent that the timed relationships shown in the various examples of the sixth embodiment can be achieved by modifying the number of counters provided in the timing controller 105. Additionally, the maximum driving frequency is about 15.9 KHz in the example of FIGS. 18A and 18B in which the number of blocks is four, while it is about 11.1 KHz when the number of blocks is seven.

Although the formula (3) is applied to the cases of $n \leqq m$ in the above explanation with reference to FIGS. 16 to 22, the explanation represents the examples aiming to realize the driving method most efficiently. There is no problem even when the driving method is carried out in those cases by employing the formula (4). It should be thus understood that the driving method implemented by employing either formula is involved in the scope of the present invention.

Seventh Embodiment

A seventh embodiment employs a pulse train consisted of three preheating pulses each having a pulse width of 1 ps and one driving pulse having a pulse width of 4 μs. FIGS. 24A and 24B to FIGS. 26A and 26B show the timed relationship of block driving in different examples of the seventh embodiment wherein the number of blocks is 3, 4 and 5, respectively.

Figure 24A:
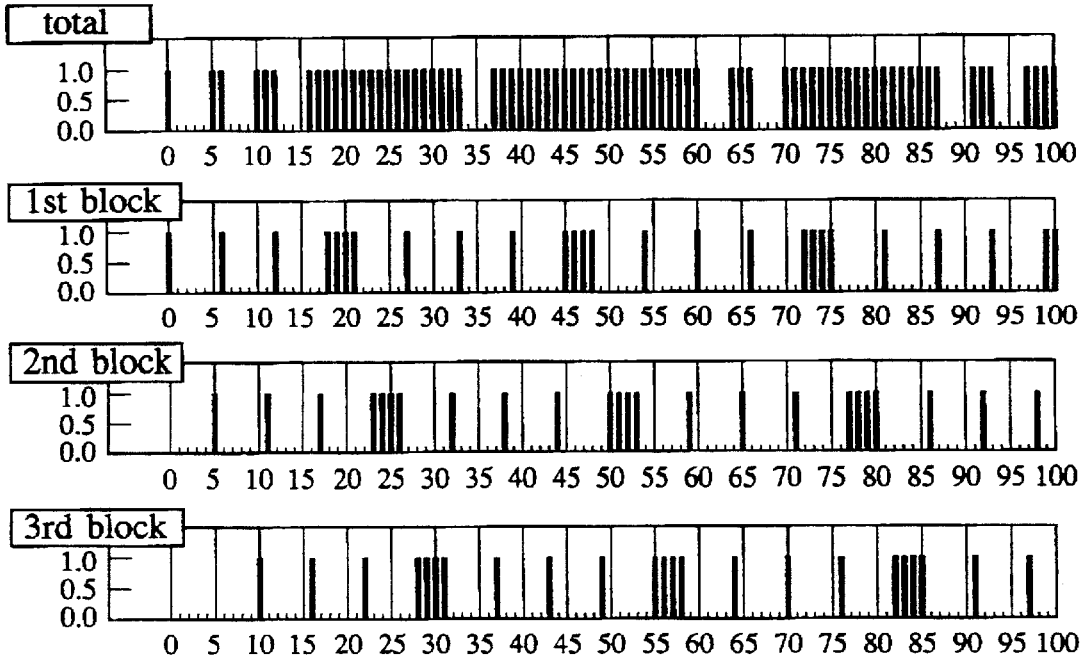
FIG. 24A is a chart showing the timed relationship of block driving in a seventh embodiment.
Figure 24B:
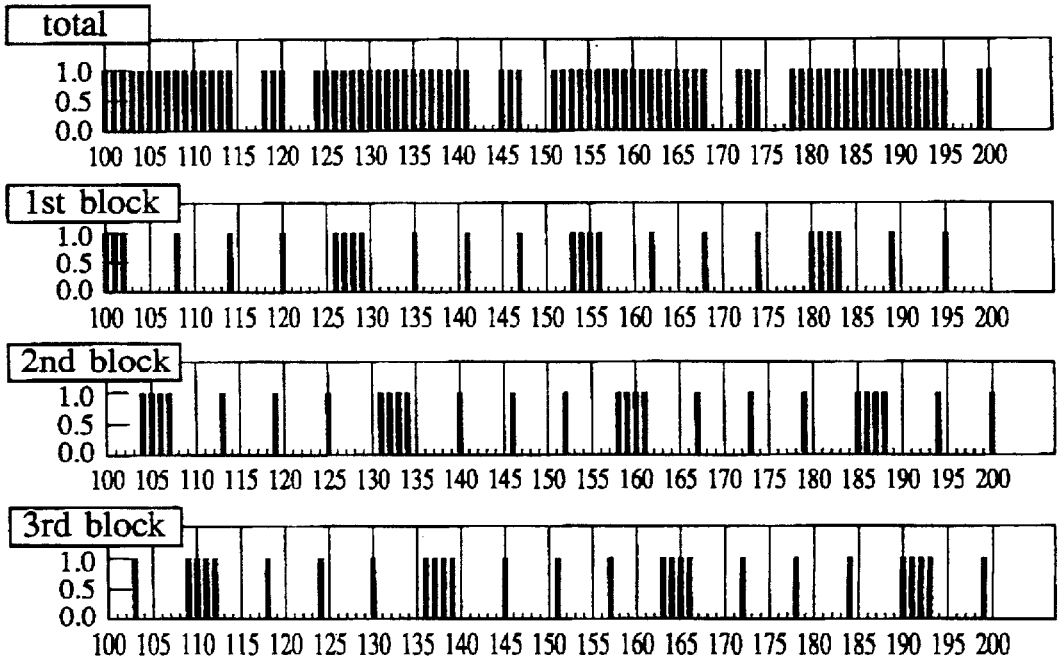
FIG. 24B is a chart showing the timed relationship of block driving in the seventh embodiment.

FIGS. 24A and 24B show an example in which the total number of blocks is three. In this example, because of n=3, m=4, a=1, b=4 and therefore n<m, the formula (3) is applied and the pulse interval is 5 μs.

Figure 25A:
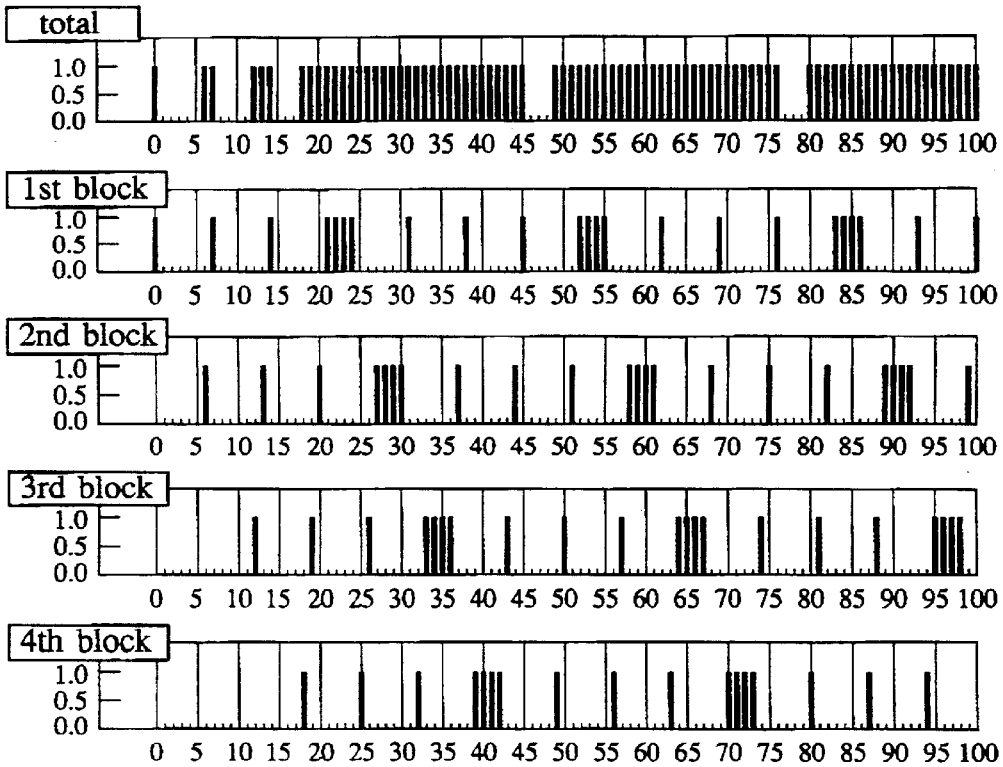
FIG. 25A is a chart showing the timed relationship of block driving in the seventh embodiment.
Figure 25B:
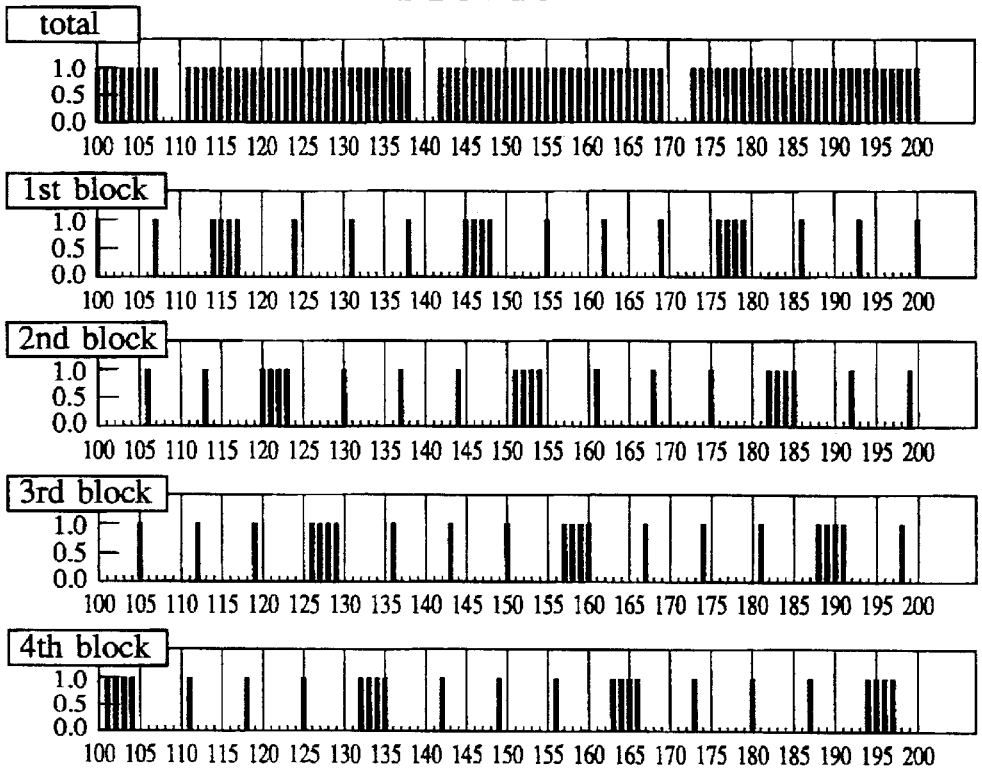
FIG. 25B is a chart showing the timed relationship of block driving in the seventh embodiment.

FIGS. 25A and 25B show an example in which the total number of blocks is four. In this example, because of n=4, m=4, a=1, b=4 and therefore n=m, the formula (3) is applied and the pulse interval is 6 μs.

Figure 26A:
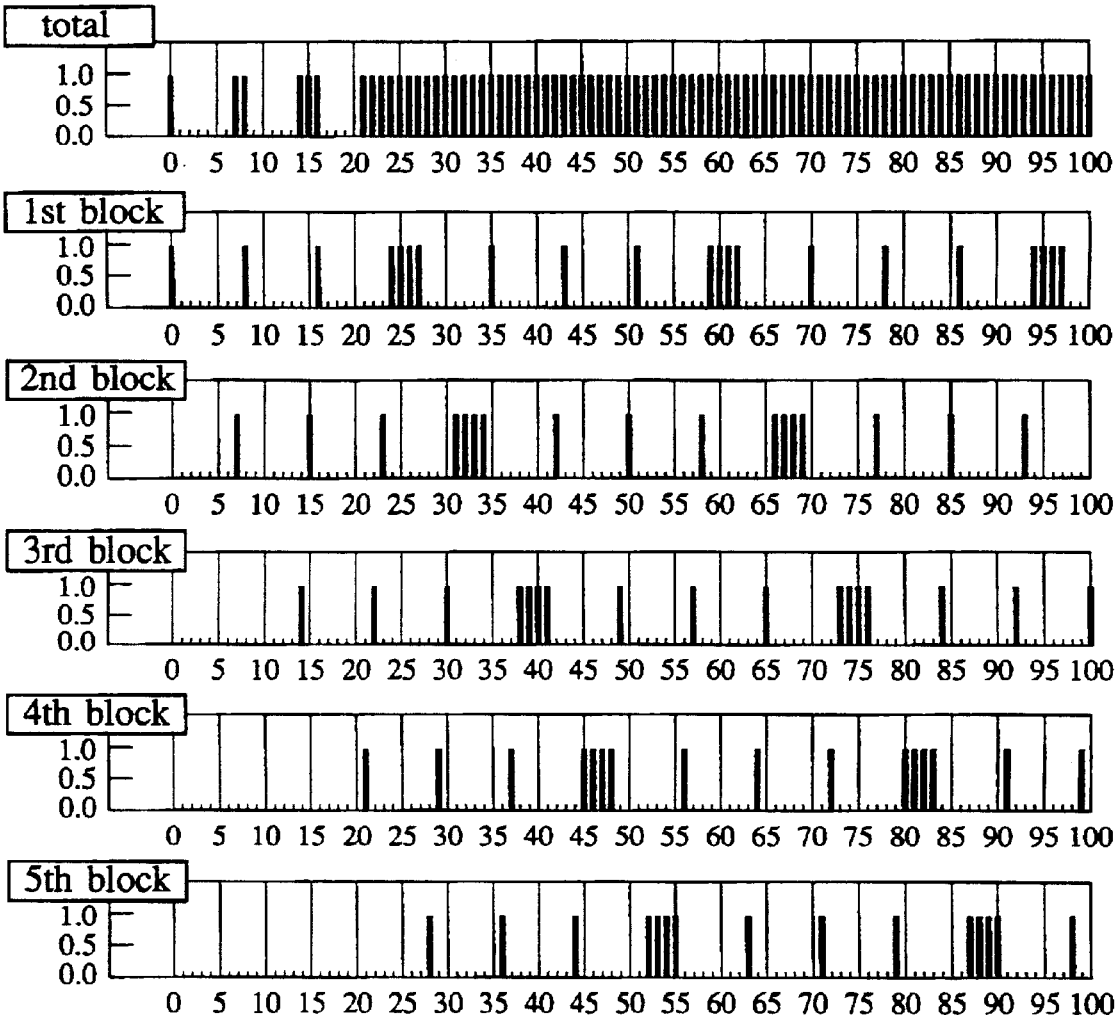
FIG. 26A is a chart showing the timed relationship of block driving in the seventh embodiment.
Figure 26B:
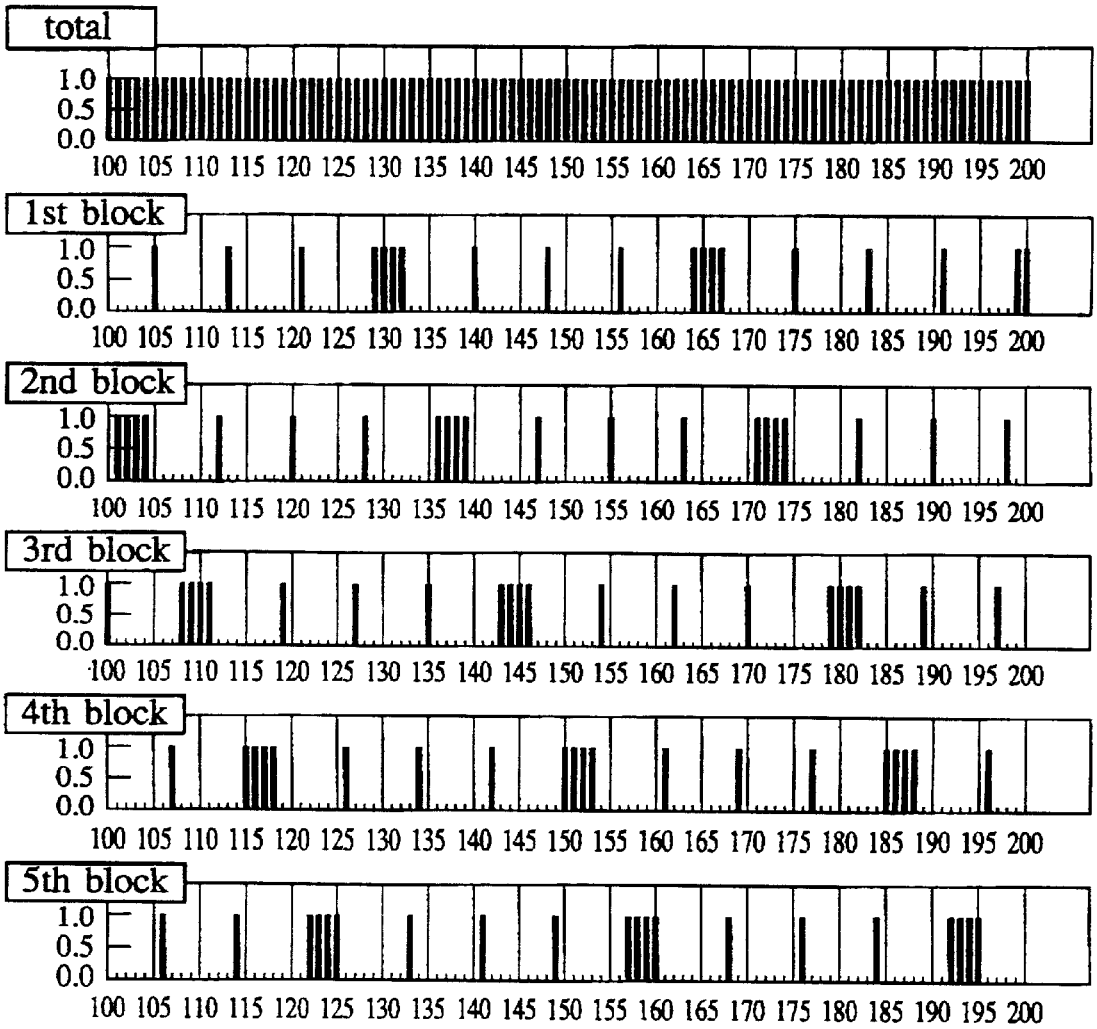
FIG. 26B is a chart showing the timed relationship of block driving in the seventh embodiment.
Figure 27:
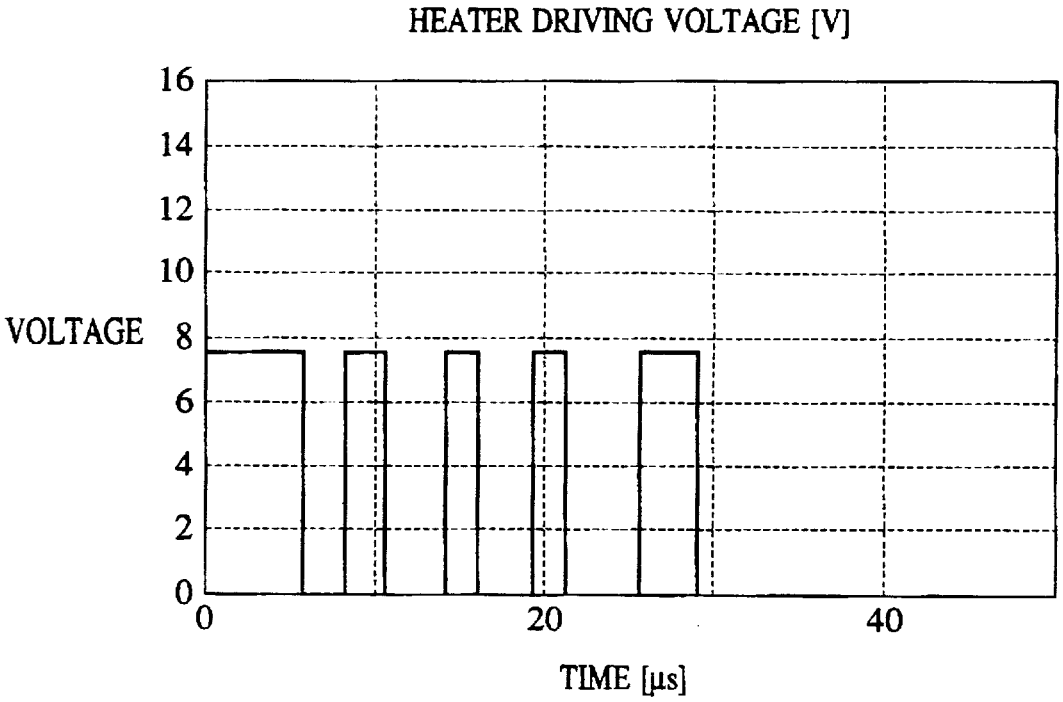
FIG. 27 is a graph for explaining an example of the timing at which a plurality of preheating pulses and a driving pulse are applied.
Figure 28:
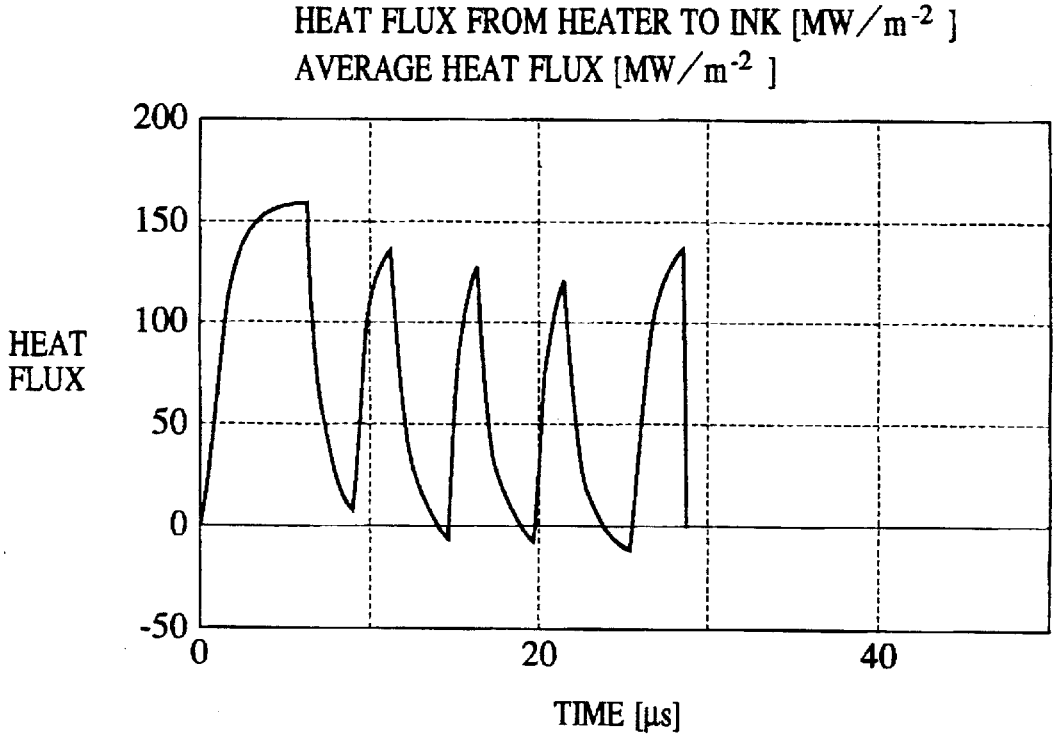
FIG. 28 is a graph showing heat flux produced when a head is driven with the pulse application timing shown in FIG. 27.
Figure 29:
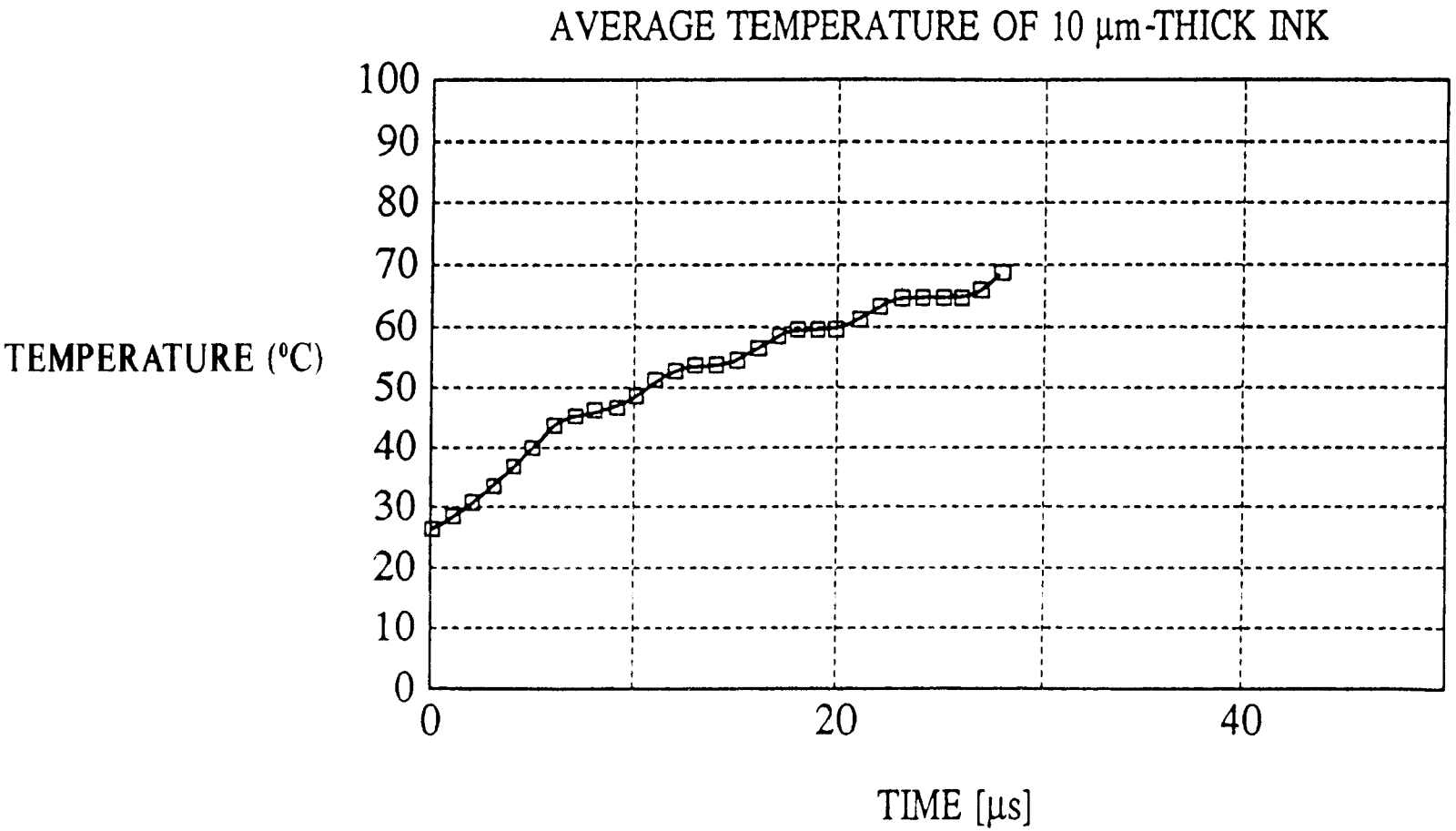
FIG. 29 is a graph showing changes in average temperature of ink being 10 $\mu$m thick resulted from the pulse application timing shown in FIG. 27.

FIGS. 26A and 26B show an example in which the total number of blocks is five. In this example, because of n=5, m=4, a=1, b=4 and therefore n>m, the formula (4) is applied and the pulse interval is 7 μs.

With the driving methods according to the various embodiments explained above, it is possible to prevent driving signals of different blocks from overlapping with each other even in the case of so-called block driving, i.e., in the case of driving the head by the use of a pulse train including a plurality of preheating pulses and a driving pulse which has a different pulse width from that of the preheating pulses. Therefore, a power supply is kept from undergoing a load larger than the power required for driving one block, and ink can be ejected with an inexpensive device. As a result, a driving mode which is suitable for ejecting the above-stated ink having the transition temperature under block driving can be achieved. Consequently, heating desired for developing transition of the.ink state can be performed without heating a recording material, while enabling the ink to eject in a satisfactory manner.

Thus, the transition of the ink state can be brought about on the surface of the recording material without causing any substance change of the ink, and recording quality can be improved. Further, since image forming does not depend on only evaporation and permeation in the combination of the recording method and the ink according to the present invention, it is possible to simultaneously solve the problem of feathering and bleeding which must be obviated to realize high-quality recording while providing a high value of O.D.

The above embodiments have been described on the method of carrying out image recording by heating and ejecting the ink having the transition temperature with multiple preheating pulses. However, the driving method of the present invention is not limited to the usage in combination with such a special ink, but applicable to ejection of other conventional ink as well. Application of the driving method of the present invention to the conventional ink is also very effective in increasing the speed and amount of ink ejected.

The present invention may be applied to not only a system comprising a plurality of devices (such as a host computer, an interface unit, a reader and a printer), but also an equipment comprising a single device (e.g., a copying machine or a facsimile).

It is needless to say that the object of the present invention can also be achieved by supplying, to a system or equipment, a storage medium which stores program codes of software for realizing the function of any of the above-described embodiments, and causing a computer (or CPU and MPU) in the system or equipment to read and execute the program codes stored in the storage medium.

In such a case, the program codes read out of the storage medium serve in themselves to realize the function of any of the above-described embodiments, and hence the storage medium storing the program codes constitutes the present invention.

Storage mediums for use in supplying the program codes may be, e.g., floppy disks, hard disks, optical disks, photomagnetic disks, CD-ROM's, CD-R's, magnetic tapes, nonvolatile memory cards, and ROM's.

Also, it is a matter of course that the function of any of the above-described embodiments is realized by not only a computer reading and executing the program codes, but also an OS (Operating System) or the like which is working on the computer and executes part or whole of the actual process to realize the function. Thus, the latter case is naturally involved in the concept of the present invention.

Further, it is a matter of course that the present invention involves such a case where the program codes read out of the storage medium are written into a memory built in a function extension board mounted in the computer or a function extension unit connected to the computer, and a CPU incorporated in the function extension board or unit executes part or whole of the actual process in accordance with instructions from the program codes, thereby realizing the function of any of the above-described embodiments.

A description will now be made of ink for ink jet recording which can be employed in the above-described embodiments.

A high molecule which is mixed in the ink suitable for the driving method of the present invention and has a property of increasing viscosity in a thermally reversible manner, i.e., which dissolves in a solvent isolatedly below the transition temperature, but aggregates to increase viscosity above the transition temperature can be used. The term "high molecule having a property of increasing viscosity in a thermally reversible manner" means such a high molecule that viscosity of its aqueous solution, aqueous suspension, etc. increases above a certain temperature (transition temperature) and the relationship between temperature and viscosity is reversible.

The high molecule to be mixed in the ink suitable for the driving method of the present invention is a water-soluble vinyl-based polymer (A) containing, as a construction unit, 50 wt % or more of vinyl-based carboxylic ester (a) which is an alkylene oxide adduct of an active hydrogen compound having a nitrogen containing ring, the vinyl-based carboxylic ester (a) being (metha-)acrylic ester produced by adding 1–20 mol of ethylene oxide and/or propylene oxide to (substituted) morpholine.

The active hydrogen compound having a nitrogen containing ring is a compound having active hydrogen necessary for addition of the nitrogen containing ring and the alkylene oxide. Examples of the active hydrogen compound include nitrogen-containing alicyclic compounds [those having an aziridine ring such as aziridine and 2-methylaziridine; those having a pyrrolidine ring such as a pyrrolidine, 2-methylpyrrolidine, 2-pyrrolidone, and succinimide; those having a piperidine ring such as piperidine, 2-methylpiperidine, 3,5-dimethylpiperidine, 2-ethylpiperidine, 4-piperidinopiperidine, 4-pyrrolidinopiperidine, and ethylpipecolinate; those having a piperazine ring such as 1-methyl piperazine and 1-methyl-3-piperazine; and those having a morpholine ring such as morpholine, 2-methylmorpholine, and 3,5-dimethyl-morpholine], ϵ-caprolactam, and nitrogen-containing unsaturated cyclic compounds such as 3-pyrroline, 2,5-dimethyl-3-pyrroline, 2-hydroxypyridine, 4-pyridine-carbinol, and 2-hydroxypyrimidine.

Of those examples, the active hydrogen compound is preferably a nitrogen-containing alicyclic compound, more preferably a compound having a piperidine ring, most preferably a compound having a morpholine ring. Also, the alkylene oxide used in the ink suitable for the driving method of the present invention is preferably ethylene oxide, propylene oxide and butylene oxide.

Adjustment of the transition temperature of the high molecule used in the present invention can be easily realized by controlling the kind of the alkylene oxide or the number of mols of the added oxide. For example, the transition temperature is raised by increasing the number of mols of the added oxide when ethylene oxide is used, and it is lowered by increasing the number of mols of the added oxide when propylene oxide or butylene oxide is used. The number of mols of the alkylene oxide added is preferably in the range of 1–20 mol, more preferably in the range of 1–5 mol.

The above ester (a) is ester of the above-mentioned alkylene oxide adduct and a vinyl-based carboxylic acid. The vinyl-base carboxylic acid is preferably (metha-)acrylic acid, acrylic acid, maleic acid, vinyl benzoid acid, and any derivative of these acids. Especially preferable examples of the vinyl-based carboxylic acid are (metha-)acrylic acid and a derivative of (metha-)acrylic acid. Further, the vinyl-based polymer (A) is a polymer of one or more kinds of the ester (a), or a copolymer of one or more kinds of the ester (a) and another vinyl-based monomer (b), and is only required to contain, as a construction unit, 50 wt % or more of one or more kinds of the ester (a).

Preferable examples of another vinyl-based monomer (b) include hydroxyethyl (metha-)acrylate, polyethyleneglycol mono(metha-)acrylate, (metha-)acrylic amide, N-hydroxymethyl (metha-)acrylic amide, N-vinyl-2-pyrroridone, (metha-)acrylic acid, (anhydrous) maleic acid, styrene sulfonate, N,N-dimethylaminoethyl (metha-)acrylate, N,N-dimethylaminopropyl (metha-)acrylate, methyl (metha-)acrylate, butyl (metha-)acrylate, glycidyl (metha-)acrylate, N-butyl (metha-)acrylic amide, N-cyclohexyl (metha-)acrylic amide, (metha-)acrylonitrile, styrene, vinyl acetate, vinyl chloride, butadine, and isoprene.

Of the monomers making up the vinyl-based polymer (A), the content ratio of the ester (a) takes part in change of a temperature range where viscosity of the ink increases. To make the temperature range as small as possible, the content ratio of the ester (a) is preferably not less than 50 wt %, more preferably not less than 70 wt %.

When the above-mentioned high molecule is in the form of an aqueous solution, viscosity of the solution lowers with an increase in solution temperature until a certain transition temperature, but rises with a high gradient once the solution temperature exceeds the transition temperature. Another feature is that the relationship between temperature and viscosity shows no appreciable hysteresis. When a 5% aqueous solution of the above-mentioned high molecule is heated at a temperature rising rate of 1° C./min, viscosity of the solution increases at a gradient of not less than 40 mPa·s/°C. with respect to temperature above the transition temperature. Therefore, a satisfactory effect of increasing viscosity of the ink can be achieved on a recording material.

Also, as stated above, the transition temperature of the high molecule can be easily adjusted to the desired temperature by changing the kind of the alkylene oxide in the ester (a) as a component of the high molecule or the number of mols of the added oxide. Accordingly, the ink having the transition temperature is adaptable for a variety of recording heads in which a temperature rising characteristic varies depending on the head structure and the recording method. Since the transition temperature depends on the kind and the amount of components added in the ink, such as a salt, a surfactant and a solvent, the transition temperature is required to be determined in consideration of the ink composition actually used.

Figure 1:
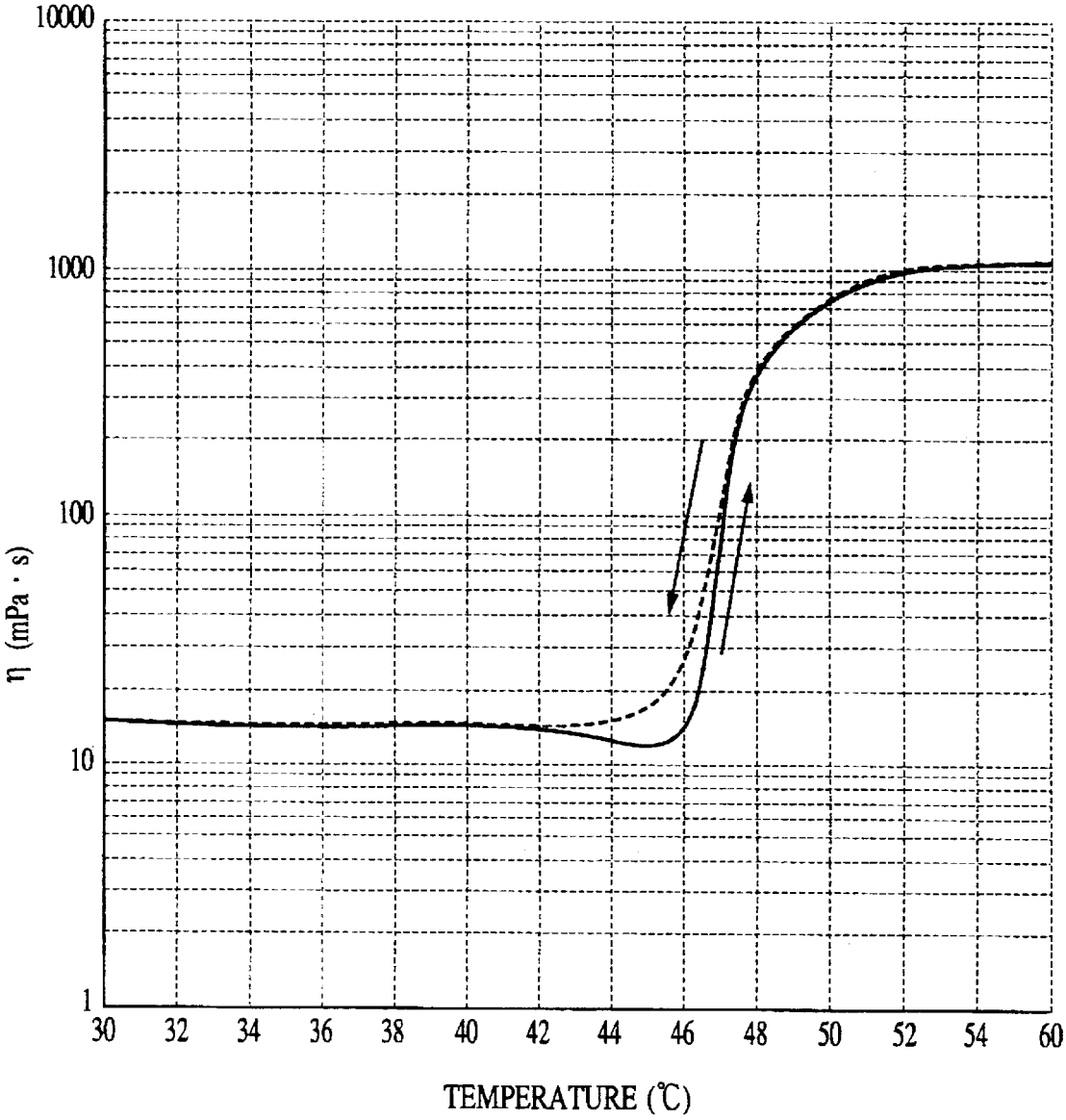
FIG. 1 is a graph showing one example of the relationship between temperature and viscosity of a 5% aqueous solution of a high molecule, the solution having a transition temperature.

One example of the relationship between temperature and viscosity of the 5% aqueous solution of the above-mentioned high molecule is plotted in FIG. 1. A high molecular compound used for measuring the relationship of FIG. 1 was prepared by putting 100 parts of 2-(2-morpholinoethoxy) ethylmethacrylate (ester of morpholine adduct of 2-mol ethylene oxyid and methacrylic acid) and 0.1 part of 2,2-azobis(2,4-dimethylvaleronitrile) in an ampule, enclosing the ampule after freezing and degassing, and then causing a mixture to polymerize for 8 hours at 60° C. In the graph of FIG. 1, a solid line represents the case where the temperature of the aqueous solution was raised at a rate of 1° C./min, and a dashed line represents the case where the temperature of the aqueous solution was lowered at a rate of 1° C./min. As shown, the transition temperature is 46° C.

In the ink for use with the driving method of the present invention, the molecular weight and the amount of the high molecule added in the ink is required to fall within the allowable range (not more than 20 mPa·s) of ink viscosity for ink jet recording. To this end, the weight-average molecular weight of the high molecule is preferably in the range of 10,000 to 1,000,000. If the weight-average molecular weight of the high molecule exceeds 1,000,000, the molecular chain would be too long, resulting in disadvantages that the re-dissolving speed would reduce, or that the ink would show a threading property. On the other hand, if it is less than 10,000, the effect of increasing viscosity of the ink would be weak and therefore the amount of the high molecule added would be required to increase up to, preferably, 2–10 wt %. When the weight-average molecular weight of the high molecule is 1,000,000, a small amount of the high molecule added can provide the satisfactory effect of increasing viscosity of the ink, and the preferable amount of the high molecule added is in the range of 0.005–3%. In addition, even when high molecules having different molecular weights from each other are used in a combined manner, the advantageous effect of the present invention can also be sufficiently achieved.

Further, the inventors found that although the ink for use with the driving method of the present invention exhibits satisfactory recording characteristics by mixing therein the above-mentioned high molecule having a property of increasing viscosity in a thermally reversible manner, the effect of increasing viscosity of the ink can be still more enhanced in the range above the transition temperature by adding a hydrophobic micro-particle dispersion to the ink. More specifically, above the transition temperature, the high molecule having a property of increasing viscosity in a thermally reversible manner decreases its hydration property and comes into the state of a hydrophobic droplet. When a hydrophobic (polymer) micro-particle dispersion, e.g., an acrylic emulsion, coexists in such a state, it is believed that because the affinity between the high molecule and the hydrophobic micro-particle is greater than the affinity between the high molecule and water, the high molecule drags in the micro-particle dispersed in the solution and merges with it, thereby increasing the solution viscosity as compared with the case where the high molecule solely exits in the solution. Although an increase rate of the effect of increasing viscosity of the ink varies depending on the kind and the amount of micro-particles added, as well as the kind and the amount of a dispersant used, the experiments conducted by the inventors showed an increase rate of 10–15%. Examples of micro-particles usable for that purpose are an acrylic-based emulsion, styrene-acrylic-based emulsion, styrene-divinylbenzene-based emulsion, urethane-based emulsion, silicone-acrylic-based emulsion, etc. It is preferable that such an emulsion containing a solid component of 8–40% with a particle size of 10–80 nm and pH 6.0–8.5 be added in the ink in amount of 0.1–10 wt %. A polymer selected for the micro-particles should be high in both heat resistance and hardness. The higher a degree of cross-linking, the more suitable is the polymer for ink jet recording. In the method of recording an image by acting thermal energy upon ink, particularly, the critical temperature of the polymer is desirable to be higher than that of water which is a main ink solvent. From practical point of view, the polymer preferably has a 10% weight-reduction temperature Tb not less than 300° C. Of the emulsions cited above, the styrene-divinylbenzene-based emulsion (Tb: 380° C.) having a high degree of cross-linking is especially preferable.

A color material for use in the ink suitable for the driving method of the present invention will be described below.

Direct dyes, acid dyes, food dyes, basic dyes, reactive dyes, etc. are usable so long as they can react with the high molecule having a property of increasing viscosity in a thermally reversible manner, which is mixed in the ink suitable for the present invention, and they act to promote merging of high molecular chains above the transition temperature. Those dyes have a hydrophobic coloring skeleton occupying a greater part, several soluble groups such as sulfonate (—$SO_3M$), carboxylate (—COOM) or ammonium salt ($NH_4X$), and a hydrogenating group such as a hydroxyl group (—OH), amino group (—$NH_2$) or imino group (—NH—), and therefore it can form a complex with the above-mentioned high molecule. Disperse dyes are water-insoluble in themselves, but they can also be used similarly to the above-cited dyes because an apparent ionic property of the disperse dyes is anionic as with direct dyes when used in combination with a polycyclic anionic activating agent, e.g., naphthalenesulfonate, as a dispersant.

Practical examples of the usable dyes include black dyes such as C.I. Direct Black 17, C.I. Direct Black 19, C.I. Direct Black 62, C.I. Direct Black 154, IJA 260, IJA286, C.I. Food Black 2, C.I. Reactive Black 5, C.I. Acid Black 52, and C.I. Project Fast Black 2; yellow dyes such as C.I. Direct Yellow 11, C.I. Direct Yellow 44, C.I. Direct Yellow 86, C.I. Direct Yellow 142, C.I. Direct Yellow 330, C.I. Acid Yellow 3, C.I. Acid Yellow 38, C.I. Basic Yellow 11, C.I. Basic Yellow 51, C.I. Disperse Yellow 3, C.I. Disperse Yellow 5, and C.I. Reactive Yellow 2; magenta dyes such as C.I. Direct Red 227, C.I. Direct Red 23, C.I. Acid Red 18, C.I. Acid Red 52, C.I. Basic Red 14, C.I. Basic Red 39, C.I. Disperse Red 60, and IJR-016; and cyan dyes such as C.I. Direct Blue 15, C.I. Direct Blue 199, C.I. Direct Blue 168, C.I. Acid Blue 9, C.I. Acid Blue 40, C.I. Basic Blue 41, C.I. Acid Blue 74, and C.I. Reactive Blue 15. In addition to the above dyes, those dyes which are given higher water resistance by reducing the number of the soluble groups, or which have a special grade in point of solubility being sensitive to a pH-value. The content of the dye in the ink is freely selectable within the range of solubility and preferably in the range of 1–8 wt % in the normal case. Further, the content of the dye in the ink is preferably in the range of 3–10 wt % when recording is made on cloth, a metal (allumilite) or the like, and in the range of 1–8 wt % when gradation is required in a recorded image.

As a second color material, carbon black and organic pigments can be employed. Because of being used in combination with a dispersant similarly to the disperse dyes, those color materials are capable of interacting with the above-mentioned high molecular compound through the dispersant. Therefore, those color materials are usable so long as they are adapted for ink jet recording. Among them, carbon black employed for black ink is desired to be manufactured by the furnace process or the channel process, and to have a primary particle size of 10–40 m$\mu$, a specific surface area of 50–300 $m^2/g$ based on the BET method, and a DBP oil absorption amount of 40–150 ml/100 g. Practical examples of the second color material include carbon black (No. 2300, No. 900, MCF88, No. 33, No. 40, No. 45, No. 52, MA7, MA8 and #2200B manufactured by Mitsubishi Chemical Industries, Ltd.; Raven 1255 and Raven 1060 manufactured by Columbia Carbon Co.; Rega 1330R, Rega 1660R and Mogu L manufactured by Cabot Co.; Color Black FW18, Printex 35 and Pretenx U manufactured by Degussa Co., etc.), carbon black having surface subjected to oxidizing or plasma process, and organic pigments such as insoluble azo pigments, soluble azo pigments, phthalocyanine-based pigements, isoindoline-based high-grade pigments, quinacridone high-grade pigments, dioxane violet, and perynone-perylene high-grade pigments. In addition, the so-called dyed lakes, which are obtained by coloring moisture-resistant pigments with dyes, are also taken into the group of the above-cited pigments and can be used as the second color material to be mixed in the ink suitable for the driving method of the present invention.

As a third color material, there is a color material micro-particle which is obtained by coupling a dye to the surface of a micro-particle and making the dye insoluble to water. In the color material micro-particle explained here, a dye is chemically bonded to an organic micro-particle of the core/shell structure having a reactive group on the shell surface. The reactive group is selected from among a carboxylic group, hydroxyl group, amino group, epoxide group, amide group, hydroxymethyl group, and isocyanate group.

A core portion of the core/shell type micro-particle is a styrene-divinylbenzene-based polymer having a high degree of cross-linking, and any of the above reactive groups is introduced to the shell surface. The thickness of a shell portion is preferably about 30% of the micro-particle size so that it is sufficiently colored with a dye. One practical preferable example is the micro-particle dispersion S2467 manufactured by Japan Synthetic Rubber Co., Ltd. When employed as the third color material, properties of S2467 are selected to have a particle size of 10 nm–80 nm and a solid component of 10%. If the shell surface of the core/shell type micro-particle is denatured by an amino group, the resulting shell portion can form ionic bonding with a dye having an anionic coloring ion like direct dyes, for example, and hence can be easily colored with such a dye. Also, if the shell surface of the core/shell type micro-particle is denatured by a carboxylic group, the resulting shell portion can form ionic bonding with a dye having an cationic coloring ion like basic dyes, for example, and hence can be easily colored with such a dye.

The color material micro-particle after dyeing can be used as the third color material to be mixed in the ink suitable for the driving method of the present invention, by being handled in a like manner to the above-mentioned pigments. Addition of the color material micro-particle also contributes to improving the effect of increasing viscosity of the ink as with addition of a micro-particle dispersion. Further, the color material micro-particle increases water resistance in comparison with the case of using dyes alone, and can enhance fastness of a recorded image.

It is a matter of course that although the three types of color materials explained above may be used solely, the combined use of color material micro-particle and dye, or the combined use of color material micro-particle and carbon black or dye is advantageous in further improving quality of a recorded image, e.g., in points of enhancing color development due to the improved effect of increasing viscosity of the ink, and making sharper the edges of recording dots as a result of inclusion of particles.

The ink suitable for the driving method of the present invention may additionally include a moisture retaining agent and a dye dissolving aid, cited below, to provide reliability, stability in preservation, and adjustability in permeation of the ink, thereby making the ink more adapted for ink jet recording.

Materials of those agents include alkylene glycols such as 1,2-ethanediol, 1,2-propanediol, 1,3-propanediol, 1,2-butanediol, 1,3-butanediol, 1,4-butanediol, 2,3-butanediol, 1,5-pentanediol, 1,7-heptanediol, 2-methyl-2,4-pentanediol, 2-ethyl-1,3-hexanediol, glycerin, diethylene glycol, triethylene glycol, tetraethylene glycol, polyethylene glycol 200, dipropylene glycol, 2,2'-thiodiethanol, and 1,2,6-hexanetriol; alcohol amines such as monoethanol amine, triethanol amine, and triethanol amine; non-protonic polar solvents such as dimethyl-foramide, dimethylacetamide, dimethylsulfoxide, sulpholane, and 1,3-propanesultone; lower alkyl ethers of polyhydric alcohols such as 1,2-dimethoxyethane, 1,2-diethoxyethane, 1,2-dibutoxyethane, diethyleneglycol dimethyl ether, diethyleneglycol diethyl ether, diethyleneglycol dibutyl ether, 2-methoxyethanol, 2-ethoxyethanol, 2-(methoxymethoxy)ethanol, 2-butoxyethanol, diethyleneglycol monomethyl ether, diethyleneglycol monoethyl ether, diethyleneglycol monobutyl ether, triethyleneglycol monomethyl ether, 1-methoxy-2-propanol, 1-ethoxy-2-propanol, dipropyleneglycol, dipropyleneglycol monomethyl ether, dipropyleneglycol monoethyl ether, and tripropyleneglycol monoethyl ether; formamide, 2-pyrrolidone, N-methyl-2-pyrrolidone, 1,3-dimethylimidazolizinone, sorbitol (Sorbit), urea, 1,3-bit(β-hydroxyethyl)urea, etc. The content of any of the above materials in the ink is preferably in the range of 1–30% of the total weight of the ink.

When the above-explained ink is used for ink jet recording, it is more effective in improving an ejection property of the ink to add any of alkyl alcohols such as methanol, ethanol, propanol, 2-propanol, 1-butanol and 2-butanol. The content of the alkyl alcohol in the ink is preferably in the range of 1–10% of the total weight of the ink.

In addition, if necessary, other additives such as a surfactant, an anticorrosive, a fungicide, an antioxidant, a pH-adjusting agent, etc. may be added to the ink.

The ink explained above is effectively employed in ink jet recording. In one of ink jet recording methods, an ink droplet is ejected by applying thermal energy to ink and generating a bubble in the ink. The above-explained ink is particularly suitable for use in such a recording method.

According to the present invention, as described above, the timed relationship in driving of a pulse train including pulses having different pulse widths from each other is properly adjusted in control of a recording process in accordance with block driving so that the driving timing of the pulse train is avoided from overlapping with each other between blocks. As a result, a load imposed on the power supply during the operation can be reduced.

In addition to such a reduction in load imposed on the power supply, according to the present invention, the ink having the transition temperature can be ejected in a sufficiently heated state. It is thus possible to appropriately control behavior of the ink on a recording material and to achieve image recording with high quality.

What is claimed is:

1. A recording apparatus for recording an image on a recording medium, comprising:

a recording head having a plurality of recording elements for recording an image by utilizing heat;

pulse generating means for generating a driving pulse train consisting of a number (m) of pulses including a number (m−1) (m−1)>2) of preheating pulses each having a pulse width (a) and including at least first and second preheating pulses, and one main driving pulse having a longer pulse width (b) than the pulse width (a) of said preheating pulses, the intervals between said pulses in the driving pulse train being equal and each not less than (a×(m−1)+b); and driving means for dividing said plurality of recording elements into multiple blocks, and driving said recording elements in units of blocks to perform recording in such a manner that just before the second preheating pulse of the driving pulse train for one block, with the second preheating pulse being applied after the first preheating pulse of the driving pulse train for the one block, the driving pulse train for the next block is started.

2. The recording apparatus according to claim 1, wherein said pulse generating means generates the driving pulse train with the intervals between the pulses being equal to (a×(n−2)+b) when a total number (n) of said blocks is not more than the number (m) of the pulses of said driving pulse train, and equal to (a×(m−1)+b) when the total number (n) of said blocks is more than the number (m) of the pulses of said driving pulse train.

3. The recording apparatus according to claim 1, wherein said pulse generating means starts to supply the driving pulse train for a first block in a next recording cycle just after a main driving pulse for the (n−m+1)-th block in the previous recording cycle when a total number (n) of said blocks is more than the number (m) of the pulses of said driving pulse train.

4. The recording apparatus according to claim 1, wherein said pulse generating means starts to generate the driving pulse train for a first block in a next recording cycle just after a main driving pulse for the (n−m+1)-th block in a previous recording cycle when a total number (n) of said blocks is more than the number (m) of the pulses of said driving pulse train.

5. A recording apparatus for recording an image on a recording medium, comprising:

a recording head having a plurality of recording elements for recording an image by utilizing heat;

pulse generating means for generating a driving pulse train consisting of a number (m) of pulses including a plurality of preheating pulses, including at least first and second preheating pulses, and one main driving pulse, intervals between said pulses in the driving pulse train being each not less than a total time of pulse widths of said pulses in the driving pulse train; and driving means for dividing said plurality of recording elements into multiple blocks, and driving said recording elements in units of blocks to perform recording in such a manner that just before the second preheating pulse of the driving pulse train for one block, with the second preheating pulse being applied after the first preheating pulse of the driving pulse train for the one block, the first preheating pulse of the driving pulse train for the next block is applied.

6. The recording apparatus according to claim 1 or 5, wherein said recording head includes orifices provided corresponding to said recording elements, and flow passages communicating with said orifices, and wherein said preheating pulses are each a pulse for heating ink to such an extent as not producing a bubble in the ink, and said main driving pulse is a pulse for heating the ink to produce a bubble in the ink and ejecting an ink droplet from one of said orifices under pressure produced upon generation of the bubble.

7. The recording apparatus according to claim 1 or 5, wherein said pulse generating means starts to supply the driving pulse train for a first block in a next recording cycle just before any of second and subsequent pulses of the driving pulse train for a last block in a previous recording cycle.

8. A method of controlling a recording apparatus including recording means in which a plurality of recording elements for recording an image by utilizing heat are divided into multiple blocks, and said recording elements are driven in units of blocks in accordance with a driving pulse train input for each of said blocks, said method comprising the steps of:

generating a driving pulse train consisting of a number (m) of pulses including a number (m−1) ((m−1)>2) of preheating pulses each having a pulse width (a) and including at least first and second preheating pulses, and one main driving pulse having a longer pulse width (b) than the pulse width (a) of said preheating pulses, intervals between said pulses in the driving pulse train being equal and each not less than (a×(m−1)+b); and dividing said plurality of recording elements into multiple blocks, and driving said recording elements in units of blocks to perform recording in such a manner that just before the second preheating pulse of the driving pulse train for one block, with the second preheating pulse being applied after the first preheating pulse of the driving pulse train for the one block, the driving pulse train for a next block is started.

9. The method of controlling the recording apparatus according to claim 8, wherein said pulse generating step generates the driving pulse train with the intervals between the pulses being each equal to (a×(n−2)+b) when a total number (n) of said blocks is not more than the number (m) of the pulses of said driving pulse train, and equal to (a×(m−1)+b) when the total number (n) of said blocks is more than the number (m) of the pulses of said driving pulse train.

10. The method of controlling the recording apparatus according to claim 8, wherein said pulse generating step starts to supply the driving pulse train for a first block in a next recording cycle just after the main driving pulse for the (n−m+1)-th block in a previous recording cycle when a total number (n) of said blocks is more than the number (m) of the pulses of said driving pulse train.

11. The method of controlling the recording apparatus according to claim 8, wherein said pulse generating step starts to generate the driving pulse train for a first block in a next recording cycle just after the main driving pulse for the (n−m+1)-th block in a previous recording cycle when a total number (n) of said blocks is more than the number (m) of the pulses of said driving pulse train.

12. A method of controlling a recording apparatus including recording means in which a plurality of recording elements for recording an image by utilizing heat are divided into multiple blocks, and said recording elements are driven in units of blocks in accordance with a driving pulse train input for each of said blocks, said method comprising the steps of:

generating a driving pulse train consisting of a number (m) of pulses including a plurality of preheating pulses, including at least first and second preheating pulses, and one main driving pulse, intervals between said pulses in the driving pulse train being each not less than a total time of pulse widths of said pulses in the driving pulse train; and dividing said plurality of recording elements into multiple blocks, and driving said recording elements in units of blocks to perform recording in such a manner that just before the second preheating pulse of the driving pulse train for one block, with the second preheating pulse being applied after the first preheating pulse of the driving pulse train for the one block, the first preheating pulse of the driving pulse train for a next block is applied.

13. The method of controlling the recording apparatus according to claim 8 or 12, wherein said recording means includes orifices provided corresponding to said recording elements, and flow passages communicating with said orifices, and wherein said preheating pulses are each a pulse for heating ink to such an extent as not producing a bubble in the ink, and said main driving pulse is a pulse for heating the ink to produce a bubble in the ink and ejecting an ink droplet from one of said orifices under pressure produced upon generation of the bubble.

14. The method of controlling the recording apparatus according to claim 8 or 12, wherein said pulse generating step starts to supply the driving pulse train for a first block in a next recording cycle just before any of second and subsequent pulses of the driving pulse train for a last block in a previous recording cycle.

* * * * *

UNITED STATES PATENT AND TRADEMARK OFFICE

CERTIFICATE OF CORRECTION

PATENT NO. : 6,322,183 B1
DATED : November 27, 2001
INVENTOR(S) : Kubota et al.

It is certified that error appears in the above-identified patent and that said Letters Patent is hereby corrected as shown below:

Column 1,
Line 38, "the.paper" should read -- the paper --.
Line 49, "62-181372," should read -- 62-181372 --.

Column 3,
Line 36, "be now" should read -- now be --.
Line 41, "mpa·s," should read -- mPa·s, --.

Column 11,
Line 59, "Is" should read -- is --.

Column 13,
Line 3, "input to" should read -- input to the --.

Column 14,
Line 38, "In" should read -- in --.
Line 40, "plurality." should read -- plurality --.
Line 52, "Is" should read -- is --.
Line 56, "Is" should read -- is --.

Column 16,
Line 32, "four," should read -- four. --.

Column 17,
Line 7, "1 ps" should read -- 1 μs --.
Line 38, "the.ink" should read -- the ink --.

Column 21,
Line 16, "ink in" should read -- ink in an --.
Line 23, "From" should read -- From a --.

UNITED STATES PATENT AND TRADEMARK OFFICE

CERTIFICATE OF CORRECTION

PATENT NO. : 6,322,183 B1
DATED : November 27, 2001
INVENTOR(S) : Kubota et al.

It is certified that error appears in the above-identified patent and that said Letters Patent is hereby corrected as shown below:

Column 22,
Line 28, "pigements" should read -- pigments --.

Signed and Sealed this

Twenty-third Day of April, 2002

*Attest:*

*Attesting Officer*

JAMES E. ROGAN
*Director of the United States Patent and Trademark Office*